US007441351B2

(12) United States Patent
Clark et al.

(10) Patent No.: US 7,441,351 B2
(45) Date of Patent: Oct. 28, 2008

(54) FOOTWEAR FOR HOSTILE ENVIRONMENTS

(75) Inventors: Douglas E. Clark, Durham, NH (US); Stephen David Opie, Arlington, MA (US); Jason Nevens, Dover, NH (US)

(73) Assignee: The Timberland Company, Stratham, NH (US)

( * ) Notice: Subject to any disclaimer, the term of this patent is extended or adjusted under 35 U.S.C. 154(b) by 358 days.

(21) Appl. No.: 11/206,237

(22) Filed: Aug. 17, 2005

(65) Prior Publication Data

US 2007/0039210 A1 Feb. 22, 2007

(51) Int. Cl.
*A43C 11/00* (2006.01)
*A43B 23/28* (2006.01)

(52) U.S. Cl. ..... 36/138; 36/45; 36/113; 36/56

(58) Field of Classification Search ..... 36/4, 36/113, 69, 14, 50.1, 109, 89, 7.3, 138, 45, 36/56, 59 C
See application file for complete search history.

(56) References Cited

U.S. PATENT DOCUMENTS 247,136 A * 9/1881 Vermilye ..... 36/56
404,449 A * 6/1889 Vail ..... 36/1
553,130 A * 1/1896 Norris ..... 36/56
582,961 A * 5/1897 Shoop ..... 36/56
913,695 A * 3/1909 Carroll ..... 36/56
1,042,870 A * 10/1912 Benninghaus ..... 36/56
1,478,467 A * 12/1923 Binns ..... 36/45
1,749,789 A 3/1930 Wheeler
1,750,397 A * 3/1930 Faulstich ..... 36/51
1,851,629 A * 3/1932 Herzstein ..... 36/45
RE22,614 E 3/1945 Roberts
2,427,459 A 9/1947 Jastrzomb
3,419,974 A * 1/1969 Lange ..... 36/117.6
3,514,877 A * 6/1970 Coppola ..... 36/87
3,531,878 A 10/1970 Corry
3,621,489 A 11/1971 Keller
3,783,534 A 1/1974 Phillips et al.
3,827,167 A 8/1974 Jones
4,062,133 A * 12/1977 McGee et al. ..... 36/131

(Continued)

OTHER PUBLICATIONS

"Ladder Company Operations: Portable Ladders" 201 FDNY Firefighting Procedures; vol. 3, Book 1, Revised Mar. 15, 1997; 1986 New York City Fire Department.

(Continued)

*Primary Examiner*—Marie Patterson
(74) *Attorney, Agent, or Firm*—Lerner, David, Littenberg, Krumholz & Mentlik, LLP

(57) ABSTRACT

The present invention provides articles of footwear for use by firefighters in different activities such as emergency and rescue situations, as well as daily activity in and around the firehouse. Integrated handles enable the firefighter to quickly and easily put the article of footwear on while minimizing the possibility of accidentally catching on equipment, apparel or debris. Locking bands that wrap around the upper are used to adjust for comfort and a secure fit. A dual lacing and zipper system enables the firefighter to initially adjust for fit by selectively tightening the lace, while the zipper provides a quick means for securing the article of footwear. Different outsole lug configurations are suitable for different surfaces, wet, dry and of varying and extreme temperatures. Added protection is available with a tibia/shin protector and ankle protectors.

16 Claims, 40 Drawing Sheets

U.S. PATENT DOCUMENTS

| | | | | | |
|---|---|---|---|---|---|
| 4,329,790 | A | * | 5/1982 | Bell | 36/32 R |
| 4,385,456 | A | * | 5/1983 | Livernois et al. | 36/115 |
| 4,563,825 | A | * | 1/1986 | Tesser | 36/131 |
| 4,586,271 | A | * | 5/1986 | Maleyko et al. | 36/1.5 |
| 4,587,749 | A | * | 5/1986 | Berlese | 36/131 |
| 4,607,440 | A | * | 8/1986 | Roberts et al. | 36/114 |
| 4,640,027 | A | | 2/1987 | Berlese et al. | |
| 4,641,438 | A | * | 2/1987 | Laird et al. | 36/59 C |
| 4,693,021 | A | | 9/1987 | Mazzarolo et al. | |
| 4,724,623 | A | * | 2/1988 | Silverman | 36/112 |
| 4,864,742 | A | * | 9/1989 | Grilliot et al. | 36/109 |
| 5,007,111 | A | | 4/1991 | Adams et al. | |
| 5,068,982 | A | | 12/1991 | Devasthal | |
| 5,117,568 | A | * | 6/1992 | Mitsui | 36/54 |
| 5,148,565 | A | | 9/1992 | Devasthali | |
| 5,317,821 | A | * | 6/1994 | Vargo | 36/93 |
| 5,438,769 | A | * | 8/1995 | Mazzarolo | 36/131 |
| 5,546,680 | A | * | 8/1996 | Barma et al. | 36/108 |
| 5,855,079 | A | | 1/1999 | Herbert et al. | |
| 5,933,985 | A | * | 8/1999 | James | 36/50.1 |
| 5,987,778 | A | | 11/1999 | Stoner | |
| 6,066,384 | A | * | 5/2000 | Crandall | 428/143 |
| 6,237,254 | B1 | | 5/2001 | Rork et al. | |
| 6,324,773 | B1 | * | 12/2001 | Gaither | 36/50.1 |
| 6,360,454 | B1 | | 3/2002 | Dachgruber et al. | |
| 6,408,542 | B1 | | 6/2002 | Shepherd | |
| 6,427,362 | B2 | | 8/2002 | Rork et al. | |
| 6,442,873 | B2 | | 9/2002 | Rork et al. | |
| 6,560,898 | B2 | | 5/2003 | Borsoi et al. | |
| 2002/0144435 | A1 | | 10/2002 | Shepherd | |
| 2002/0170205 | A1 | | 11/2002 | Shepherd | |
| 2004/0045196 | A1 | | 3/2004 | Shepherd | |
| 2004/0226195 | A1 | | 11/2004 | Martinez | |
| 2004/0237178 | A1 | | 12/2004 | Landeros | |
| 2005/0217147 | A1 | * | 10/2005 | Dion | 36/58.6 |

OTHER PUBLICATIONS www.metadesign.it/lenzi/adv_lenzi_04.htm, advertising K-Systems ®; retrieved from the Internet Jun. 24, 2005.

* cited by examiner 5B-5B 5D-5D

FOOTWEAR FOR HOSTILE ENVIRONMENTS

BACKGROUND OF THE INVENTION

The present invention relates generally to articles of footwear and, more particularly, to footwear such as boots for use by first responders such as firefighters and other emergency and rescue personnel in various environments and conditions. Of course, the footwear herein can also be used in routine footwear usage, such as fashion. "Firefighter" as used herein is exemplary of any worker facing hostile environmental conditions, such as natural or manmade fires, hazardous material spills, etc.

Firefighters and other first responders work in extreme and dangerous environments that often require specialized equipment such as air masks, protective helmets, and fire and/or chemical resistant articles of clothing such as coats, pants, etc. The boots or other footwear worn by the firefighter or other first responder are also extremely important to the success and safety of each call or operation. In the past, firefighting boots have evolved from conventional boots to more rugged footwear that is fire resistant. However, such boots are typically bulky, heavy and hard to put on and remove. Known firefighting boots include hoop handles that extend up from the top of the boots. Unfortunately, these hoops are bulky and are prone to catching on equipment or debris, presenting a hazard to the firefighter.

When a call comes in, firefighters typically have a very brief time in which to dress and leave the firehouse. Thus, it is important to put on equipment, including footwear, as rapidly as possible. Emergency situations are referred to herein as "call" situations, which include fires, industrial accidents, hazardous material spills, etc. In the rush to answer the call, it is desirable to be able to quickly and easily identify which equipment to put on, and to do so in a timely fashion. Another type of situation is the "duty" situation, for example routine calls such as rescuing a cat from a tree. A third type of situation is the "station" situation, where the firefighter is performing activities in and around the firehouse, such as cleaning and maintaining equipment. The call, duty and station identifiers are merely exemplary of different types of activities that may be performed in different situations or environments, and are not meant to limit how or where any particular footwear configuration is employed.

Once at the site of the emergency, specific tasks such as clearing debris or directing a hose place added stress on firefighting boots, particularly when such tasks take place on a ladder. For instance, a firefighter may use a tool to remove debris or handle a hose that is under tremendous pressure while standing on a ladder. In these cases, the firefighter must take extra precautions, such as performing a "leg lock" or "ladder lock," which involves wrapping one leg securely around the ladder. According to the New York City Fire Department Firefighting Procedures, DCN 4.06.07, Vol. 3, Book 1, copyright 1986, a ladder lock is performed by placing the leg over and under a rung which is two rungs over the rung on which the firefighter is standing. The instep or shin of the locking leg is then positioned on the ladder's side support structure or beam opposite the side on which the firefighter working, for example by wielding equipment such as an axe or a hose. The arch of the foot not in the ladder lock position is then placed against the other beam of the ladder. It should be understood that a great deal of pressure and strain are placed on the instep/shin in the ladder lock position. Unfortunately, known firefighting boots do not provide adequate protection or stability for the wearer.

In order to address these and other problems, it is desirable to provide firefighting boots that promote comfort and safety for the wearer and which can be put on in a timely fashion.

SUMMARY OF THE INVENTION

In accordance with an embodiment of the present invention, an article of footwear is provided. The article of footwear comprises an outsole and an upper. The outsole has a first surface for contacting the ground and a second surface remote from the first surface. The upper is attached to the second surface of the outsole. The upper has an interior surface defining a cavity for receiving a foot, an exterior surface, and a collar having a top line providing an opening to the cavity. The collar includes an integral gripping member positioned below the top line of the collar.

In one alternative, the gripping member is spaced less than about 4 cm away from the exterior surface of the upper. In another alternative, the gripping member comprises a folded-over section of the collar that is attached to the exterior surface of the upper with a fastener. In a further alternative, the gripping member has an outer surface substantially aligned with the exterior surface of the upper.

In yet another alternative, the article of footwear further comprises a carrying member disposed along the interior surface of the upper adjacent the upper surface of the collar. In an alternative, the article of footwear may include a securing member disposed across the upper from a medial to a lateral side of the article of footwear for securing the foot within the cavity. In this case, the securing member may comprise at least one locking strap. The locking strap has a first section that is fixedly secured to a first one of the medial side or the lateral side and a second section that is removably connected to a second one of the medial side or the lateral side. At least one of the first and second sections has an elastic portion to allow for stretching and adjustment of the at least one locking strap. Desirably, the first section is disposed within a channel along an interior section of the upper between the interior surface and the exterior surface, and the second section fastens to the exterior surface of the upper with a fastening system.

In an example, the article of footwear further comprises a tibia guard positioned along an anterior portion of the upper. In this case, the tibia guard preferably has a first surface in contact with an exterior surface of the anterior portion and a second surface remote from the first surface. The second surface includes a plurality of ridges thereon. The ridges are operable to provide traction and protection to a wearer of the article of footwear. In another example, the article of footwear further comprises a reflective indicator that runs substantially around an outer surface of the article of footwear. The reflective indicator is adjacent to at least one of the upper and the outsole. In this case, the outsole may include an inset groove positioned circumferentially along the article of footwear. Here, at least a portion of the reflective indicator is disposed on the inset groove. In yet another example, the outsole includes lugs disposed along the first surface thereof. A first set of the lugs has a substantially triangular pattern and is arranged in at least one row from the medial to the lateral side of the article of footwear. At least some of the first set of lugs include siping along bottoms thereof. A second set of the lugs comprises ridges and are disposed at a toe region and at a heel region of the outsole.

In another alternative, the article of footwear further comprises an ankle protection pad disposed on the medial or the lateral side of the upper. In this case, the protection pad preferably comprises a pair of ankle protection pads. A first one of the pair is disposed on the medial side of the upper and a second one of the pair is disposed on the lateral side of the upper. The pair of ankle protection pads each comprises a protective insert, an inner lining disposed along a first side of the protective insert, an outer lining disposed along a second side of the protective insert, and an outer cover disposed over the outer lining. In a further alternative, the article of footwear further comprises a heel guard disposed along a heel section of the exterior surface of the upper. Here, the heel guard includes an indicator having identification data disposed thereon.

In accordance with another embodiment of the present invention, an article of footwear is provided. The article of footwear comprises an outsole, an upper, a carrying member, a pair of strap members, a tibia protector, ankle protection pads, an indicator, a footbed, a reinforcing plate and an insulating member. The outsole has a first surface for contacting the ground and a second surface remote from the first surface. The upper is attached to the second surface of the outsole. The upper has an interior surface defining a cavity for receiving a foot, an exterior surface, and a collar having a top line providing an opening to the cavity. The collar includes an integral gripping member positioned below the top line of the collar. The carrying member is disposed along the interior surface of the upper adjacent to the collar. The pair of strap members are disposed across the upper from a medial to a lateral side of the article of footwear for retaining the foot within the cavity. The strap members each comprising an elasticized locking strap having a first section that is fixedly secured to a first one of the medial side or the lateral side and a second section that is removably connected to a second one of the medial side or the lateral side. The tibia protector is disposed along an anterior section of the upper. The tibia protector includes a series of outwardly extending transverse ridges thereon. The pair of ankle protection pads are disposed on the medial and lateral sides of the upper. The indicator comprises a reflective inset member positioned circumferentially around the article of footwear adjacent to the outsole. The removable footbed is disposed within the cavity of the upper. The reinforcing plate is disposed between the removable footbed and the outsole. The insulating member is disposed between the removable footbed and the outsole.

In accordance with yet another embodiment of the present invention, an article of footwear is provided. The article of footwear comprises an outsole, an upper and a dual fitting and securing system. The outsole has a first surface for contacting the ground and a second surface remote from the first surface. The upper is attached to the outsole, and has an interior surface defining a cavity for receiving a foot. The dual fitting and securing system is for retaining the foot within the cavity of the upper. The dual fitting and securing system includes a zipper apparatus disposed centrally along an anterior portion of the upper and a lacing system disposed along at least a medial or a lateral side of the zipper apparatus. The lacing system has a series of receptacles and a lace threaded through the series of receptacles, wherein the zipper apparatus is operable to be zipped substantially completely open or closed without impediment by the lacing system.

In one example, the lacing system further includes a lace locking mechanism for adjustably securing a first end of the lace to the upper. In this case, a second end of the lace may be fixedly secured to the upper. Alternatively, the lacing system may be asymmetrically positioned on the upper so that the series of receptacles is positioned along a first side of the zipper apparatus.

In accordance with yet another embodiment of the present invention, an article of footwear comprising an outsole and an upper is provided. The outsole has a first surface including elongated traction elements for contacting wet surfaces and a second surface remote from the first surface. The upper is attached to the outsole and defines a cavity for receiving a foot. The upper includes a first region of a non-stretchable waterproof material and a second region of a stretchable material adjacent to the first region.

In one alternative, the elongated traction elements include a plurality of raised ridge members for removing water from the ground and providing enhanced traction. In one example, the plurality of raised ridge members are arranged in a substantially parallel direction from a medial side to a lateral side of the first surface of the outsole. In another example, the plurality of raised ridge members include a first member arranged transversely across the first surface of the outsole, a second member arranged longitudinally along the first surface of the outsole, and a third member arranged in a non-transverse and non-longitudinal direction along the first surface of the outsole.

DETAILED DESCRIPTION

Figure 1A:
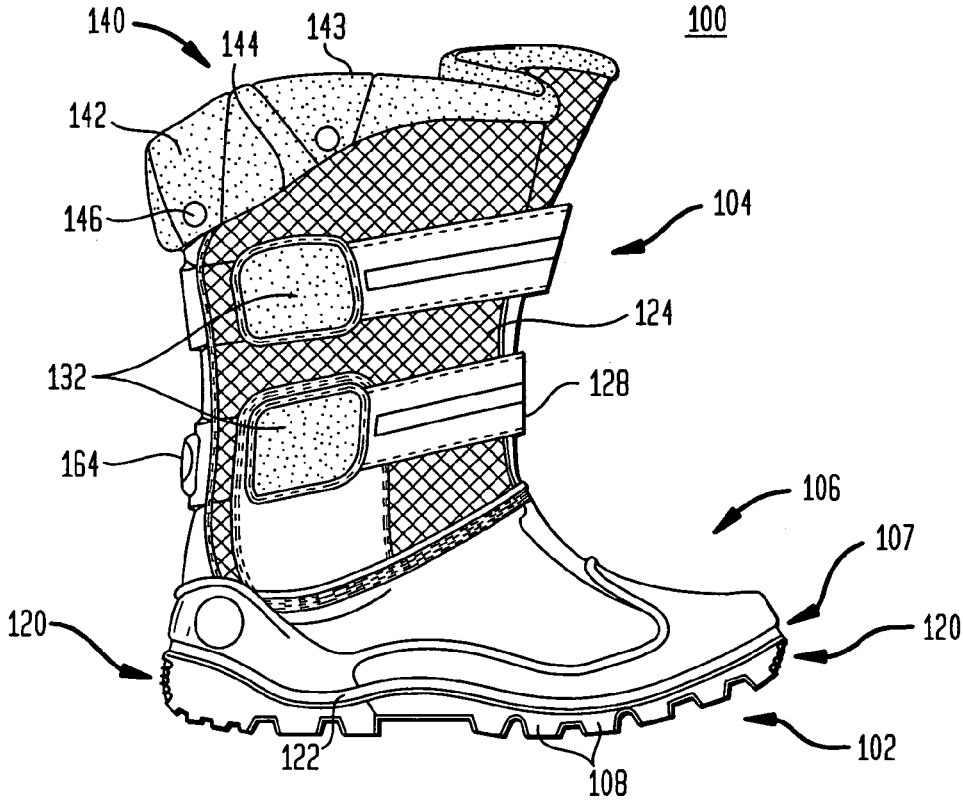
FIGS. 1(*a*)-(*b*) illustrate an article of footwear in accordance with an embodiment of the present invention in a call-type boot style.

The foregoing aspects, features and advantages of the present invention will be further appreciated when considered with reference to the following description of preferred embodiments and accompanying drawings, wherein like reference numerals represent like elements. All dimensions on the drawings are in millimeters. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose. In the embodiments of footwear shown in the drawings, only right (or left) foot shoes are shown. However, it should be understood that the left (or right) foot shoes are mirror images of the right (or left) foot shoes.

Figure 1B:
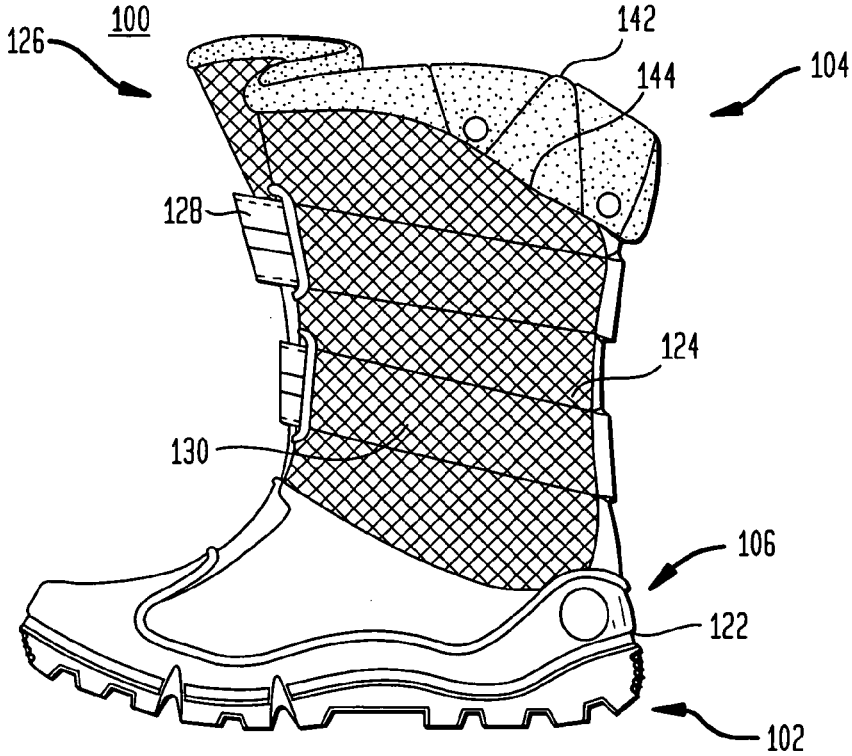
Figure 2A:
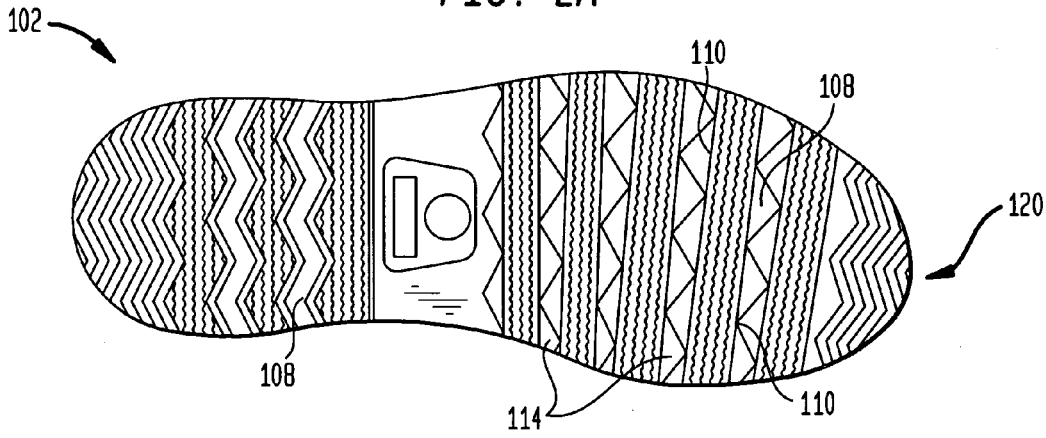
FIGS. 2(*a*)-(*e*) illustrate outsole views of the article of footwear of FIGS. 1(*a*)-(*b*).
Figure 2B:
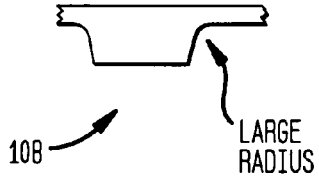
Figure 2C:
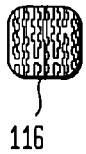
Figure 2D:
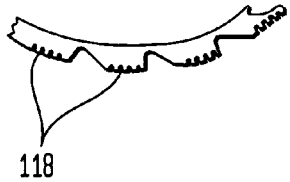
Figure 2E:
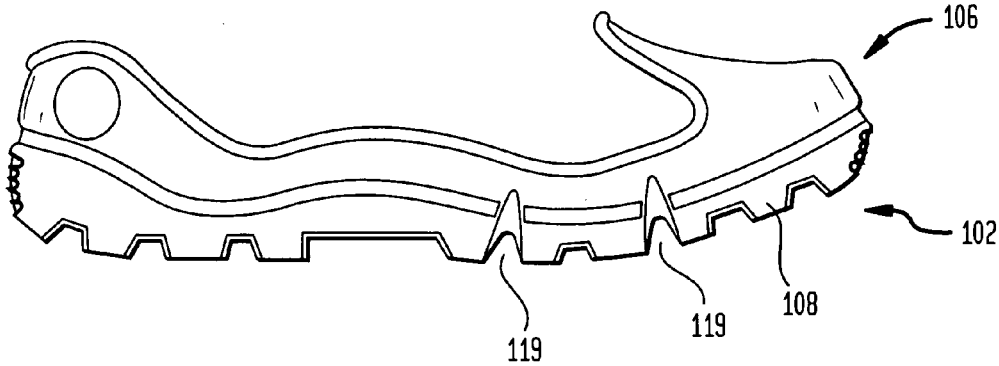

FIGS. 1(*a*) and 1(*b*) illustrate lateral and medial side views, respectively, of an article of footwear 100 in accordance with aspects of the present invention. The article of footwear 100 is desirably formed as a "call" type boot for use in fighting fires, industrial accidents and other extremely hazardous conditions. However, as discussed above, the call identifier is merely exemplary of types of activities that may be performed in exemplary situations or environments, and is not meant to limit how or where any particular footwear configuration such as the article of footwear 100 is employed. The article of footwear 100 preferably comprises several components including an outsole 102, an upper 104, a rand 106 and a midsole 107. The outsole 102 provides a ground contacting surface. The upper 104 provides a receptacle or enclosure for receiving a wearer's foot. The midsole 107 connects the outsole 102 and the upper 104 together. The rand 106 provides extra protection to the article of footwear 100. The features of the article of footwear 100, including the outsole 102, upper 104, rand 106 and midsole 107 will be described in detail below.

As seen in FIG. 1(*a*) and FIG. 2(*a*), the outsole 102 preferably includes a tread in the form of lugs 108. The lugs 108 may be formed in one or more rows extending, for example, from the medial to the lateral side of the outsole 102. The rows of lugs 108 desirably have a straight edge 110 facing toward the front or toe region of the article of footwear 100, and a sawtooth, jagged or substantially triangular pattern 112 adjacent to the edge 110. The edge 110 is especially beneficial when climbing a ladder, as it provides a clean edge facing the ladder rungs. The sawtooth pattern 112 is adapted to grip and interlock with a corresponding tread pattern on the rungs of the ladder. Of course, it should be understood that other patterns may be employed so as to achieve interlock, depending upon the tread pattern on the ladder rungs. Channels 114 may be deeply inset in the outsole 102, for instance along the forefoot region, to provide flex thereto.

FIG. 2(*b*) is a side view of one of the lugs 108, which shows that the lug 108 preferably includes a large radius to the inside edge of the lug 108. The large radius prevents dirt buildup and reduces clogging of the lugs 108 by debris or other material. As shown in FIG. 2(*c*), the outsole 102 between rows of the lugs 108 may include additional traction elements such as siping 116. As shown in FIG. 2(*d*), the bottoms of the lugs 108 preferably include siping 118 for enhanced traction on wet surfaces. The outsole 102 and midsole 107 may be formed as an integral unit of, for example, molded rubber. As illustrated in FIG. 2(*e*), in this preferred embodiment the rubber is fire and heat resistant to meet specifications in a given field of use such as those identified by the National Fire Protection Association ("NFPA"). As shown in this figure, the outsole 102 may include slits or flex segments 119 to enable the outsole 102 to flex or bend during wear.

Returning to the side views of FIGS. 1(*a*) and 1(*b*), it can be seen that the toe and/or heel regions of the outsole 102 may include ridges 120 thereon. The ridges 120 may be used to provide enhanced traction when kneeling, crawling, or climbing. Furthermore, the outsole 102, including the lugs 108, is preferably formed from a fire resistant material such as nitrile rubber or other composition with a high melting temperature. Desirably, the melting temperature is at least 260° C.

A reflective indicator 122 may be positioned on, above or adjacent to the outsole 102. The reflective indicator 122 may comprise, for example, a layer or material such as a reflective paint or tape. The reflective indicator 122 desirably runs substantially or entirely around the article of footwear 100, and may cover at least a portion of the midsole 107. In addition, the reflective indicator 122 may be configured as an inset groove positioned circumferentially along the top line of the outsole 102. Reflective indicators 122 may also be positioned elsewhere along the article of footwear 100.

In one alternative, the midsole 107 preferably comprises ethyl vinyl acetate ("EVA"). In another example, the midsole 107 may comprise polyurethane ("PU"). However, other materials may be used alone or in combination to form the midsole 107.

Element 106 depicts the rand, a wrap around protective covering on the upper 104 of the shoe. The rand 106 preferably extends from the top line of the outsole 102. In the preferred embodiment of FIGS. 1(*a*)-(*b*) the rand 106 extends up and forms the toe cap 148. See FIG. 3(*a*). The rand 106 can be made, for example, from aramid material(s), or a heat resistant and flame retardant finished leather, rubber or thermoplastic material. Although heat and fire resistant materials are preferable, the material characteristics are not limited to these. Any material such as leather, synthetic, rubber, plastic, treated or untreated, etc. may be used. The rand 106 may be fabricated and employed as a distinct component, or may be fabricated integrally or otherwise employed in conjunction with, for example, the outsole 102 and/or the midsole 107.

The upper 104 has an outer shell 124 that is preferably fire resistant if not fireproof. By way of example only, the outer shell 124 may include a fabric of a nylon material that is fire retardant, tear proof and/or insulated. Other fibers include aramids, which have no melting point, low flammability, and good fabric integrity at elevated temperatures. Para-aramid fibers, which have a slightly different molecular structure from aramid fibers, also provide outstanding strength-to-weight properties, high tenacity and high modulus. DUAL MIRROR® by Gentex is an aluminum and arammid laminate used for extreme flame and heat protection. Fibers such as NOMEX® or KEVLAR® brand fibers from E.I. Du Pont de Nemours and Company are aramid blends that include the flame and heat resistance in a plain weave or rip stop material. Treated materials, such as leather or synthetics can be finished with a fire retardant finish. Tightly woven aramids or para-aramids such as Dupont's SNAKE ARMOR® can be employed for fire resistance and added puncture resistance.

The outer shell 124 may also include a gusset and gusset overlay 126 along or near the anterior portion of the upper 104, as seen in FIG. 1(*b*). The gusset 126, in addition to providing an upper construction that is closed and waterproof, provides an easily adjustable region to enable the wearer to quickly insert his or her foot and leg into the article of footwear 100. Once the wearer's foot is inserted into the article of footwear 100, it is desirable to secure the foot and, optionally, the leg, to the article of footwear 100 to achieve a snug and safe fit. Therefore, one or more securing members, such as locking bands or straps 128, may be provided. The straps 128 are designed to enable an initial adjustment of the article of footwear 100 so that the wearer's foot can slide in and out while securely retaining the heel or the rest of the foot in the article of footwear 100 during use.

The straps 128 are preferably permanently affixed at one end to the medial side of the article of footwear 100 and adjustably attached at the other end to the lateral side of the article of footwear 100, as shown in FIGS. 1(*a*) and 1(*b*). Alternatively, straps 128 may be permanently affixed at one end to the lateral side of the article of footwear 100 and adjustably attached at the other end to the medial side of the article of footwear 100.

The end of the strap 128 that is permanently affixed is desirably disposed within a channel 130. The channel 130 may be formed of components such as bars molded into the upper 104, or as simply as the use of stitching to form the upper and lower bands. The bars can also be used to provide support and/or reinforcement to the article of footwear 100. In the preferred embodiment, stretchable gore panels may be placed between an interior lining (not shown) and the outer upper material. The exposed opening of the channel 130 may be reinforced with a fire resistant material, such as treated leather for durability and protection. Another embodiment may include hardware, such as a D-ring, metal or hard plastic reinforcement around the opening to provide a tight and secure fit, and to reduce exterior layering of the channel 130 and/or the strap 128. The adjustability in the preferred embodiment comes from the elasticized material the rubber straps are anchored to within the interior layer of the upper, such as with the stretchable gore panel.

The other end of the strap 128 preferably includes a fastening mechanism or fastening member thereon, such as a hook or loop fastener panel 132 facing toward the upper 104. The hook or loop fastener panel 132 preferably attaches to a reciprocal loop or hook fastener panel 134 disposed on the upper 104. The reciprocal hook and loop fastener panels 132, 134 may be, for example, VELCRO® brand fastener panels from the 3M Company. The fastener panel 132 may be covered by a pad 136 comprising, for instance, leather. Other fasteners or fastening mechanisms such as snaps, hooks, clips, buttons and the like.

The strap 128 itself may be formed of pliable rubber, fireproof or otherwise. A backing layer of neoprene, lycra or other material (not shown) may also be added to the strap 128 to provide a low friction surface that slides over the housing 124. In addition, a reflective insert 138 may be included to enhance the visibility of the article of footwear.

The article of footwear 100 desirably also includes a collar 140 positioned along the top of the upper 104. The collar 140 preferably includes one or more handle members 142 positioned thereon. The handle members 142 enable the firefighter to easily grip the article of footwear 100 so as to pull it onto his or her foot. A first handle member 142 may be placed on the medial side of the collar 140 and a second handle may be placed on the lateral side of the collar 140. Handle members 142 may also be placed along the back and/or front of the collar 140.

Unlike conventional hoop grips or pull handles connected to the top of a boot which project up from the boot, the handle members 142 are most preferably integrally formed with the collar 140 and have a gripping overhang, lip or grip 144 that is positioned below the top line or upper surface 143 of the collar 140 or the upper 104. In addition, the gripping overhang 144 need only be spaced approximately 8 cm or less from the side of the outer shell 124. More preferably, the gripping overhang/lip 144 is less than about 4-6 cm away from the side of the housing 124. Grips 144 can be flush with outer surface of the upper 104. When the lips/gripping overhangs 144 are not flush or integrated into the outer shell 124, they most preferably project or extend only 2-3 cm or less therefrom. In the case where the grips 144 are flush or integrated into the outer shell 124, the interior of the handle member 142 can be of a softer material, for example backed with foam, that easily deforms to receive fingers for easy grip. See, for example, FIG. 6(*a*). The slight, streamlined projections in any of the aforementioned configurations, which extend minimally away from the outer shell 124, are sufficient to enable the firefighter or other first responder to grab onto so as to don the article of footwear 100, while providing a low profile that substantially reduces the likelihood of accidentally catching or snagging onto debris, equipment or other material or structures. Additionally, the grip 144 may be achieved by the incorporation of a material such as webbing attached to collar area. Another alternative may be a slice or opening within the collar area to allow fingers to easily slide in and grip. Alternatively, the handle member 142 may be incorporated by construction of the collar 140, whereby the handle member 142 is folded over and heat set to form the grip 144. This could be done out of the collar material such as a leather or rubber. All grip alternatives can be done with a variation on the medial and lateral handles such that medial handle could have a lower or higher profile than the lateral handle to prevent the handles on a pair of boots or other footwear 100 from hitting each other during use, for example as the wearer is walking.

As seen in FIG. 1(*a*), the handle member 142 may comprise a folded over portion of the top of the upper 104 that is affixed at one or more points by fasteners such as rivets 146. In another alternative, the handle members 142 may be made of a molded rubber, such as seen in FIG. 4.

Figure 3A:
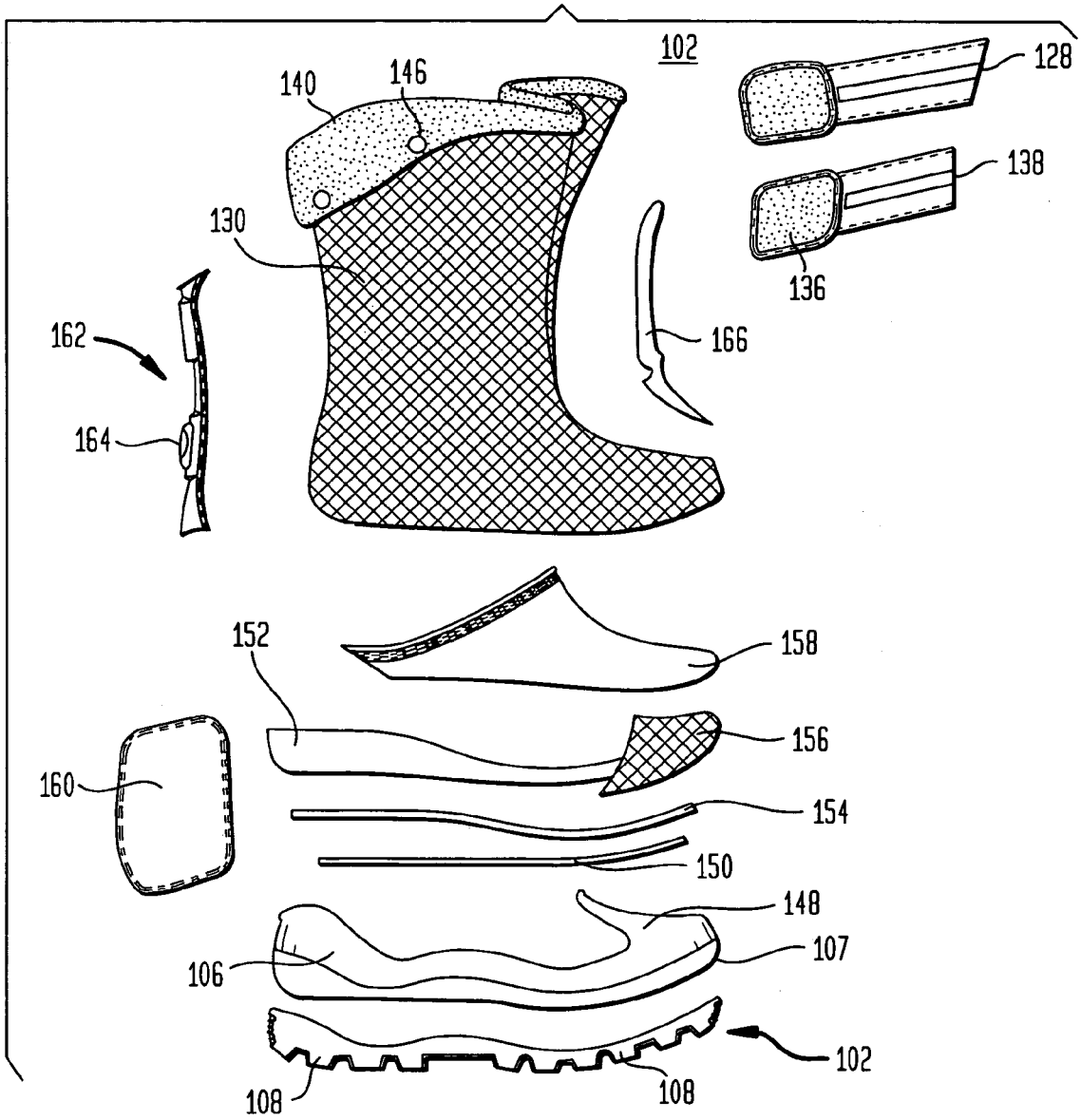
FIGS. 3(*a*)-(*b*) illustrate additional views of the article of footwear of FIGS. 1(*a*)-(*b*).
Figure 3B:
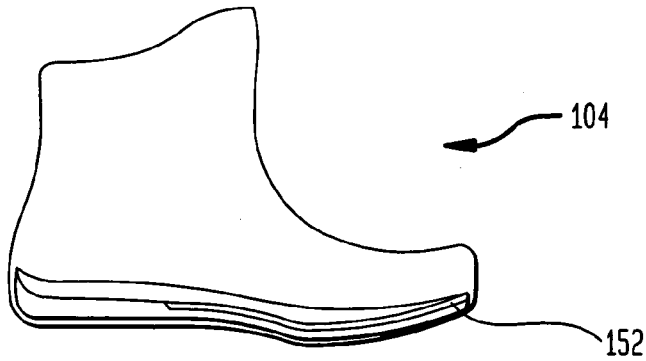
Figure 4A:
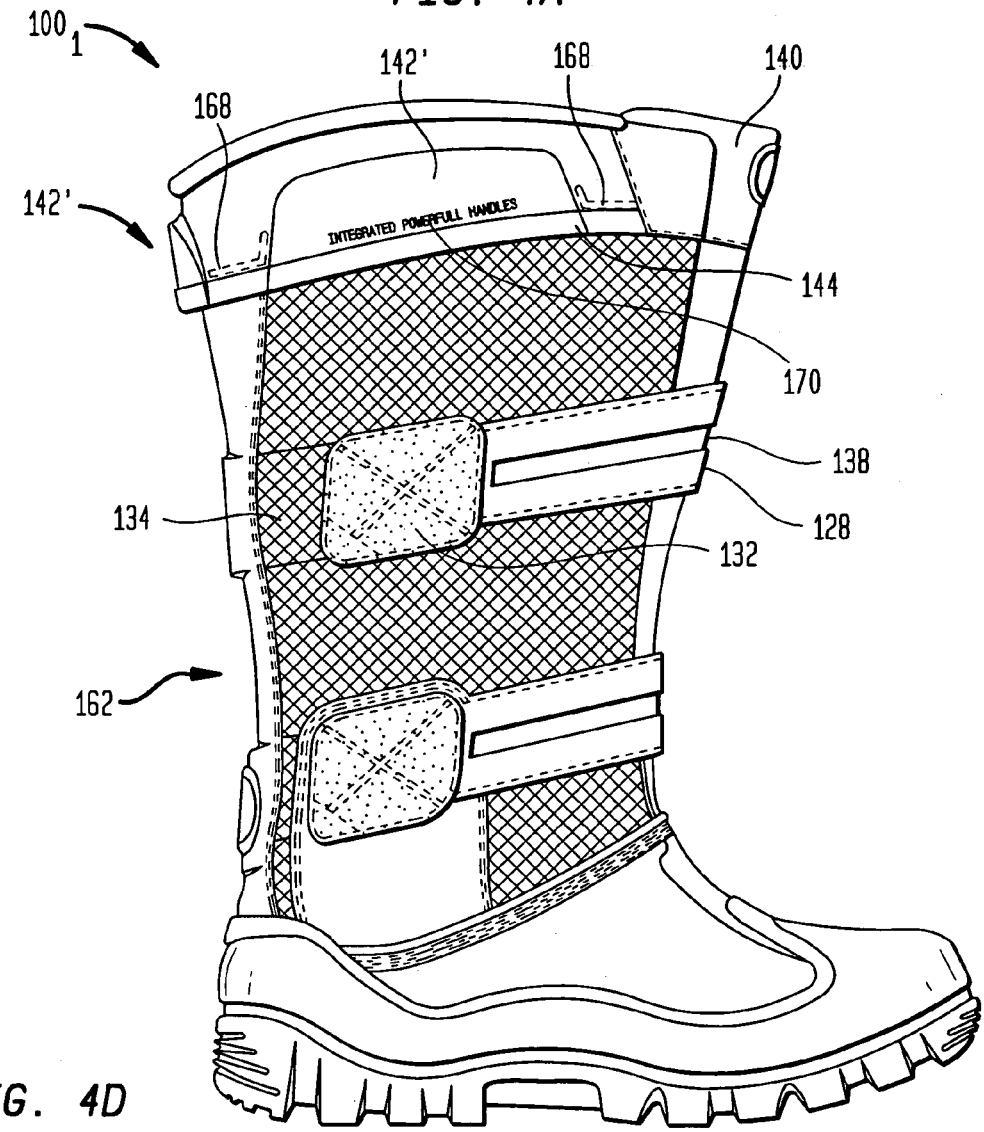
FIGS. 4(*a*)-(*d*) illustrate an alternative call-type boot in accordance with the present invention.
Figure 4D:
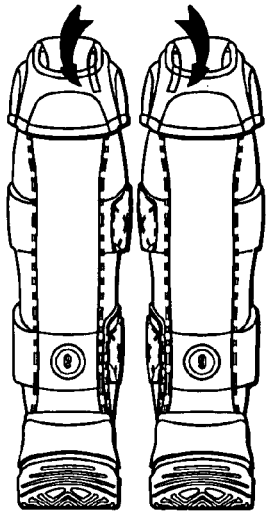
Figure 4C:
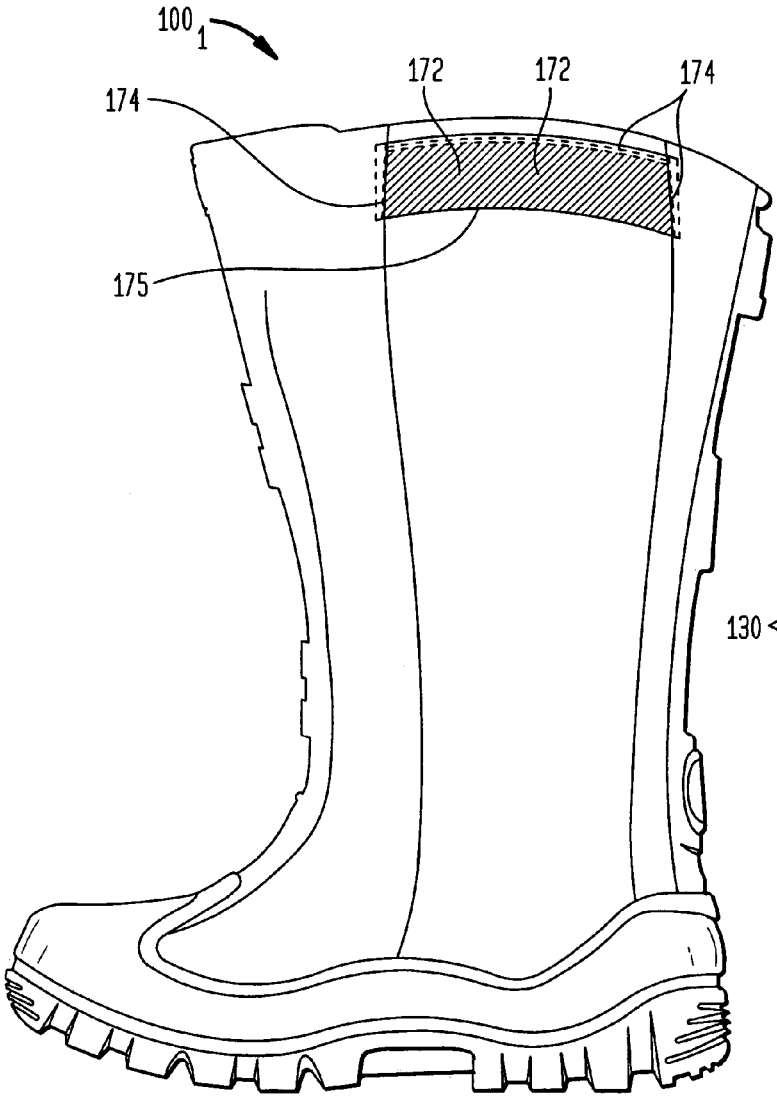
Figure 4B:
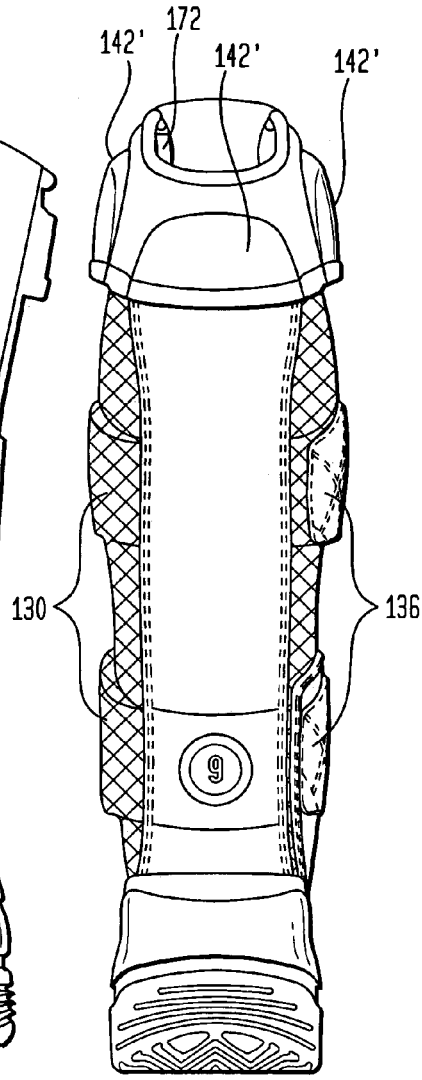
Figure 5A:
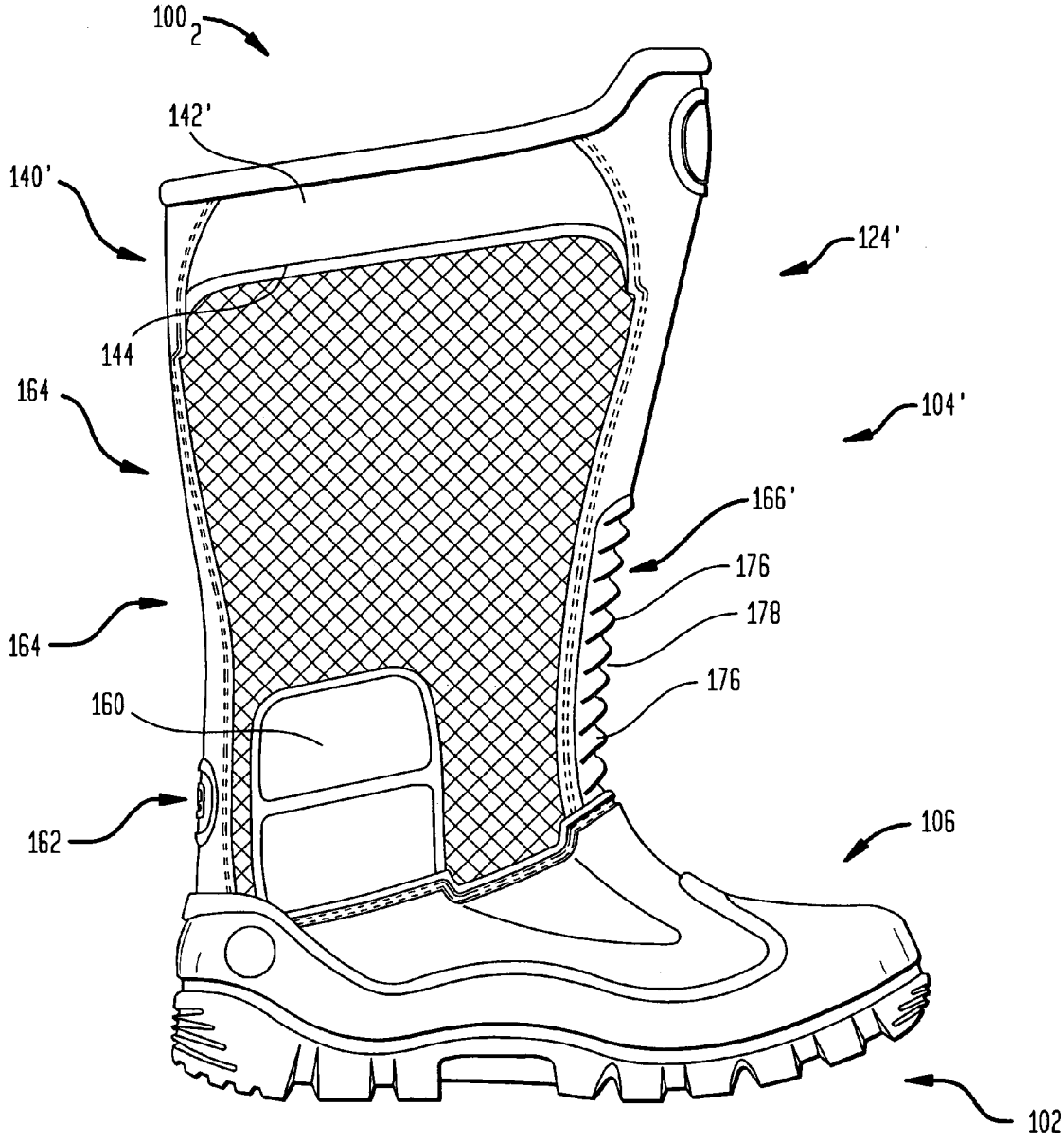
FIGS. 5(*a*)-(*l*) illustrate a further call-type boot in accordance with the present invention.
Figure 5B:
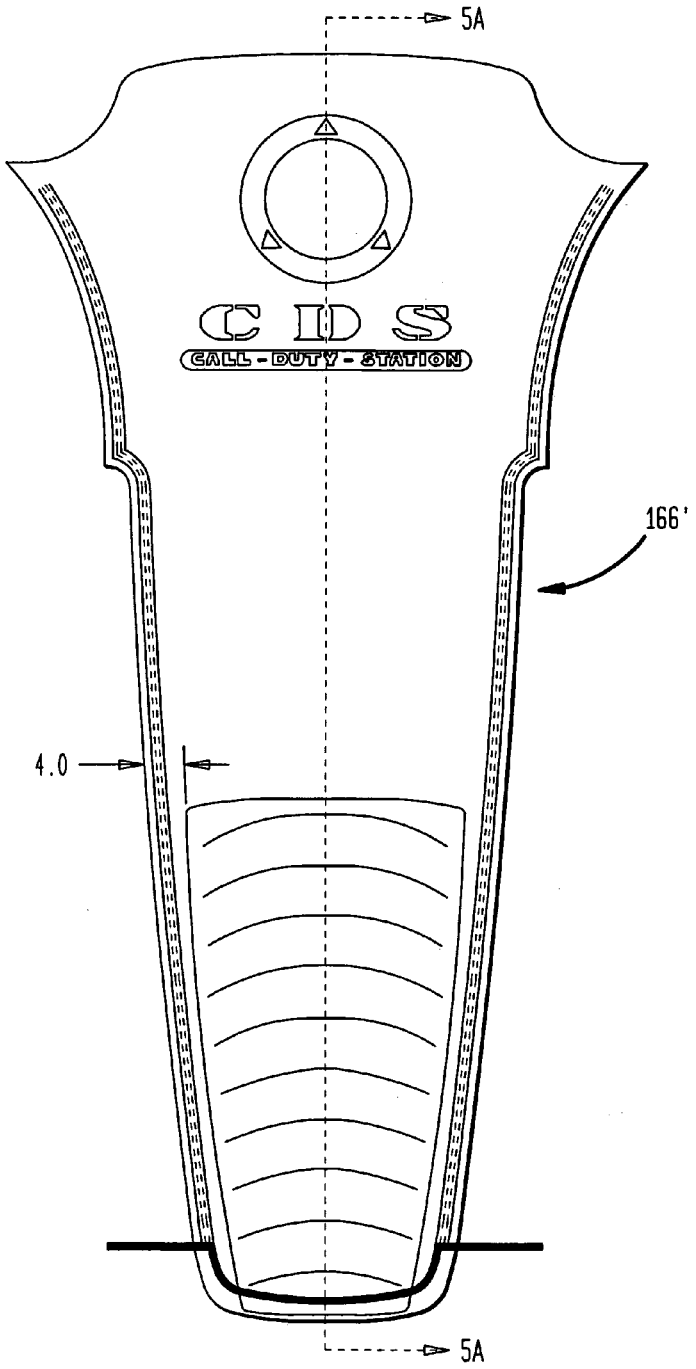
Figure 5C:
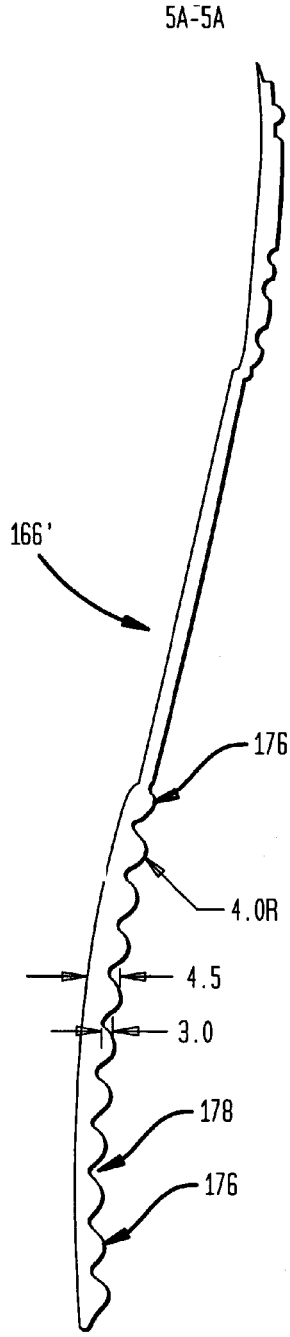
Figure 5D:
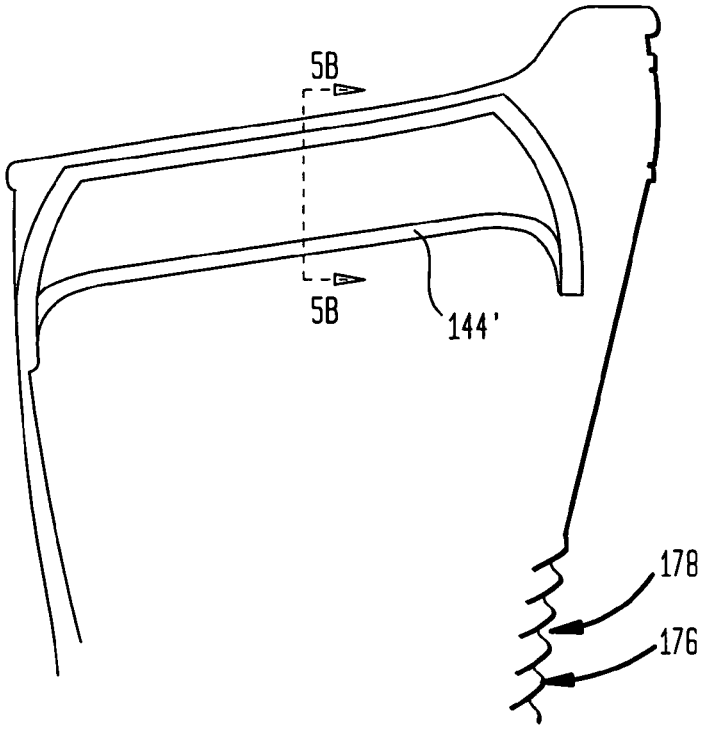
Figure 5E:
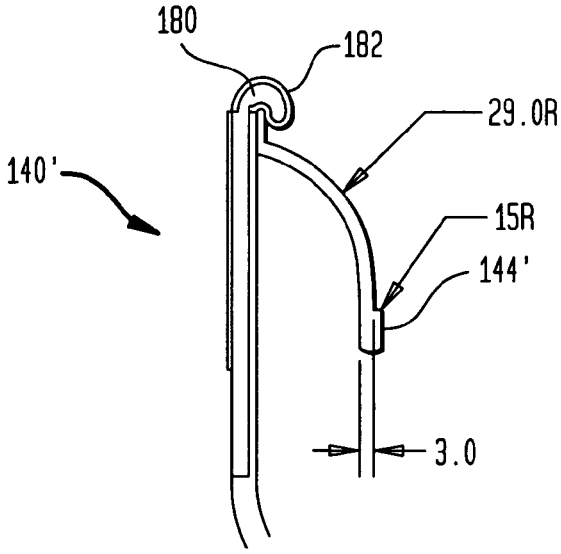
Figure 5F:
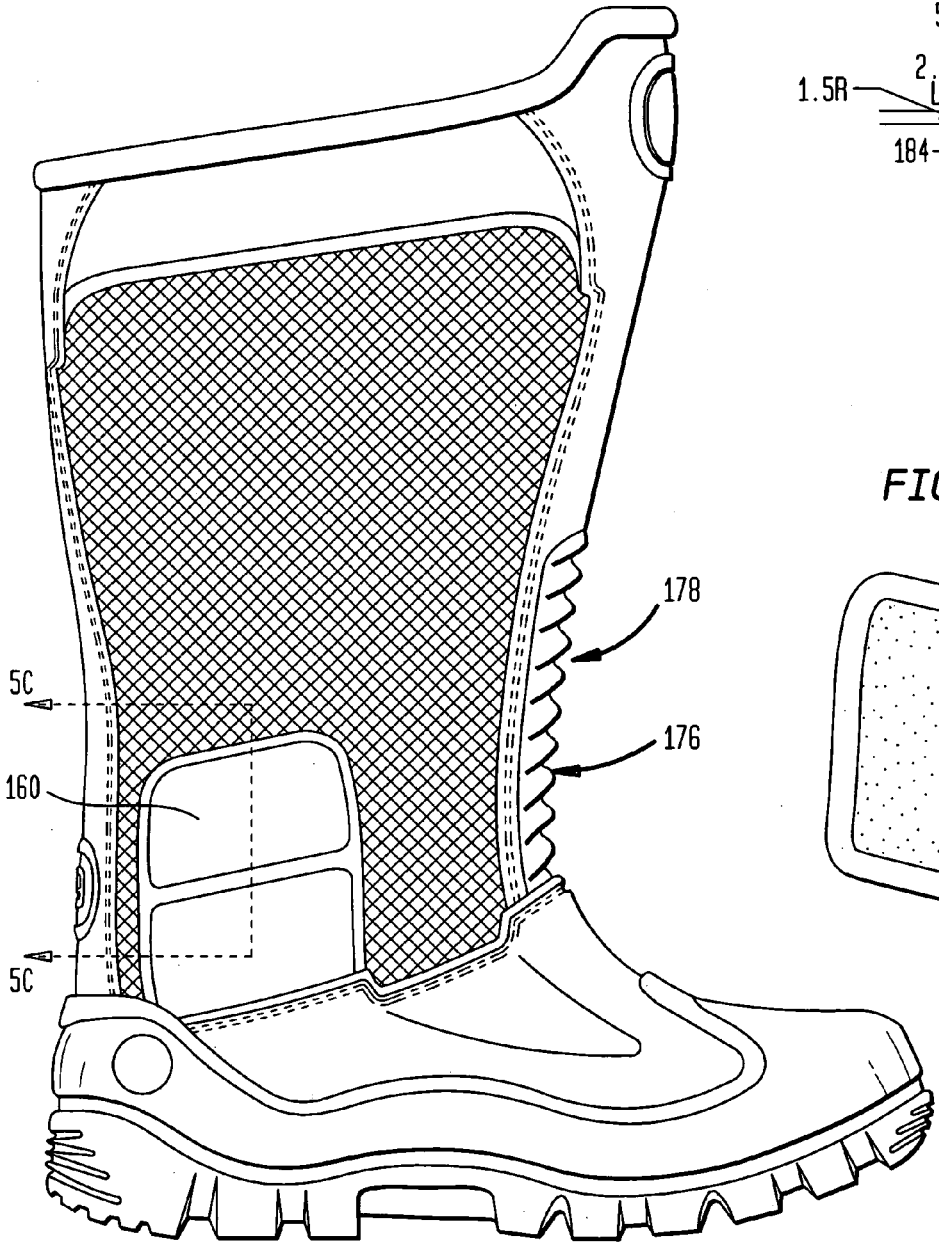
Figure 5G:
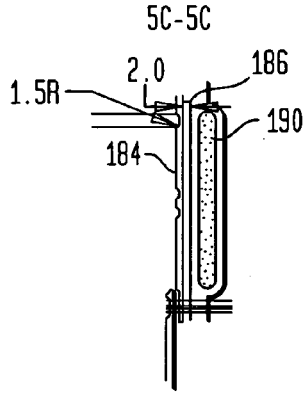
Figure 5H:
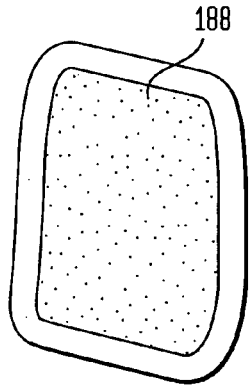
Figure 5I:
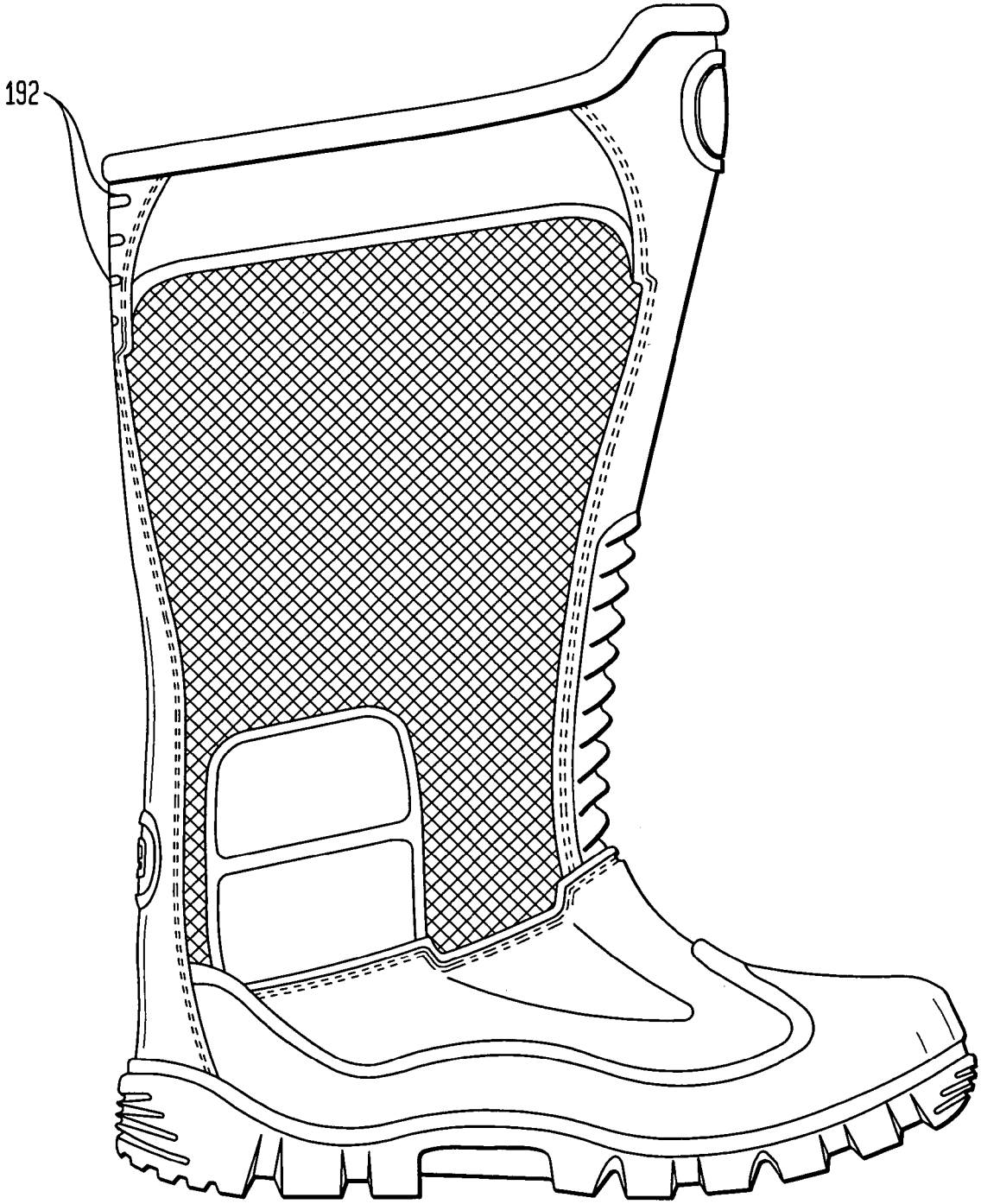
Figure 5J:
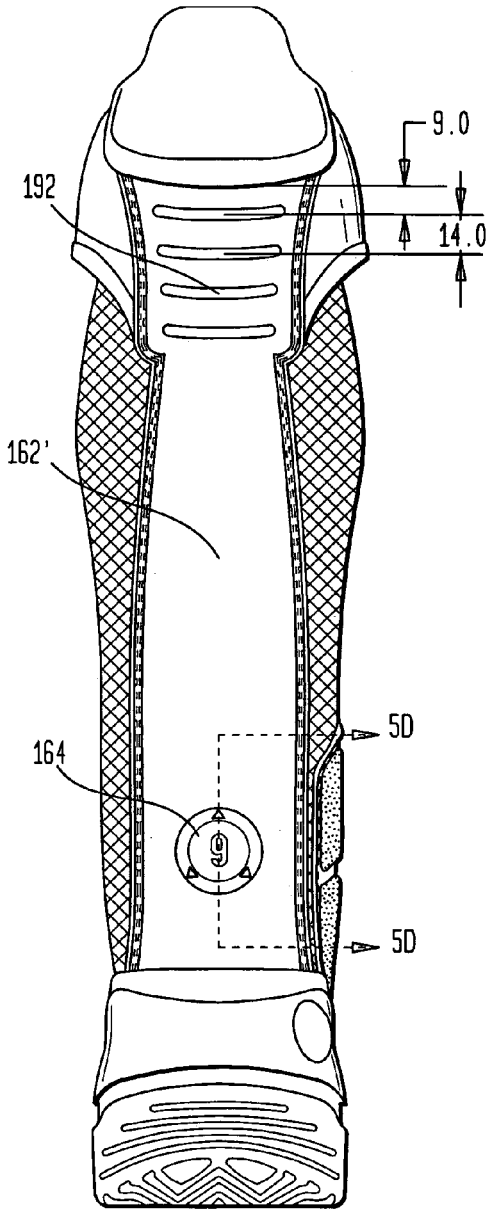
Figure 5K:
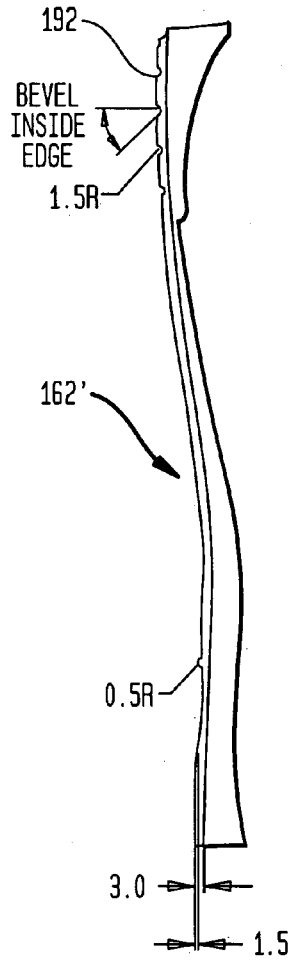
Figure 5L:
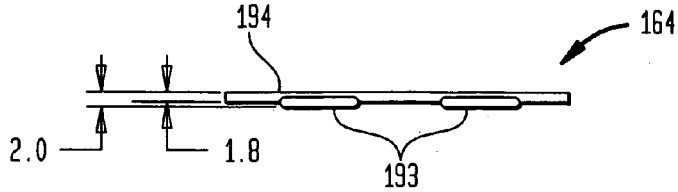
Figure 6A:
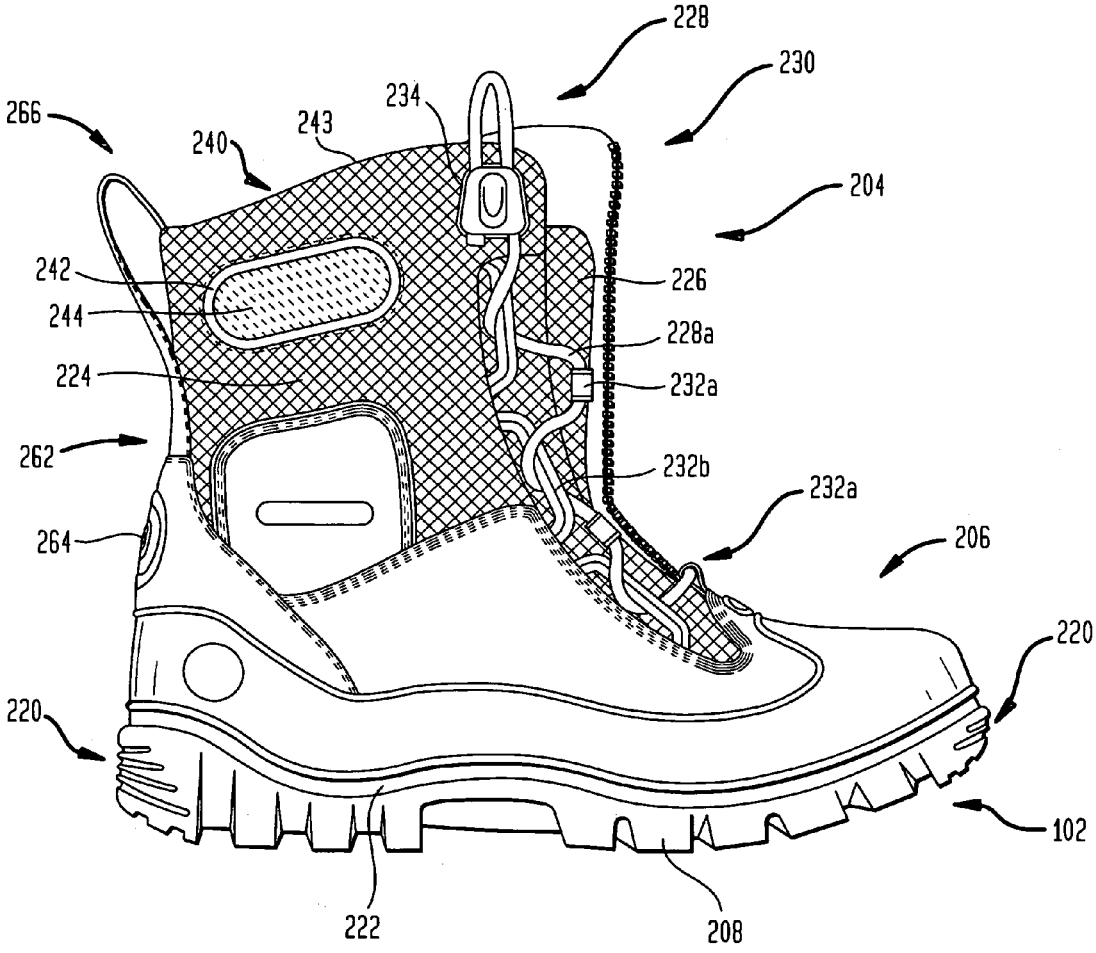
FIGS. 6(*a*)-(*k*) illustrate an article of footwear in accordance with an embodiment of the present invention in a duty-type boot style.
Figure 6B:
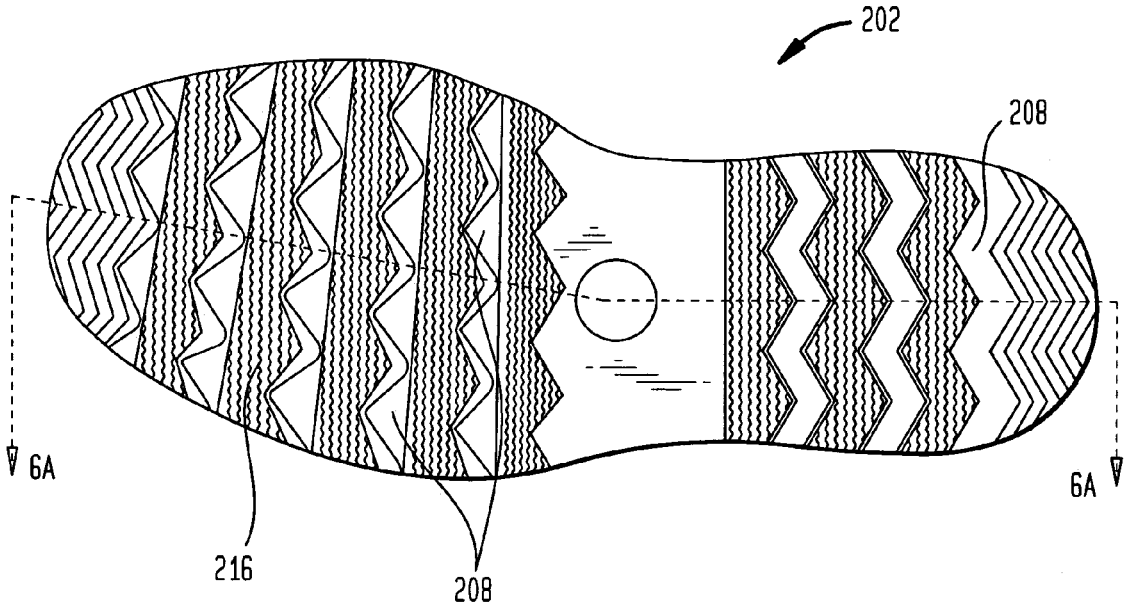
Figure 6C:
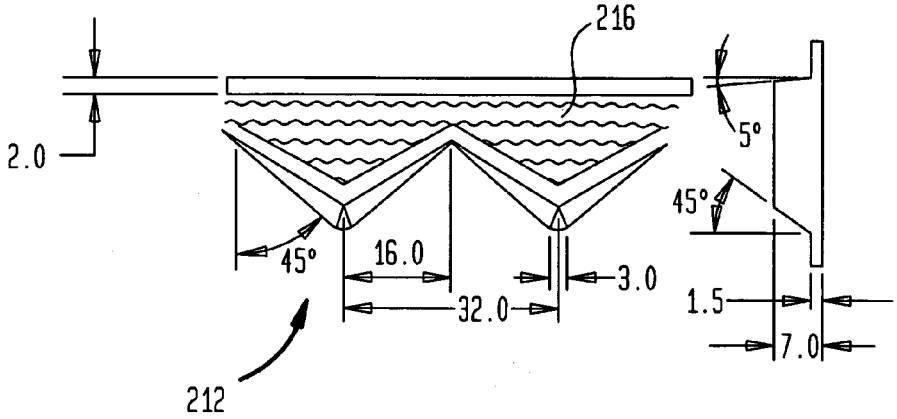
Figure 6D:
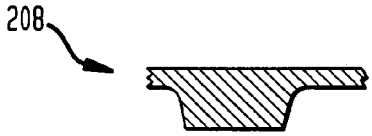
Figure 6E:
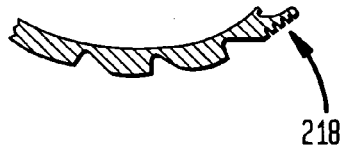
Figure 6F:
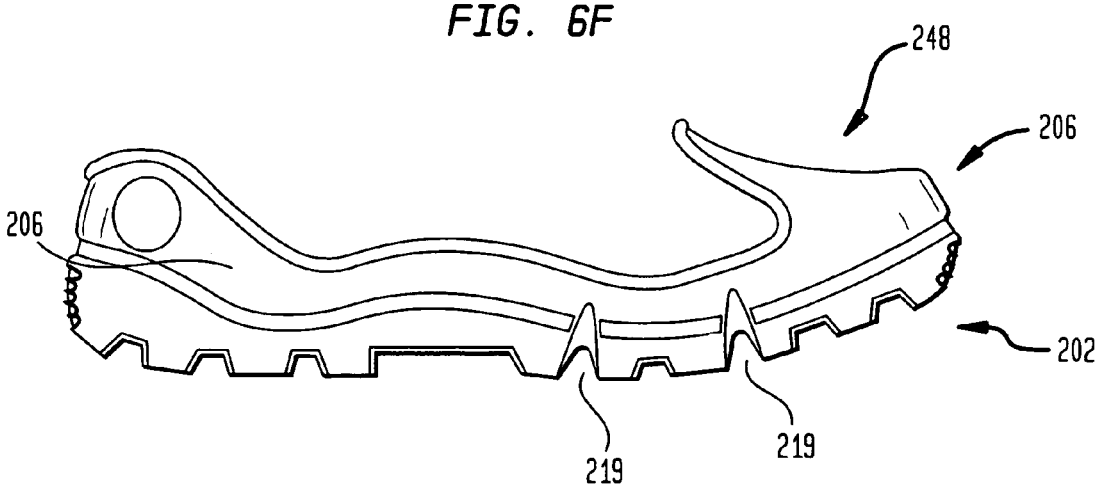
Figure 6G:
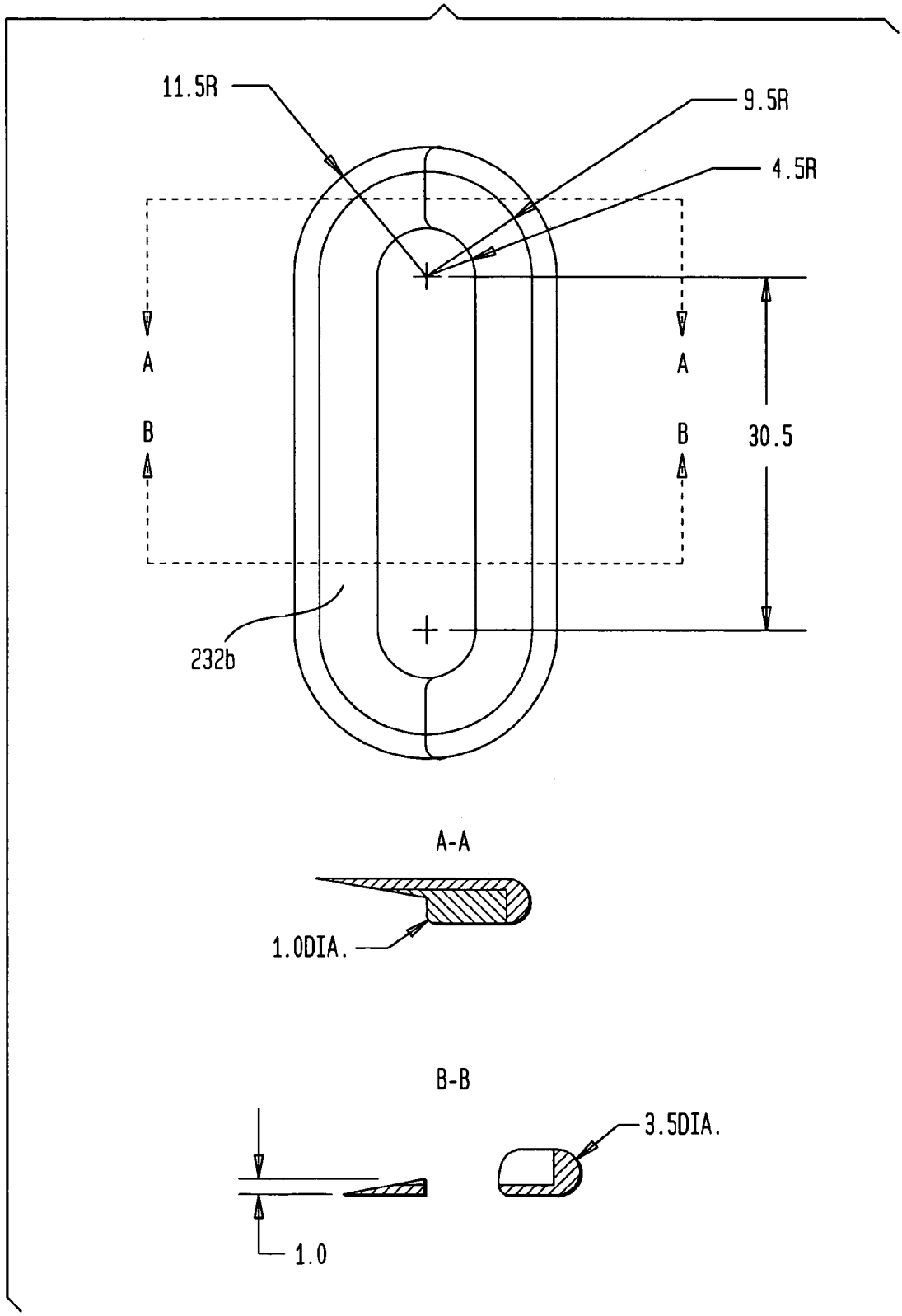
Figure 6H:
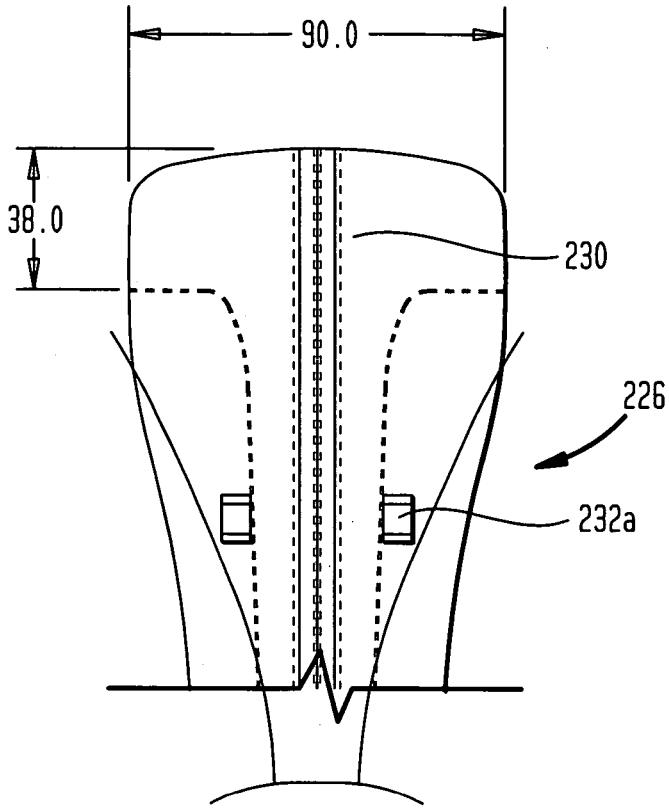
Figure 6I:
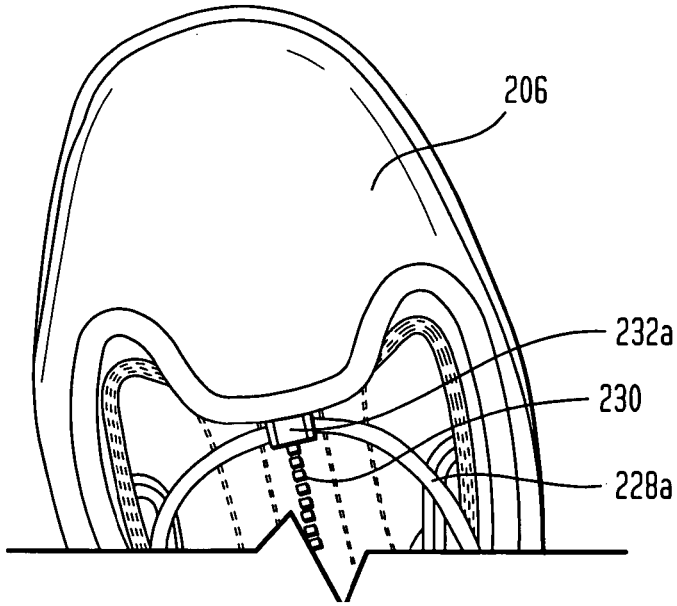
Figure 6J:
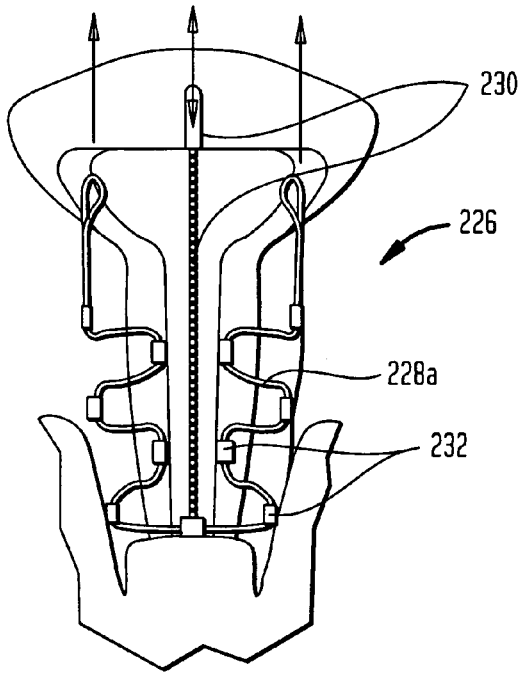
Figure 6K:
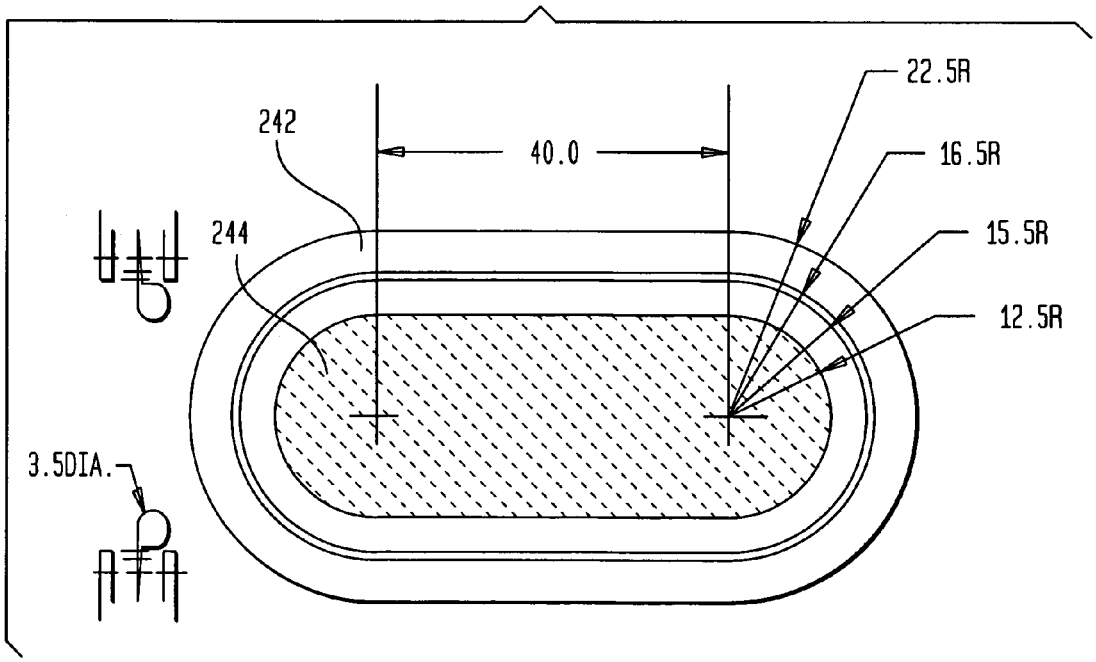

FIG. 3(*a*) is an exploded view of the article of footwear 100. As shown here, the reflective indicator 122 may be positioned to show substantially or entirely along the topline of the outsole 102. In addition, the midsole 107 may be molded to include the rand 106 as well as a toe cap 148. The midsole 107 may also be integrally molded or otherwise formed with the outsole 102. A plate, such as steel plate 150, may be disposed on or in the midsole 107 for enhanced support or protection of the wearer's foot.

A footbed 152 may be permanently or removably positioned within the article of footwear 100. The footbed 152 is preferably positioned on or over the midsole 107, with the optional steel plate 150 between them. The footbed 152 may be formed from resilient materials such as EVA or PU foams or other such materials commonly used in shoe midsoles, insoles or sockliners. FIG. 3(*b*) is a side cutaway view illustrating the footbed 152 as it is preferably positioned in the upper 104 during wear.

In another preferred embodiment, the footbed 152 may be an adjustable footbed, which provides enhanced fit and performance. Examples of such adjustable footbeds may be found in U.S. Provisional Patent Application No. 60/623,475 filed Oct. 29, 2004 and entitled "Shoe Footbed With Interchangeable Cartridges," and in U.S. Provisional Patent Application No. 60/667,970 filed Apr. 4, 2005 and entitled "Shoe Footbed With Interchangeable Cartridges," the entire disclosures of which are hereby incorporated by reference herein.

The footbed 152 may be formed of one or more material layers, regions and/or segments, which may each have a different thickness and/or a different rigidity. For example, the footbed 152 may comprise multiple layers of different rigidity. Alternatively, the footbed 152 may have different levels of rigidity in the forefoot, instep and heel regions, respectively. The footbed 152 could also have a first segment about the first metatarsal on the medial side of the forefoot of a first rigidity and a second segment about the fifth metatarsal on the lateral side of the forefoot of a second rigidity. In a preferred example, a first layer or region of the footbed 152 comprises EVA foam such as compression molded EVA ("CMEVA"), and a second layer or region of the footbed 152 includes an antimicrobial component.

A component such as an insole/lasting board or insulating member 154 is desirably placed between the steel plate 150 and the footbed 152. The insole board/insulating member 154 may be used in the lasting process to form and secure the upper 104 around to last. The insole board/insulating member 154 may also provide enhanced thermal or other protection for the wearer's foot. A suitable thermally protective material such as a tightly woven aramid may be used. A steel toe or toe protector 156 may be connected to or integrally formed with the footbed 152 for added protection of the wearer's toes. The toe protector 156 may be, for example, steel, a composite plastic or other material. Furthermore, the toe protector 156 may be used with or without the toe guard 148.

A protective shell or upper overlay 158 may overlie the bottom of the upper 104, providing enhanced durability and protection to the article of footwear 100. The protective shell 158 may be positioned so as to protect the bottom portion of the upper 104, such as the portion extending from the top of the outsole 102 upward to the ankle region and forward to cover the forefoot and toe region, including the toe cap area. The protective shell 158 may comprise, for instance, fire retardant finished leather, a leather or synthetic, rubber, etc. as the outermost layer. The protective shell 158 may provide protection against other hazards besides fire. For example, the protective shell 158 may be chemically non-reactive for chemical spills and other hazardous material situations.

In addition to components such as the steel plate 150, the lasting board/insulating member 154, the toe protector 156 and the protective shell 158 that are preferably integrated or positioned within the article of footwear 100, there are other components that may be part of the article of footwear 100 as well. By way of example only, the article of footwear 100 may also include an ankle protector 160. The ankle protector 160 may be placed on the interior of the upper 104, between layers of the upper 104, or on the outer shell or housing 124 of the upper 104. The ankle protector 160 may be on the medial and/or the lateral sides of the upper 104. Preferably, the ankle protector 160 is located at least on the lateral side. In one example, the ankle protector 160 comprises one or more layers of padding, such as foam padding or felt in combination with a durable material such as leather.

A protective reinforcement 162 is desirably placed on the rear of the article of footwear 100. The protective reinforcement 162 may include size moniker or other label 164 that can indicate the size of the article of footwear 100. The size indication enables a firefighter or other first responder to quickly select a pair of boots to put on as he or she is putting on protective gear. The label 164 is preferably on the order of at least 2 cm in diameter, and is more preferably between about 2.5 and 5 cm in diameter. The label 164 can also be used as an area to place other pertinent data or unique markers such as a lot number, wearer's name, or pair ID.

As discussed above, a firefighter may use a hose while standing on a ladder. The hose pressure creates a dangerous condition as it is very hard for the firefighter to maintain his or her balance on the ladder while holding and directing the hose. Such a situation mandates the use of the ladder lock position. However, as noted above, the ladder lock position can place tremendous strain on the lower front portion of firefighter's leg, e.g., the tibia or shin region. A preferred embodiment of the article of footwear 100 addresses this issue by protective pad 166 disposed on the front or gusset 126 of the upper 104. The protective pad 166 can be positioned, for example, along the surface of the gusset 126 or if no gusset is incorporated, placed specifically on front of upper, to protect and cover shin and top of forefoot region. Desirably, the protective pad 166 is formed from silicon that is co-molded with a pre-formed piece of material such as rubber or leather or rubber on the most external surface. This molded surface may be formed into a series of ridges, texture or other geometries that provide traction or interlock against the ladder surface during the leg lock maneuver. The molded surface of the protective pad 166 can provide traction as well as protection. The molded surface can be backed with a padding material such as foam for enhanced bruise protection. The aforementioned footwear structures are applicable to any activity whereby the wearer needs tibia or shin region protection.

The protective pad 166 may run along the entire length of the front surface of the upper 104, e.g., from the ankle region to the collar region of the article of footwear 100. Alternatively, the protective pad 166 may only be disposed along the upper or lower shin portion of the article of footwear 100. Desirably, the protective pad 166 is at least 10 cm in length. More desirably, the protective pad is at least 15 cm in length, such as between about 15 to 30 cm. The protective pad 166 may be, for example, substantially as wide as the gusset 126 or front of the upper 104.

In an alternative embodiment of an article of footwear $\mathbf{100}_1$ shown in FIGS. 4(*a*) and 4(*b*), a molded a collar 140' may be employed. As seen in these figures, handle members 142' may be integrally formed as part of the collar 140' on the medial and/or lateral sides of the collar 140'. The handle members 142' and the collar 140' may be the same as the handle members 142 and the collar 140 described above. Preferably, the handle members 142' and the collar 140' comprise a molded high temperature plastic, rubber, etc. that is either affixed to or integrally formed with the top of the upper 104. In such case, no fasteners 146 are necessary. However, the collar 140' may have reinforcing stitching 168 along either side of each handle member 142'. In addition, an identifier or other indicator 170 may be placed along the molded handle member 142*a* for easy viewing. The identifier 170 may include, for instance, instructions for putting on the article of footwear $\mathbf{100}_1$, safety instructions, a personalized nameplate, etc.

FIG. 4(*c*) illustrates a partial cutaway view of the article of footwear $\mathbf{100}_1$. As shown in FIG. 4(*c*), a carrying member 172 may be placed along the inside of the collar 140' or the top part of the upper 104. Preferably, the carrying member 172 is affixed to the medial portion of the article of footwear $\mathbf{100}_1$. The carrying member 172 enables a firefighter to quickly and easily grasp the article of footwear $\mathbf{100}_1$ for carrying. Desirably, one carrying member 172 is placed along the medial portion of each one of a pair of articles of footwear $\mathbf{100}_1$, and allows the pair to be easily picked up and carried. This placement allows the firefighter to grasp the pair without having to look and see where to grip, as shown in FIG. 4(*d*). The carrying member 172 is preferably connected to the article of footwear $\mathbf{100}_1$ by stitching 174 along both sides and the top, as seen in FIG. 4(*c*). The bottom 175 of the carrying member 172 is preferably substantially or completely unstitched. The carrying member 172 may comprise a webbing or slightly elastic material.

FIG. 5(*a*) illustrates another embodiment showing an article of footwear $\mathbf{100}_2$ in accordance with aspects of the present invention. Here, the article of footwear $100_2$ includes the collar 140' with handle members 142', as well as the ankle protector 160, which may be on one or both of the medial and lateral sides of upper 104'. The article of footwear $100_2$ preferably also includes a reinforcing member such as the protective reinforcement 162 with the label 164. Unlike the article of footwear 100, the article of footwear $100_2$ preferably does not include the gusset 126. Instead, the outer shell 124' of the upper 104' is desirably constructed as a substantially uninterrupted member. Nonetheless, the front portion of the outer shell 124' desirably includes a protective pad 166'.

As best seen the front view of FIG. 5(*b*) and the cutaway view of FIG. 5(*c*) along the 5A-5A line of FIG. 5(*b*), the protective pad 166' preferably includes a series of projections or ridges 176 along the exterior surface separated by grooves 178. As with molded surface of the protective pad 166', the ridges 176 and grooves 178 are used to provide enhanced traction with the ladder when the firefighter's leg is in the ladder lock position. Optionally, a friction enhancing coating or surface may be applied to the exterior surface of the protective pad 166' to provide enhanced traction and engagement with the ladder. By way of example only, the ridges 176 and grooves 178 may include an outer layer of brushed rubber or other material having a high coefficient of friction.

FIGS. 5(*d*) and 5(*e*) illustrate the collar 140' and handle member 142' in more detail. As with the gripping overhang or lip 144 above, the gripping overhang or lip 144' is positioned below the top line or upper surface of the collar 140'. As seen in the cutaway view of FIG. 5(*d*) along the 5B-5B line of FIG. 5(*e*), the collar may include a padded portion 180 of, for example, foam. The padded portion 180 preferably includes a roll top edge 182 that is incorporated within the topline of the collar 140' and connects to the handle portion of the gripping overhang 144'. As shown, the gripping overhang 144' may have a thickness on the order of 3 mm, or preferably between 2-4 mm. Desirably, the thickness is less than about 6 mm.

The ankle protector 160 of this embodiment is shown in the side view of FIG. 5(*f*), the cutaway view of FIG. 5(*g*) and the interior view of FIG. 5(*h*). As seen in the cutaway view of FIG. 5(*g*) along the 5C-5C line of FIG. 5(*f*), the ankle protector 160 may include an outer cover 184, an outer shell 186, protective insert 188 of, for example, foam, or felt, and an inner lining 190.

In an alternative arrangement, the respective side and rear views of FIGS. 5(*i*)-(*j*) and the component view of FIG. 5(*k*) show that rear structural element or protective reinforcement 162' may also include one or more dimples, grooves or recesses 192 along the back portion thereof, for example in a series of rows, which can provide the rear structural element or protective reinforcement 162' and/or the collar 140' with enhanced flexibility or in the case of the collar 140', traction for better grip. FIG. 5(*l*) is a cutaway view along the 5D-5D line of FIG. 5(*j*) showing the reflective label 164 in detail. Here, a reflective number or other identifier may be provided by raised segment(s) 193 positioned on backing 194.

FIG. 6(*a*) illustrates a side view of an article of footwear 200 in accordance with aspects of the present invention. The article of footwear 200 is desirably formed as a "duty" type boot for use in less hazardous conditions than the call type boots described above. For example, the duty boot 200 may be used in rescue situations. However, as discussed above, the duty identifier is merely exemplary of types of activities that may be performed in exemplary situations or environments, and is not meant to limit how or where any particular footwear configuration such as the article of footwear 200 is employed. As with the article of footwear 100, the article of footwear 200 comprises several components, namely an outsole 202, an upper 204, a rand 206 and a midsole (not shown). The outsole 202 provides a ground contacting surface. The upper 204 provides a receptacle or enclosure for receiving a wearer's foot. The rand 206, as with the rand 106, provides extra protection to the article of footwear 200. The rand 206 may be formed using any of the materials described above with respect to the rand 106. The rand 206, as the rand 106, may be fabricated and employed as a distinct component, or may be fabricated integrally or otherwise employed in conjunction with, for example, the outsole 202 and/or the midsole. The midsole is ideally located between the outsole and the upper and connects the two together.

The midsole is preferably formed of molded TPU and/or thermoplastic rubber ("TPR"), which can be formed in several different ways. By way of example only, the entire midsole may be formed as a single unit via direct injection molding. In an alternative, the midsole may be formed with non-overlapping front and rear pieces as a two-part rubber cup with butted edges in a compression set. In a further alternative, the midsole may be formed as a two-part rubber cup with lapped edges in a compression set. The midsole may also be formed as part of or in conjunction with the outsole 202, the upper 204, and/or the rand 206. Of course, it should be understood that the midsole may be fabricated in other ways and the invention is not limited to any particular configuration. The features of the article of footwear 200, including the outsole 202, the upper 204, the rand 206 and the midsole will be described in detail below.

As best seen in FIGS. 6(*a*)-(*c*), the outsole 202 preferably includes a tread in the form of lugs 208. The lugs 208 may be formed in one or more rows extending, for example, from the medial to the lateral side of the outsole 202. The rows of lugs 208 desirably have a straight edge 210 facing toward the front or toe region of the article of footwear 200, and a diamond, sawtooth or substantially triangular pattern 212 adjacent to the edge 210. The edge 210 is especially beneficial when climbing a ladder, as it provides a clean edge facing the ladder rungs. The sawtooth pattern 212 is adapted to grip and interlock with a corresponding tread pattern on the rungs of the ladder. Of course, it should be understood that other patterns may be employed so as to achieve interlock, depending upon the tread pattern on the ladder rungs. Channels 214 may be deeply inset in the outsole 202, for instance along the forefoot region, to provide flex thereto.

FIG. 6(*d*) is a side view of one of the lugs 208, which shows that the lug 208 preferably includes a large radius to the inside edge of the lug 208. The large radius prevents dirt buildup and reduces clogging of the lugs 208 by debris or other material. As shown in FIGS. 6(*b*)-(*c*), the outsole 202 between rows of the lugs 208 may include additional traction elements such as siping 216. As shown in FIG. 6(*c*), sides of the lugs 208 may be beveled, and are preferably placed so that the triangular patters are substantially right angle patterns. FIG. 6(*e*) shows that the front or toe region of the outsole 202 may also include siping 218 for added traction. The outsole 202, midsole and/or the rand 206 may be formed separately or as an integral unit of, for example, molded TPU, as illustrated in FIG. 6(*f*). As shown in this figure, the outsole 202 may include slits or flex segments 219 to enable the outsole 202 to flex or bend during wear.

Returning to the side view of FIG. 6(*a*), it can be seen that the toe and/or heel regions of the outsole 202 may include ridges 220 thereon. The ridges 220 may be used to provide enhanced traction when kneeling, crawling, or climbing. Furthermore, the outsole 202, including the lugs 208, is preferably formed from a fire resistant material such as nitrile rubber or other composition with a high melting temperature. Desirably, the melting temperature is at least 260° C.

A reflective indicator 222 of, for example, paint or tape, may be positioned above the outsole 202. The reflective indicator 222 desirably runs substantially or entirely around the article of footwear 200. In addition, the reflective indicator 222 may be configured as an inset groove positioned circumferentially along the top line of the outsole. In one alternative, the midsole (not shown) preferably comprises molded TPU. In another example, the midsole may comprise EVA, such as IMEVA, or PU. However, other materials may be used alone or in combination to form the midsole. Such materials include, but are not limited to, polyether and polyester based polyurethane, rubber, plastics, etc. As discussed above, the rand 206 can be made, for example, from aramid material(s), or a heat resistant and flame retardant finished leather, rubber or thermoplastic material.

The upper 204 has an outer shell 224 that is preferably fire resistant if not fireproof. By way of example only, the outer shell 224 may include any of the materials discussed above with respect to the outer shell 124, and may protect against other conditions besides fire, such as chemicals or other hazardous materials.

The outer shell 224 preferably includes a tongue or gusset 226. The tongue/gusset 226 provides an adjustable region to enable the wearer to quickly and easily insert his or her foot and leg into the article of footwear 200. Once the wearer's foot is inserted into the article of footwear 200, it is desirable to secure the foot and, optionally, the leg, to the article of footwear 200 to achieve a snug and safe fit.

The article of footwear 200 includes a dual fitting and securing system, which includes a lacing system 228 and a zipper apparatus 230. The lacing system 228 preferably comprises a single lace 228*a* that runs from the medial side to the lateral side of upper 204, crossing over the lower most portion of the tongue/gusset 226. Each side of the lacing system 228 secures to the respective sides (medial/lateral) of the tongue 226 as not cross over the zipper apparatus 230 or otherwise obstruct the operation of the zipper apparatus 230. This allows for an initial in-shoe fitting for security via zipping and adjustment to the lacing. Once the lace 228*a* is set as desired, the zipper apparatus 230 would allow quick and easy on/off of the footwear 200 with little to no further adjustment required. The lace 228*a* may run through one or more receptacles 232 such as eyelets 232*a* and/or rings 232*b*. The receptacles 232 may comprise a bungee-style closure system on the lateral and/or medial sides of the upper 204. In another embodiment the lacing system 228 may include a single lace 228*a* that is laces on either the lateral or medial side of the tongue 226 as shown in FIGS. 11(*a*) and (*b*). In this alternative, the lace 328*a* is secured to the upper 304 on the medial side of the tongue 326, crosses over the forefoot and secures to tongue 326 and the upper 304 on the lateral side of the article of footwear 300.

Returning to FIG. 6(*a*), an end of the lace 228*a* may be adjustably secured to by a lace locking mechanism 234. This end of the lace may be crimped or burned to prevent accidental disengagement from the lace locking mechanism 234. The other end of the lace 228*a* may be adjustably secured to another lace locking mechanism 234 on the other side of the article of footwear 200, or may be rigidly attached to the upper 204. The ring 232*b* is shown in more detail in FIG. 6(*g*)

The zipper apparatus 230 is preferably centrally positioned along the tongue 226, as shown in FIGS. 6(*h*) and 6(*i*). As seen in FIG. 6(*j*), the lace 228*a* in this embodiment is preferably run through the receptacles 232 in a mirror image pattern along the medial and lateral sides of the tongue 226 and/or other portions of the housing 224.

As mentioned above, the positioning of the lacing system 228 and the zipper apparatus 230 are designed to enable an initial adjustment of the article of footwear 200 so that the wearer's foot can slide in and out while securely retaining the heel or the rest of the foot in the article of footwear 200 during use. By way of example only, the initial adjustment may include pulling or otherwise adjusting the lace 228*a* to achieve a desired tightness with the lace locking mechanism(s) 234. Then the zipper apparatus 230 can be zipped up to secure the foot in the article of footwear 200. When the firefighter or other first responder subsequently dons the article of footwear 200, all that need be done is to zip up the zipper apparatus 230, as the lace 228*a* has already been adjusted. Thus, it can be seen that a firefighter or other first responder can easily slide his or her foot into the article of footwear 200, engage the zipper apparatus 230, and proceed to respond to whatever call has arisen.

The article of footwear 200 desirably also includes a collar 240 positioned along the top of the upper 204. The collar 240 preferably includes one or more handle members 242 positioned thereon. The handle members 242 enable the firefighter to easily grip the article of footwear 200 so as to pull it onto his or her foot. A first handle member 242 may be placed on the medial side of the collar 240 and a second handle may be placed on the lateral side of the collar 240. The handle members 242 may be the same as the handle members 142 described above.

A preferred example of the handle member 242 is shown in more detail in FIG. 6(*k*). Unlike conventional hoop grips connected to the top of a boot and projecting up from the boot, the handle members 242 are most preferably rubber or plastic handles that are sewn or otherwise integrated into the collar 240. The handle members 242 may be the same as the handle members 142 described above. Each handle member 242 can be flush with outer surface of the upper 204. In this case, the interior of the handle member 242 can be of a softer material, for example backed with foam, that can easily deform to receive fingers for easy grip. Specifically, each handle member 242 may be open to expose the outer shell 224 of the upper 202, or may have a backing material 244 that covers the housing 224. The handle member 242 is preferably spaced at least 2-4 cm below the topline 243 of the upper 204, and preferably projects no more than 4-8 cm from the side of the housing 224. More preferably, the handle member 242 spaced between 1 and 10 cm below the top line of the upper 204, and projects less than about 2-3 cm from the outer shell 224 of the upper 204. Such slight, streamlined configurations are sufficient to enable the firefighter or other first responder to grab onto the handle member 242 while providing a low profile that substantially reduces the likelihood of accidentally catching or snagging onto debris, clothing, equipment or other material or structures. The handle members 242 can be implemented with a variation on the medial and lateral sides such that medial handle member 242 could have a lower or higher profile than the lateral handle member 242 to prevent the handle members 242 on a pair of boots or other footwear 200 from hitting each other during use, for example as the wearer is walking.

Figure 7A:
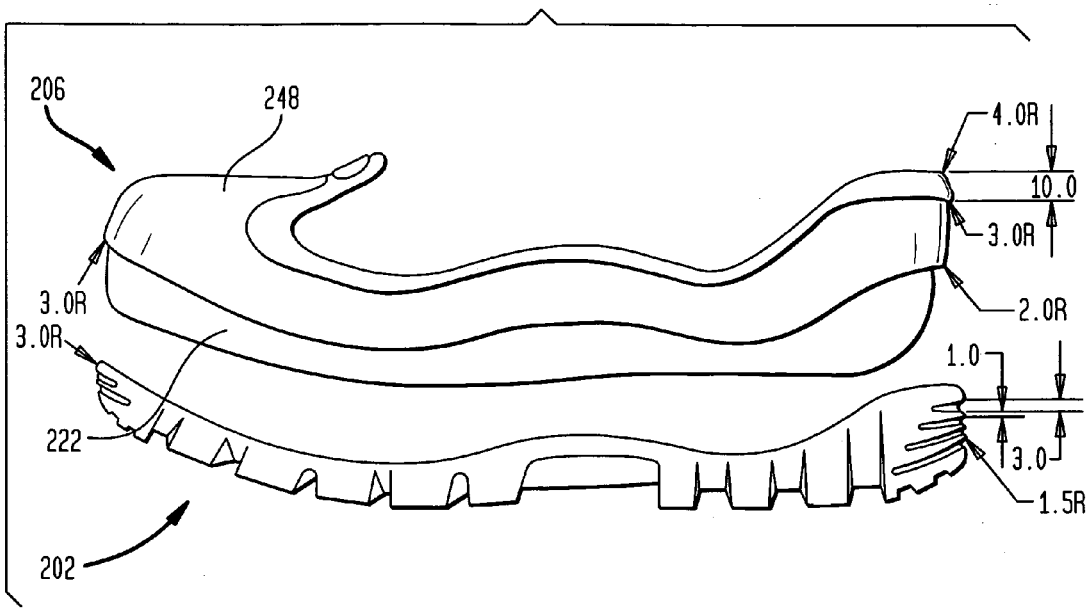
FIGS. 7(*a*)-(*c*) illustrate additional views of the article of footwear of FIGS. 6(*a*)-(*k*).
Figure 7B:
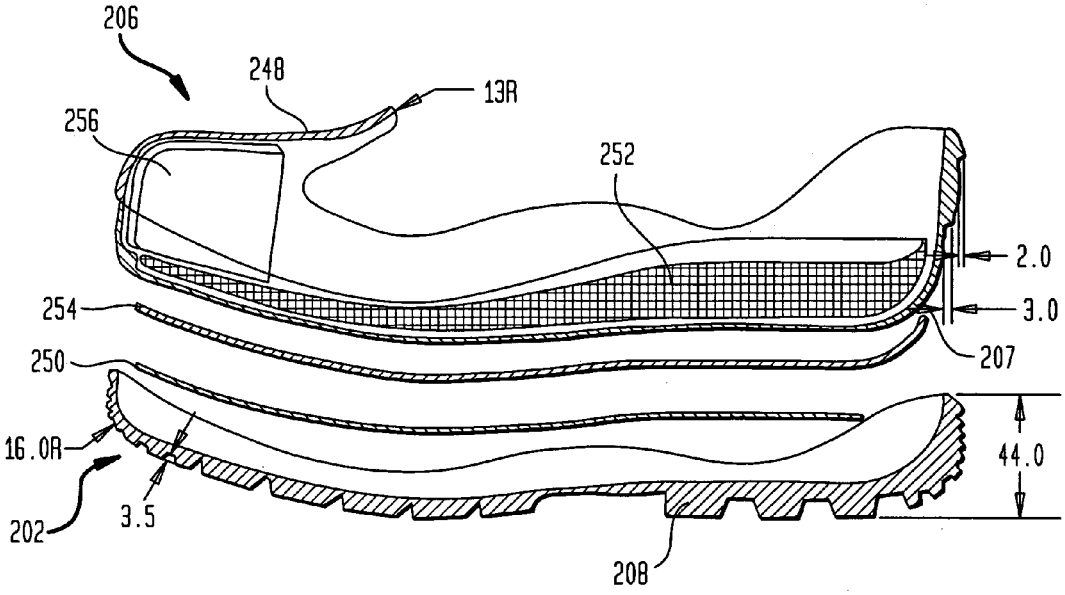
Figure 7C:
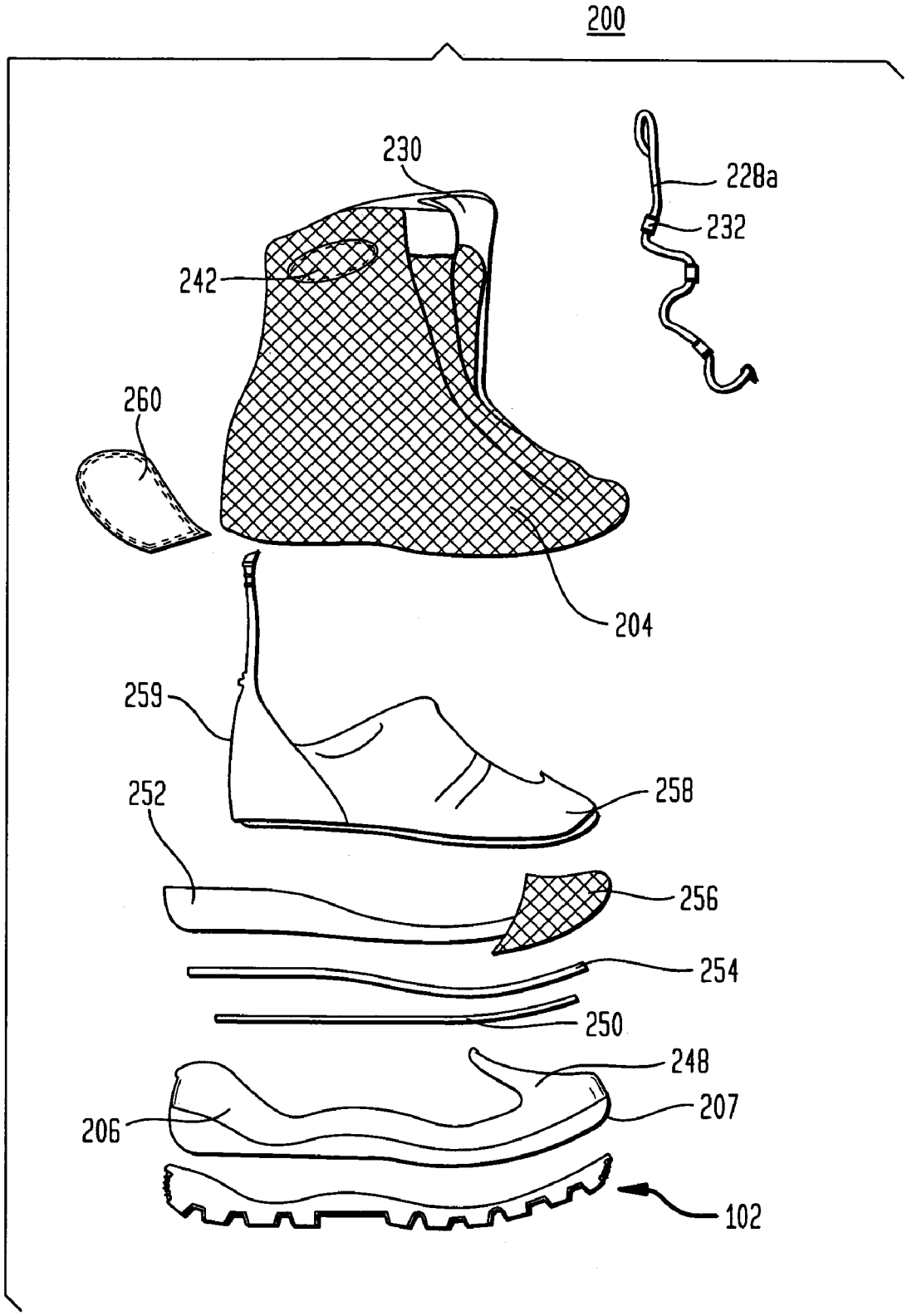

FIG. 7(*a*) is an exploded view of the article of footwear 200. As shown here, the reflective indicator 222 may be positioned on, above or adjacent to the outsole 202. The reflective indicator 222 may comprise, for example, a layer or material such as a reflective paint or tape. The reflective indicator 222 desirably runs substantially or entirely around the article of footwear 200, and may cover at least a portion of midsole 207. In addition, the reflective indicator 222 may be configured as an inset groove positioned circumferentially adjacent or along the top line of the outsole 202. Reflective indicators 222 may also be positioned elsewhere along the article of footwear 100.

The article of footwear 200 may also include a toe guard 248, which may be integrally molded as part of midsole 207, the outsole 202 or the rand 206. Alternatively, the toe guard 248 may be attached to the midsole 207, the outsole 202 or the rand 206 during fabrication of the article of footwear 200. The midsole 207 may also be integrally molded or otherwise formed with the outsole 202, or may be fabricated in any of the manners described above. The cutaway view of FIG. 7(*b*) along the 6A-6A line of FIG. 6(*b*) shows that a plate, such as steel plate 250, may be disposed between the midsole 207 and the outsole 202 for enhanced support or protection of the wearer's foot.

A footbed 252 may be permanently or removably positioned within the article of footwear 200. The footbed 252 is preferably positioned on or adjacent to the midsole 207, with the optional steel plate 250 between them. The footbed 252 may be formed from resilient materials such as EVA or PU foams or other such materials commonly used in shoe midsoles, insoles or sockliners.

As with the footbed 152, the footbed 252 may be formed of one or more material layers, regions and/or segments, which may each have a different thickness and/or a different rigidity. For example, the footbed 252 may comprise multiple layers of different rigidity. Alternatively, the footbed 252 may have different levels of rigidity in the forefoot, instep and heel regions, respectively. The footbed 252 could also have a first segment about the first metatarsal on the medial side of the forefoot of a first rigidity and a second segment about the fifth metatarsal on the lateral side of the forefoot of a second rigidity. In a preferred example, a first layer or region of the footbed 252 comprises EVA foam such as CMEVA and a second layer or region of the footbed 252 includes an antimicrobial component. The footbed 252 may also be an adjustable footbed, as described above with regard to the footbed 152.

An insole, lasting board, and/or insulating member 254 is desirably placed between the steel plate 250 and the midsole 207 and/or the footbed 252. When used as an insulator, the insulating member 254 provides enhanced thermal protection for the wearer's foot. A toe protector or steel toe 256 may be connected to or integrally formed with the upper 204 for added protection of the wearer's toes. Alternatively, the toe protector 256 may be securely received or integrated into the midsole 207. The toe protector 256 may be, for example, steel, a composite plastic or other material. Furthermore, the toe protector 256 may be used with or without the toe guard 248.

FIG. 7(*c*) is another exploded view of the article of footwear 200 showing an alternative configuration. The midsole 207 may be molded to include the rand 206 as well as a toe guard 248. The midsole 207 may also be integrally molded or otherwise formed with the outsole 202, or otherwise formed in any of the manners discussed above. The steel plate 250 may be disposed on, in or adjacent to the midsole 207 for enhanced support or protection of the wearer's foot. Here, the insole, lasting board and/or insulating member 254 may be positioned over the steel plate 250 and below the footbed 252. As seen in this figure, a protective shell or overlay 258 may overlie the midsole 207 for enhanced shielding of the top of the wearer's foot. As with the protective shell 158, the protective shell 258 may provide protection against fire and other hazards. For example, the protective shell 258 may be chemically non-reactive for chemical spills and other hazardous material situations. The protective shell 258 may comprise, for instance, molded silicon or other materials as with the protective shell 158. The protective shell 258 may be, for example, attached or otherwise connected to the midsole 207, the rand 206 and/or the upper 204. In addition, the protective shell 258 may be removably insertable into the article of footwear 200. Optionally, the protective shell 258 may include a reflective strip member 259 disposed along the rear thereof. The reflective indicator 222 may be positioned to show substantially or entirely along the topline of the outsole 202.

In addition to components such as the steel plate 250, the lasting board/insulating member 254, the toe protector 256 and the protective shell 258 that are preferably integrated or positioned within the article of footwear 200, there are other components that may be part of the article of footwear 200 as well. By way of example only, the article of footwear 200 may also include an ankle protector 260. The ankle protector 260 may be placed on the interior of the upper 204, between layers of the upper 204, or on the outer shell or housing 224 of the upper 204. The ankle protector 260 may be on the medial and/or the lateral sides of the upper 204. Preferably, the ankle protector 260 is located at least on the lateral side. In one example, the ankle protector 260 comprises one or more layers of padding, such as foam padding or felt in combination with a durable material such as leather.

Figure 8A:
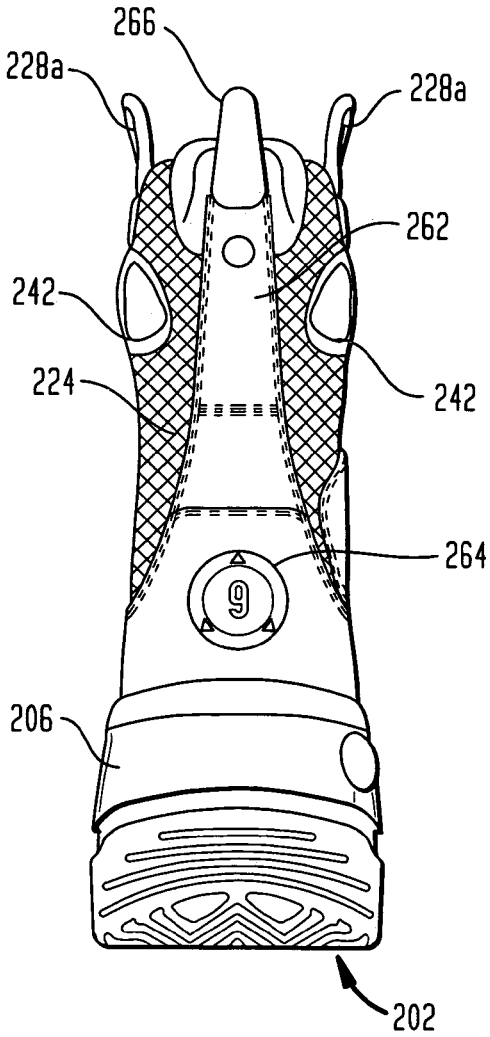
FIGS. 8(*a*)-(*b*) illustrate additional views of the article of footwear of FIGS. 6(*a*)-(*k*).
Figure 8B:
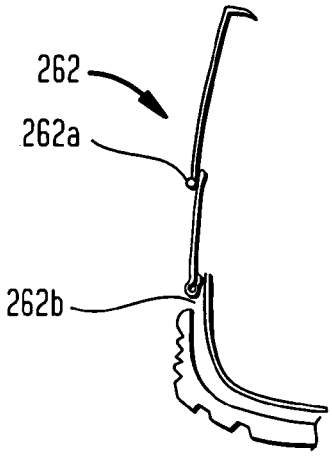
Figure 9A:
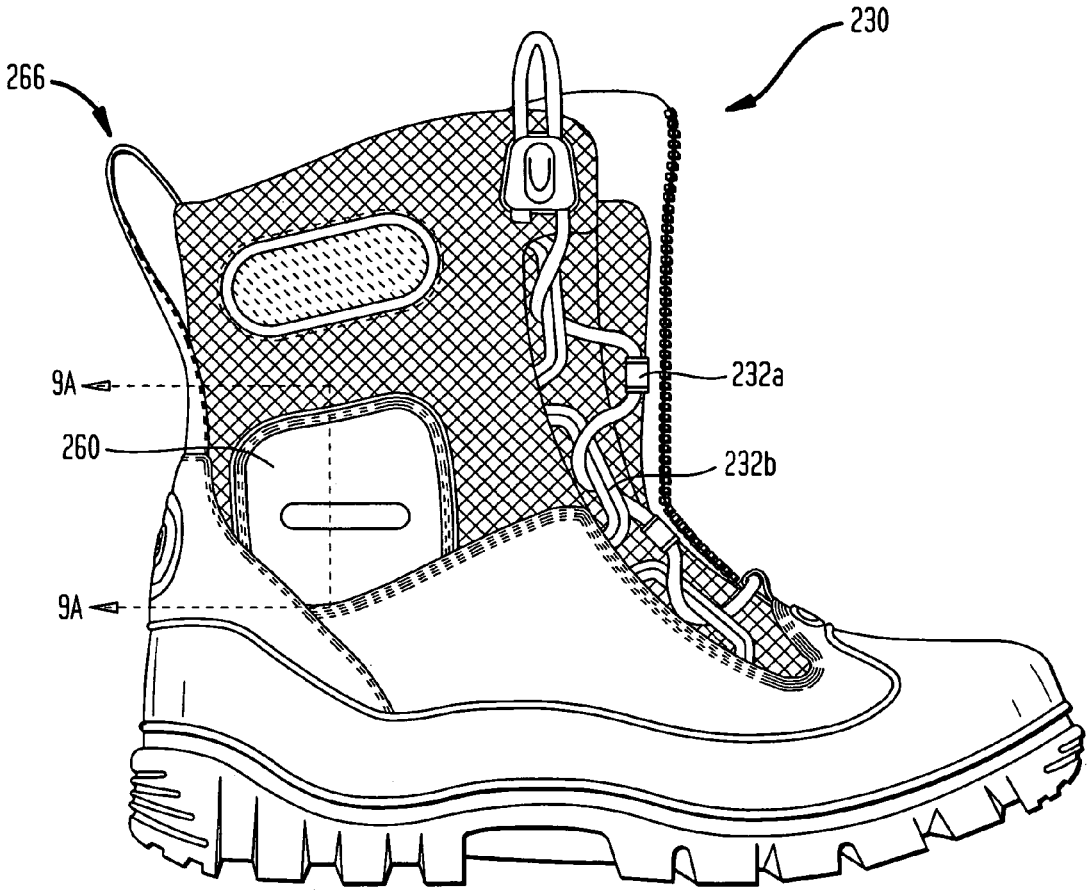
FIGS. 9(*a*)-(*d*) illustrate an ankle protector in accordance with aspects of the present invention.
Figure 9B:
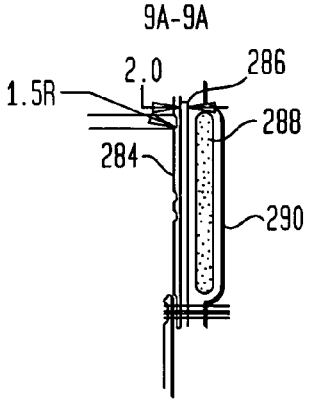
Figure 9C:
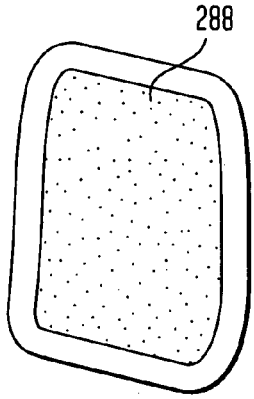
Figure 9D:
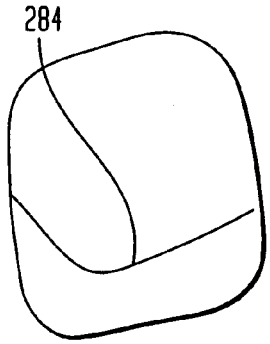

A guard or protective reinforcement such as heel guard 262 is desirably placed on the rear of the article of footwear 200, as shown in FIGS. 8(*a*) and 8(*b*). The heel guard 262 may be formed of one or more segments or pieces, and may include piping 262*a* and/or reflective tape 262*b*. The heel guard 262 may include a reflective label or indicator 264 that can indicate the size of the article of footwear 200 or other information as discussed above with regard to the indicator 164. The size or other indication enables a firefighter or other first responder to quickly select a pair of boots to put on as he or she is putting on protective gear. The label 264 is preferably on the order of at least 2 cm in diameter, and is more preferably between about 2.5 and 5 cm in diameter.

A pull tab 266 may also be positioned along the heel or back portion of the article of footwear 200. Returning to FIG. 6(*a*), the pull tab 266 can be seen attaching at one end to the top of the collar 240 and at the other end to the back of the housing 224. The pull tab 266 may be sewn or otherwise connected to the heel guard 262, or may be integrally formed therewith.

The ankle protector 260 of this embodiment is shown in the side view of FIG. 9(*a*), the cutaway view of FIG. 9(*b*), the interior view of FIG. 9(*c*) and the exterior view of FIG. 9(*d*). As seen in the cutaway view of FIG. 9(*b*) along the 9A-9A line of FIG. 9(*a*), the ankle protector 260 may include an outer cover 284, an outer shell 286, protective insert 288 of, for example, foam or felt, and an inner lining 290.

Figure 10A:
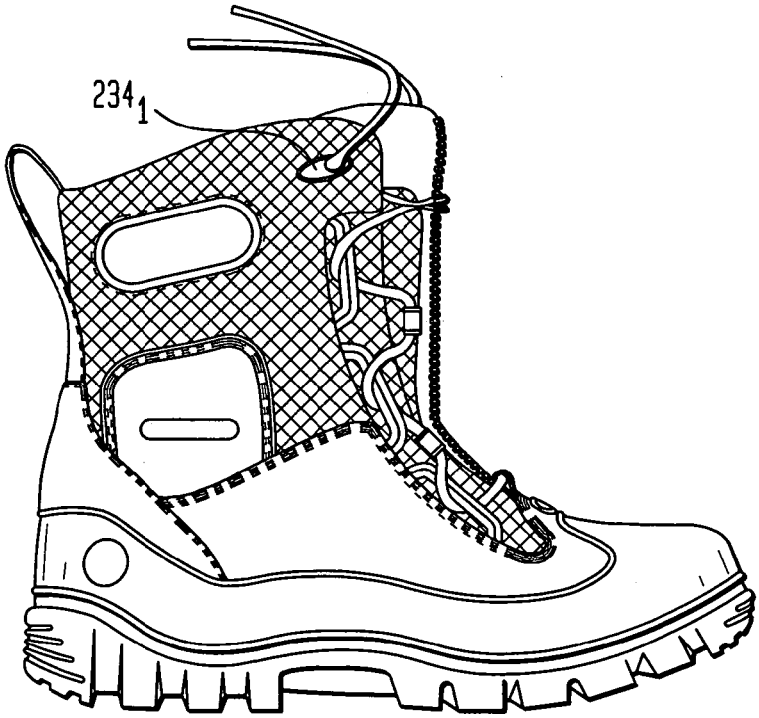
FIGS. 10(*a*)-(*c*) illustrate lace securing mechanisms in accordance with aspects of the present invention.
Figure 10B:
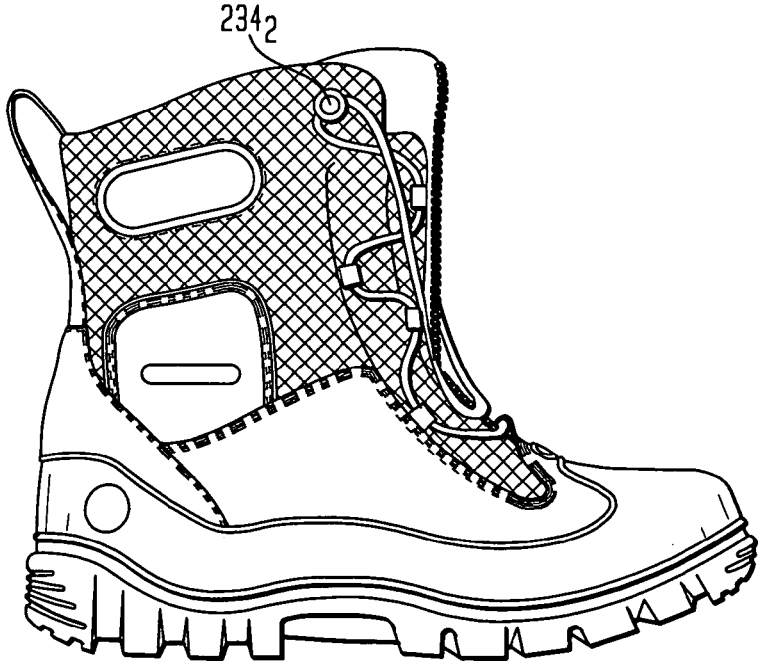
Figure 10C:
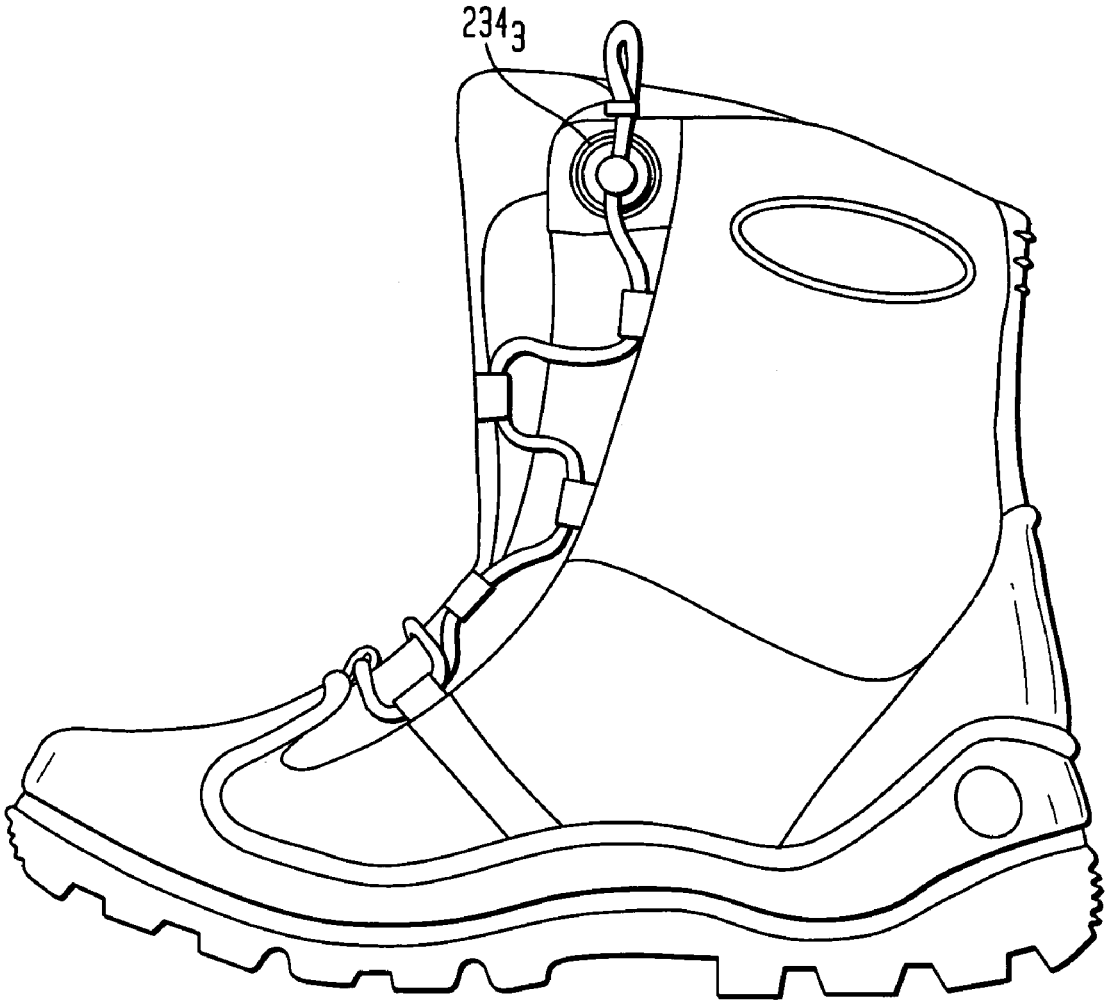
Figure 11A:
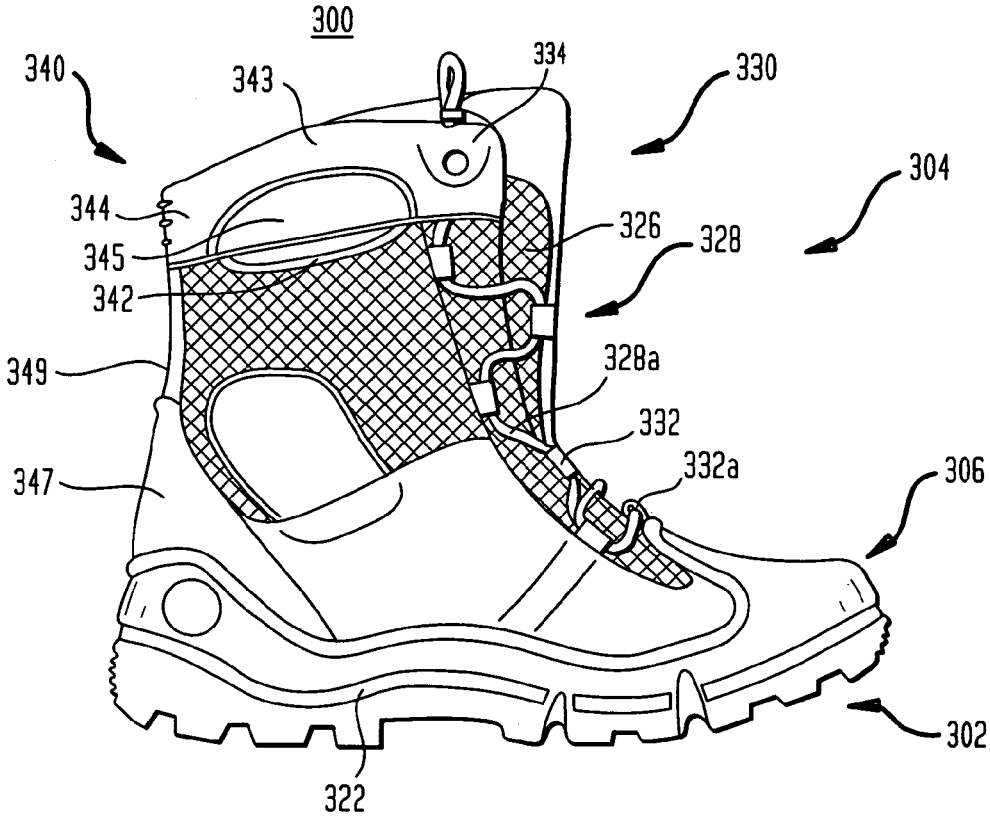
FIGS. 11(*a*)-(*d*) illustrate another duty boot configuration in accordance with aspects of the present invention.
Figure 11B:
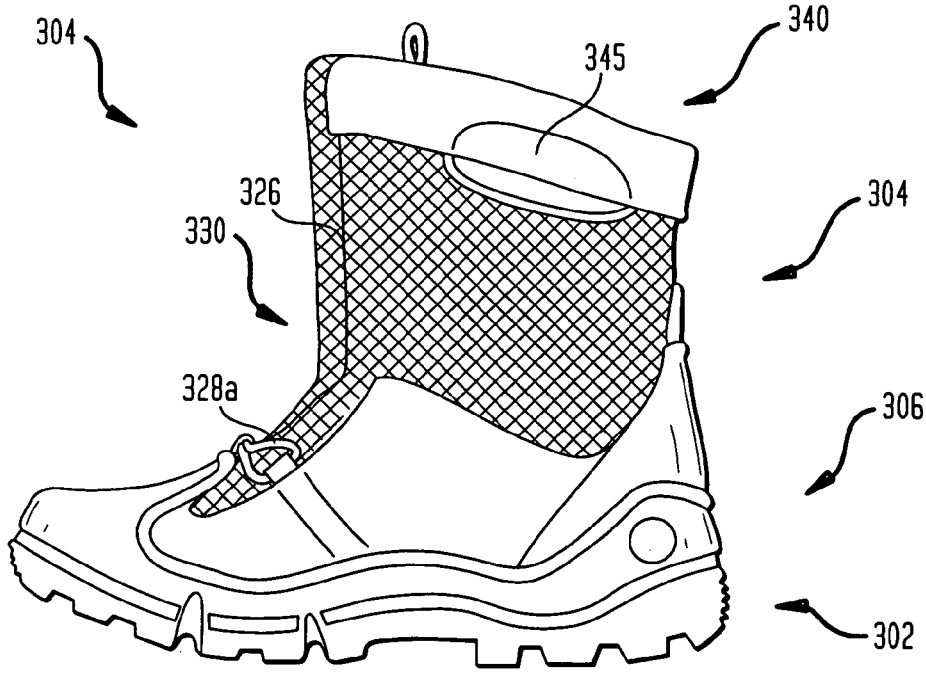
Figure 11C:
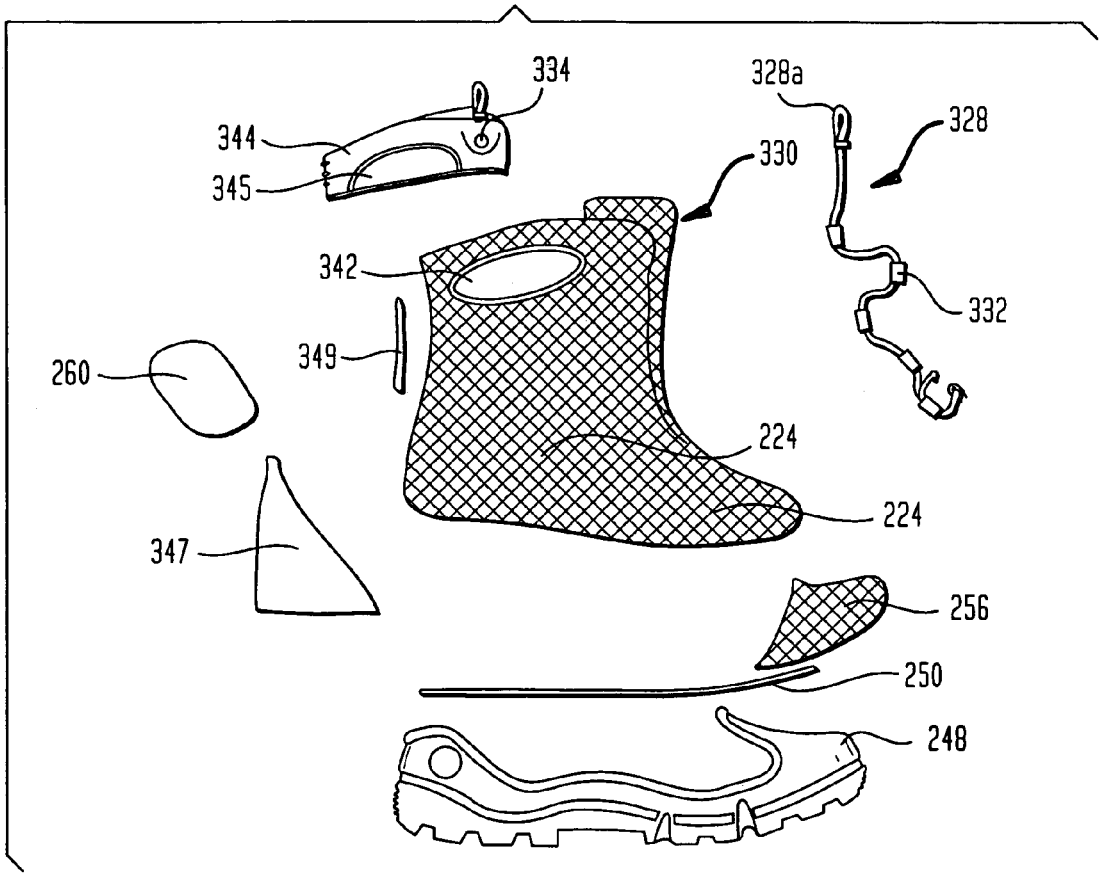
Figure 11D:
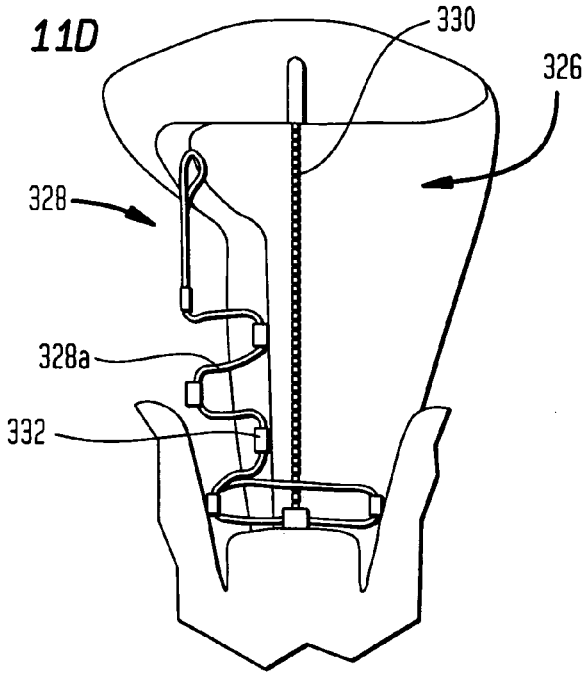

FIGS. 10(*a*) and 10(*b*) illustrate alternative lace locking mechanisms $\mathbf{234}_1$ and $\mathbf{234}_2$, respectively. As shown in FIG. 10(*a*), the lace locking mechanism $\mathbf{234}_1$ comprises a cleat to which the lace 228*a* can be tied. As shown in FIG. 10(*b*), the lace locking mechanism $\mathbf{234}_2$ may comprise a cinch strap or an eyelet-type member through which the lace 228 can be run. As seen in FIG. 10(*c*), one end of the lace 228*a* may be rigidly and securely affixed to a lace locking mechanism $\mathbf{234}_3$. In this case, only the other end of the lace 228*a* may be adjustable.

FIGS. 11(*a*) and 11(*b*) illustrate lateral and medial side views, respectively, of an article of footwear 300 in accordance with aspects of the present invention. The article of footwear 300 is desirably formed as a "duty" type boot that is generally similar to the article of footwear 200 described above, and includes many of the features thereof. However, as discussed above, the duty identifier is merely exemplary of types of activities that may be performed in exemplary situations or environments, and is not meant to limit how or where any particular footwear configuration such as the article of footwear 300 is employed. For example, the article of footwear 300 preferably comprises several components, an outsole 302, an upper 304, a midsole (not shown) and a rand 306 that may be identical or structurally equivalent to the outsole 202, the upper 204, the rand 206 and the midsole 207, and may be formed with the materials described above. The differences from the article of footwear 200 will now be described.

In particular, the article of footwear 300 includes collar 340 having one or more handle members 342. Here, unlike the collar 240, the collar 340 preferably includes a gripping overhang or cuff 344 similar to the gripping overhang 144. The gripping overhang or cuff 344 is preferably positioned below the top line or upper edge 343 of the article of footwear 300. The gripping cuff 344 preferably includes a handle 345, which is preferably integrally molded with the rest of the gripping cuff 344. The handle 345 of the gripping cuff 344 need only be spaced less than about 10 cm, more preferably between about 4-6 cm away from the housing or outer shell of the upper 304. In a preferred example, the handle 345 is spaced on the order of 5 cm or less from the exterior surface of the upper 304. The handle 345 is also preferably positioned below the top line 343, such as at least about 2 cm below the top line 343. More preferably, the handle 345 is on the order of 3-8 cm below the top line 343. The configurations of the gripping cuff 344 with the handle 345 provide slight, streamlined projections that are sufficient to enable the firefighter or other first responder to grab onto the handle 345 while providing a low profile that substantially reduces the likelihood of accidentally catching or snagging onto debris, clothing, equipment or other material or structures.

The exploded view of FIG. 11(*c*) shows that the article of footwear 300 may also include a heel member 347 and/or a backstay 349. The heel member 347 may comprise a rubber or plastic sheet that may include a reflect strip thereon. The backstay 349 may be formed of rubber, plastic or similar material.

FIG. 11(*d*) illustrated a dual fitting and securing system, which includes a lacing system 328 and a zipper apparatus 330. The lacing system 328 preferably comprises a single lace 328*a*. Unlike the lace 228*a* of the lacing system 228, the lace 328*a* preferably runs substantially along the medial or the lateral side of the article of footwear 300 along one side of tongue 326. The lace 328*a* may run through one or more receptacles 332 such as eyelets 332*a*. The receptacles 332 may comprise an elasticized/bungee-style closure system having an elastomeric/bungee type lace 328*a* on the lateral and/or medial sides of the upper 304.

As seen in FIG. 11(*d*), the lace 328*a* may wind or wrap around eyelets 332*a* along the bottom of the tongue 326. Most preferably, if the lace 328*a* runs up the lateral side of the tongue 326 then it does not run up the medial side of the tongue 326, and vice versa. The medial view of FIG. 11(*b*) shows that the lace 328*a* is only run along the bottommost portion of the tongue 326 and not along the medial side of the tongue 328*a*.

Returning to FIG. 11(*a*), an end of the lace 328*a* may be adjustably secured by a lace locking mechanism 334. The lace locking mechanism 334 preferably comprises a cinch cord that may be built into or integrally formed with the collar 340. The adjustable end of the lace 328*a* may be crimped or burned to prevent accidental disengagement from the lace locking mechanism 334. The other end of the lace 228*a* is preferably rigidly attached to the upper 304, for example along the bottom of the tongue 326.

The zipper apparatus 330 is preferably centrally positioned along the tongue 326, as shown in FIG. 11(*d*). The positioning of the lacing system 328 and the zipper apparatus 330 are designed to enable an initial adjustment of the article of footwear 300 so that the wearer's foot can slide in and out while securely retaining the heel or the rest of the foot in the article of footwear 200 during use, such as described above with the article of footwear 200. By way of example only, the initial adjustment may include pulling or otherwise adjusting the lace 328*a* to achieve a desired tightness with the lace locking mechanism 334. Then the zipper apparatus 330 can be zipped up to secure the foot in the article of footwear 300. When the firefighter or other first responder subsequently dons the article of footwear 300, all that need be done is to zip up the zipper apparatus 330, as the lace 328*a* has already been adjusted. Thus, it can be seen that a firefighter or other first responder can easily slide his or her foot into the article of footwear 300, engage the zipper apparatus 330, and proceed to respond to whatever call has arisen.

Figure 12A:
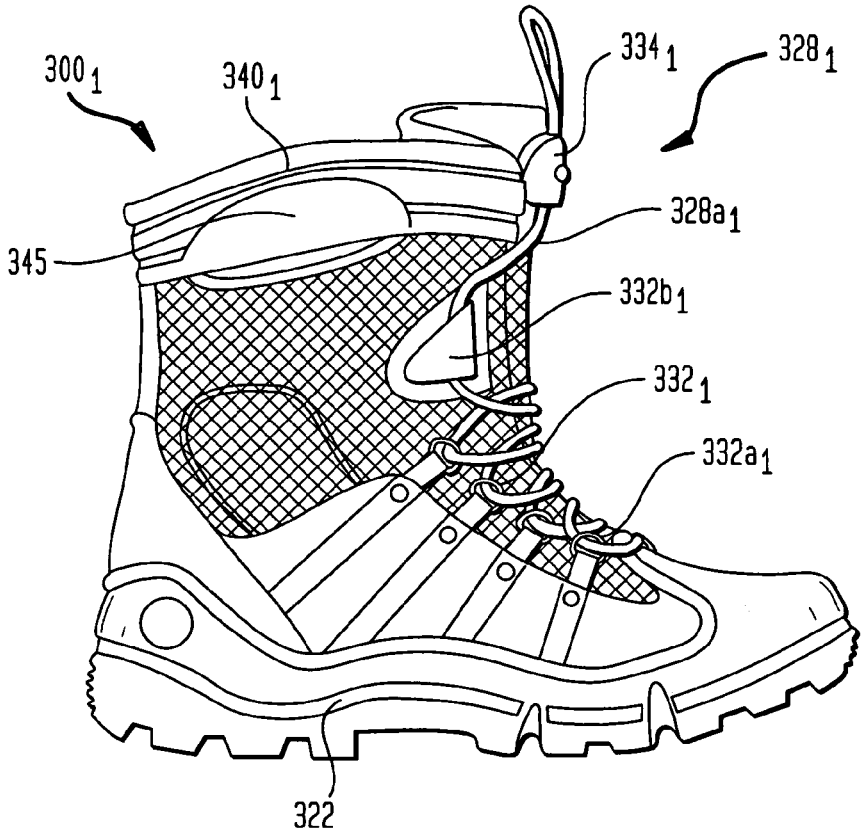
FIGS. 12(*a*)-(*c*) illustrate a further duty boot configuration in accordance with aspects of the present invention.
Figure 12B:
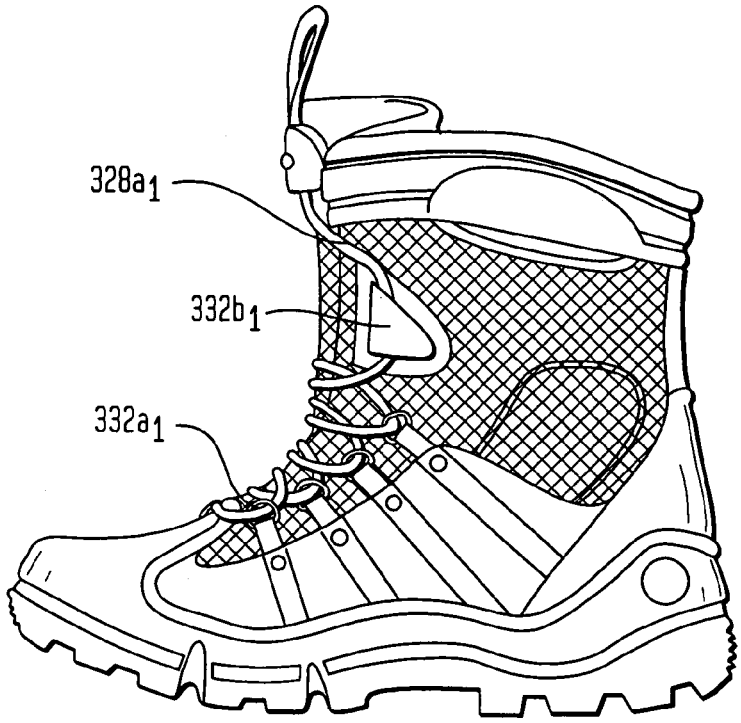
Figure 12C:
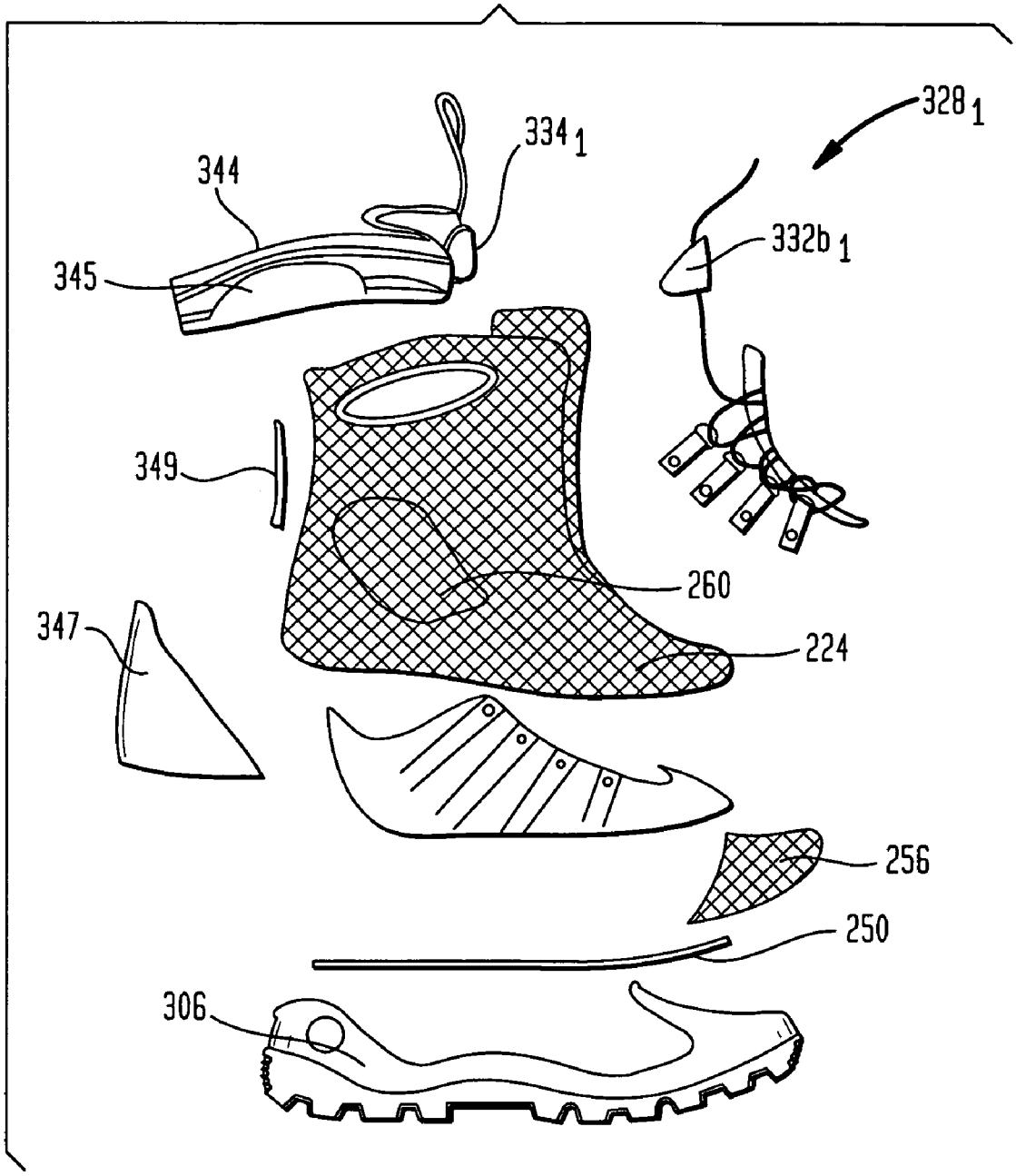

FIGS. 12(*a*) and 12(*b*) illustrate lateral and medial side views, respectively, of a modified version of the article of footwear 300, namely article of footwear $\mathbf{300}_1$, in accordance with aspects of the present invention. The article of footwear $\mathbf{300}_1$ is desirably formed as a "duty" type boot that is generally similar to the article of footwear 300 described above, and includes many of the features thereof. However, as discussed above, the duty identifier is merely exemplary of types of activities that may be performed in exemplary situations or environments, and is not meant to limit how or where any particular footwear configuration such as the article of footwear $\mathbf{300}_1$ is employed. The differences from the article of footwear 300 will now be described.

The fitting and securing system of the article of footwear $\mathbf{300}_1$ includes a lacing system $\mathbf{328}_1$ without a zipper apparatus. The lacing system $\mathbf{328}_1$ preferably comprises a single lace $\mathbf{328}a_1$. Unlike the lace 328*a* of the lacing system 328, the lace $\mathbf{328}a_1$ preferably crisscrosses over the tongue 326 from the medial side to the lateral side of the upper 304. The lace $\mathbf{328}a_1$ may run through one or more receptacles $\mathbf{332}_1$ such as eyelets or D-rings $\mathbf{332}a_1$, and/or cord loop $\mathbf{332}b_1$.

As seen in FIG. 12(*a*) and the exploded view of FIG. 12(*c*), an end of the lace $\mathbf{328}a_1$ may be adjustably secured to by a lace locking mechanism $\mathbf{334}_1$. The lace locking mechanism $\mathbf{334}_1$ preferably comprises a cinch cord that may be built into or integrally formed with collar $\mathbf{340}_1$. The adjustable end of the lace $\mathbf{328}a_1$ may be crimped or burned to prevent accidental disengagement from the lace locking mechanism $\mathbf{334}_1$. The other end of the lace $\mathbf{228}a_1$ is preferably rigidly attached to the upper 304. Alternatively, both ends of the lace $\mathbf{228}a_1$ are secured to the lace locking mechanism $\mathbf{334}_1$.

Figure 13A:
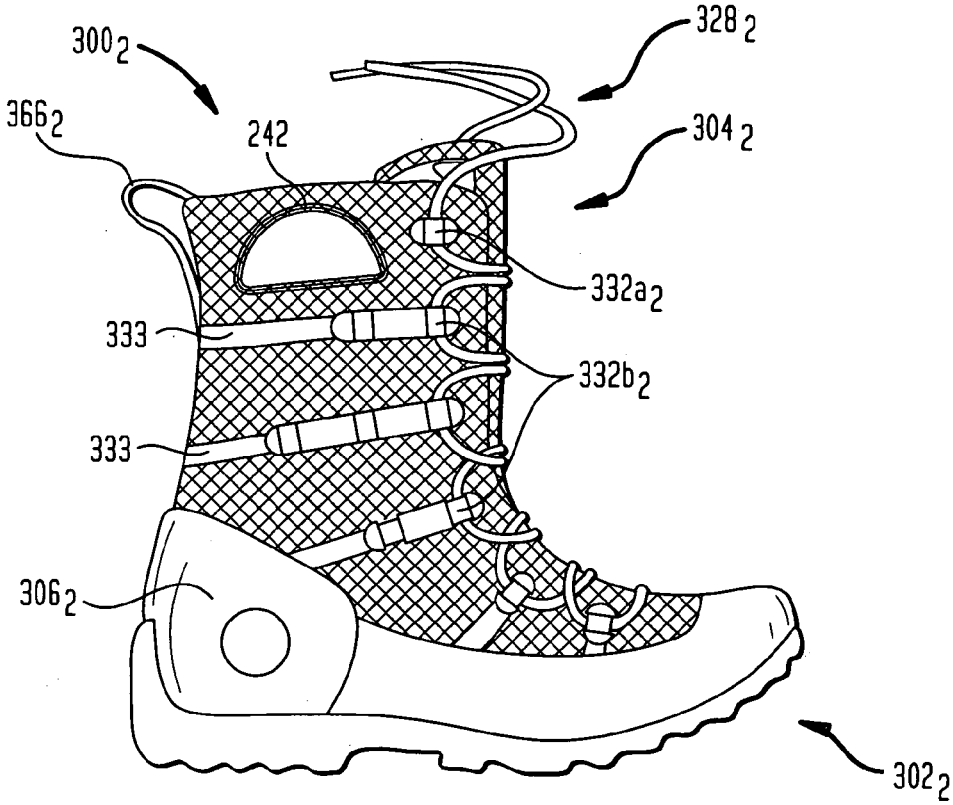
FIGS. 13(*a*)-(*c*) illustrate an alternative duty boot configuration in accordance with aspects of the present invention.
Figure 13B:
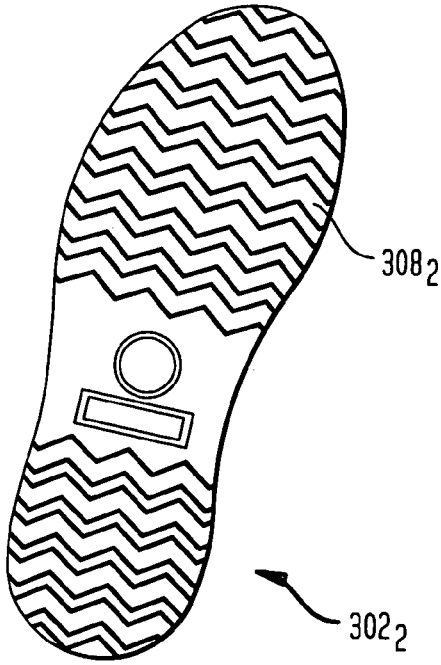
Figure 13C:
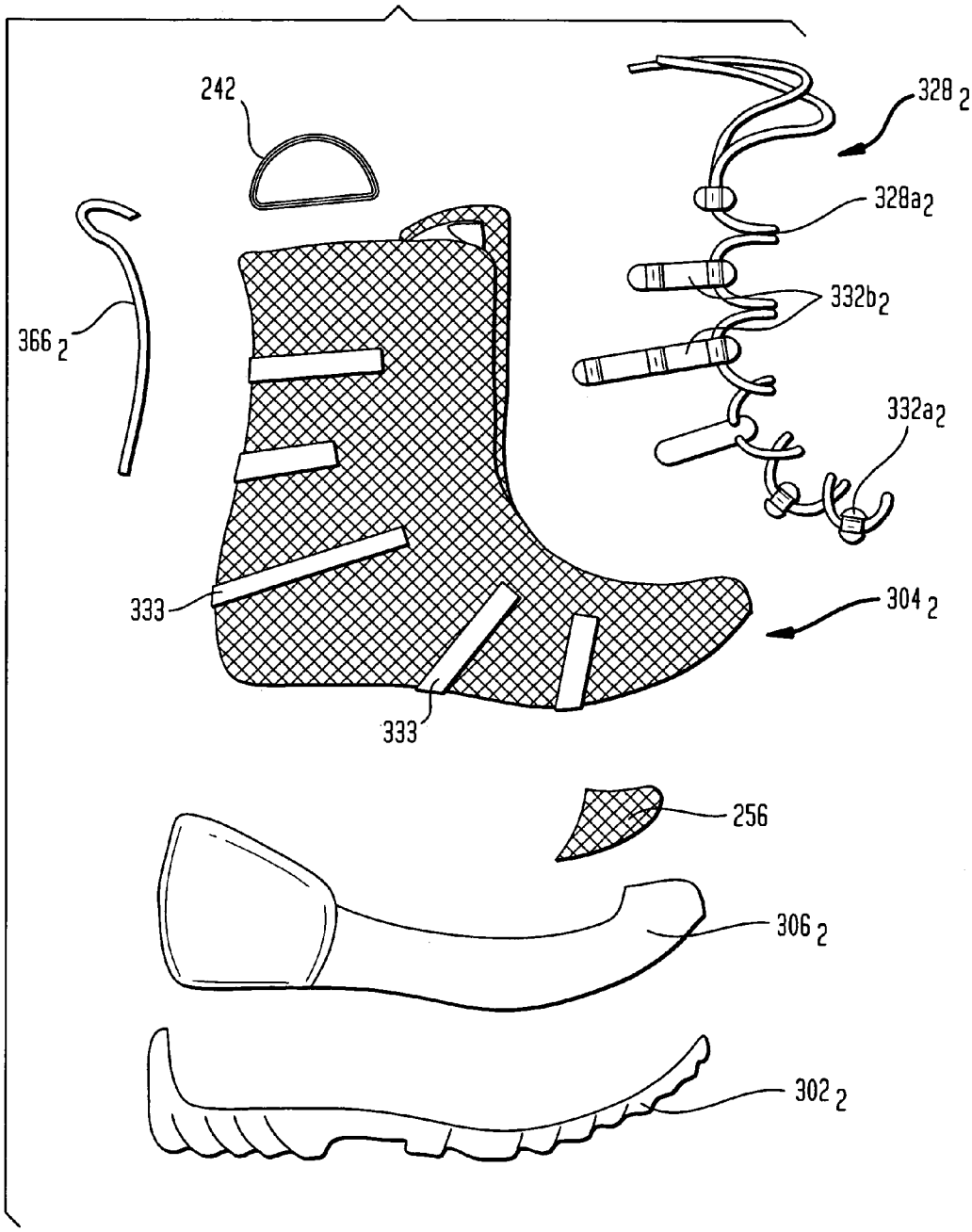

FIGS. 13(*a*) and 13(*b*) illustrate side and bottom views, respectively, of another version of the article of footwear 300, namely article of footwear $\mathbf{300}_2$, in accordance with aspects of the present invention. The article of footwear $\mathbf{300}_2$ is desirably formed as a "duty" type boot that is generally similar to the article of footwear $\mathbf{300}_1$ described above, and includes many of the features thereof. However, as discussed above, the duty identifier is merely exemplary of types of activities that may be performed in exemplary situations or environments, and is not meant to limit how or where any particular footwear configuration such as the article of footwear $\mathbf{300}_2$ is employed. The differences from the article of footwear $\mathbf{300}_1$ will now be described.

The fitting and securing system of the article of footwear $\mathbf{300}_2$ includes a lacing system $\mathbf{328}_2$ without a zipper apparatus.

The lacing system $328_2$ preferably comprises a single lace $328a_2$. Like the lace $328a_1$ of the lacing system 328, the lace $328a_2$ preferably crisscrosses or otherwise extends repeatedly over the tongue 326 from the medial side to the lateral side of the upper $304_2$. The lace $328a_2$ may run through one or more receptacles $332_2$ such as eyelets or D-rings $332a_2$, and/or multi-position connectors $332b_2$. The receptacles $332_2$ may be secured to upper $304_2$ using straps or webbing 333, which preferably wraps around the rear of the upper $304_2$ and is covered by pull tab $366_2$. As seen in FIG. 13(*a*) and the exploded view of FIG. 13(*c*), outsole $302_2$ is preferably cupped in the heel area. While not shown, a protective plate may be inset into the outsole $302_2$ below midsole and/or rand $306_2$. The outsole $302_2$ includes lugs $308_2$, which may be the same or different from lugs 108.

Figure 14A:
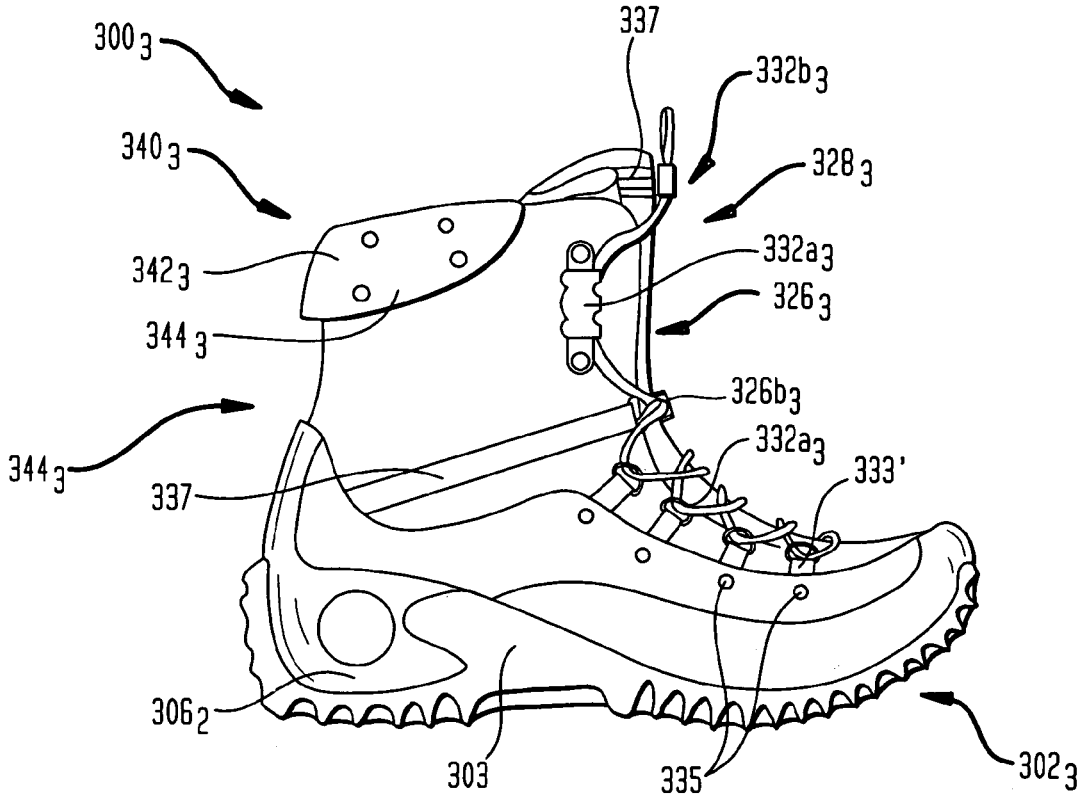
FIGS. 14(*a*)-(*c*) illustrate another duty boot configuration in accordance with aspects of the present invention.
Figure 14B:
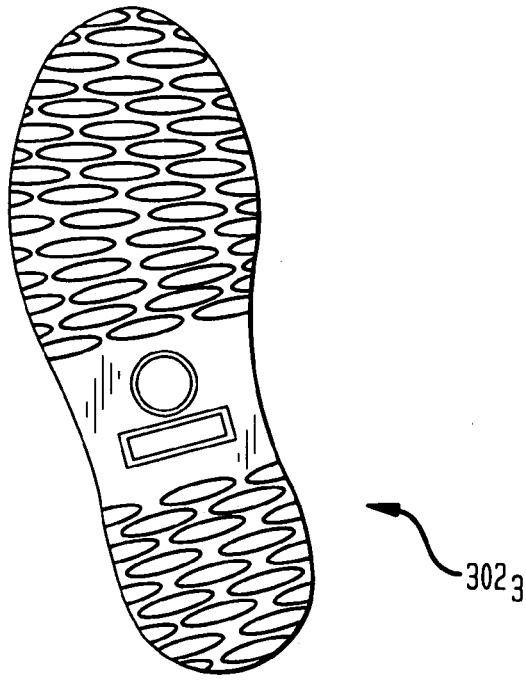
Figure 14C:
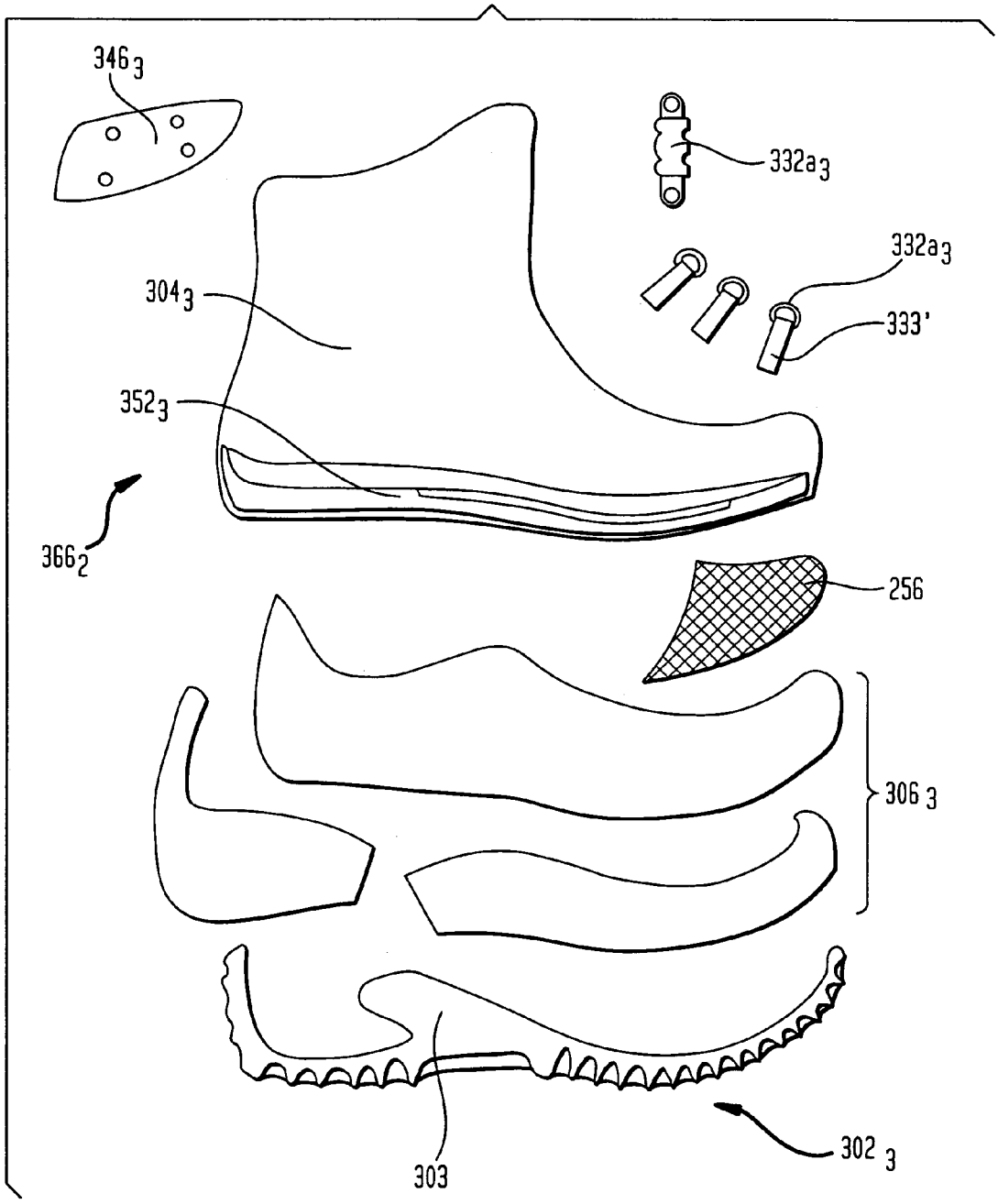
Figure 15A:
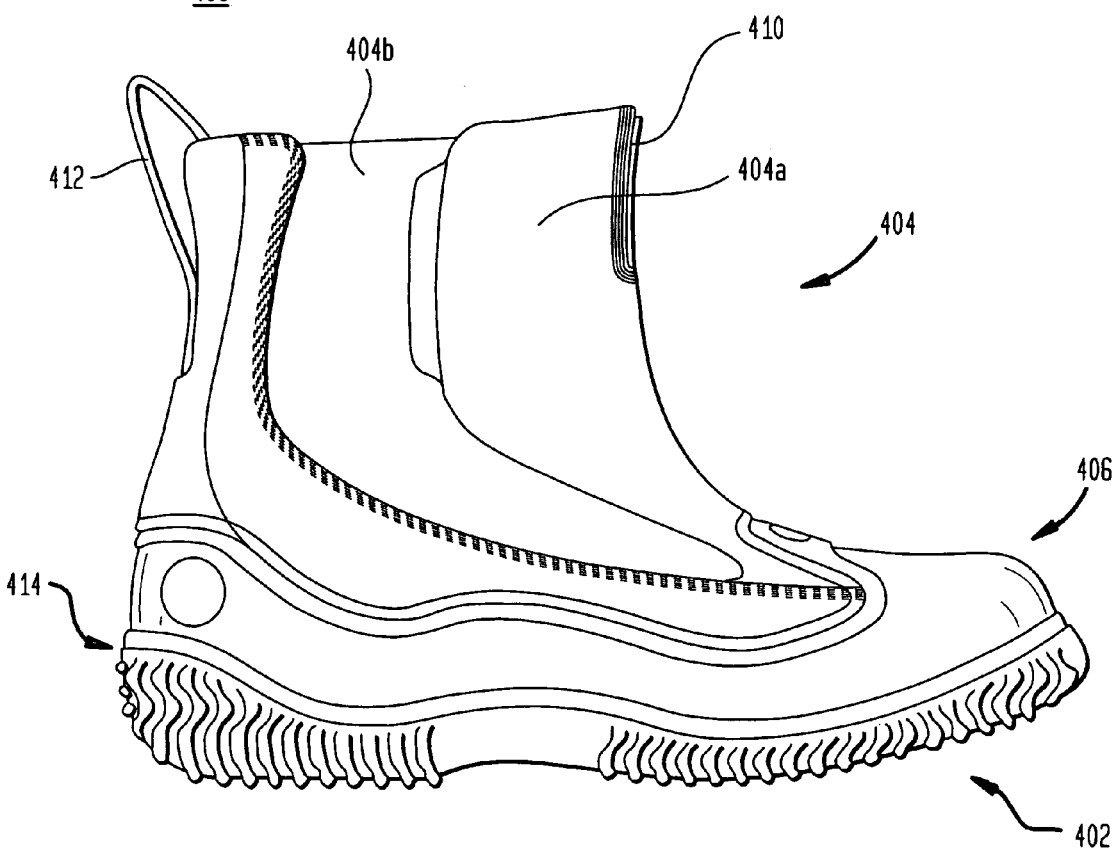
FIGS. 15(*a*)-(*e*) illustrate an article of footwear in accordance with an embodiment of the present invention in a station-type boot style.
Figure 15E:
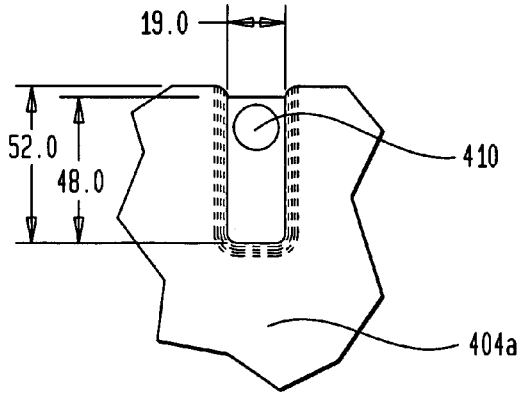
Figure 15B:
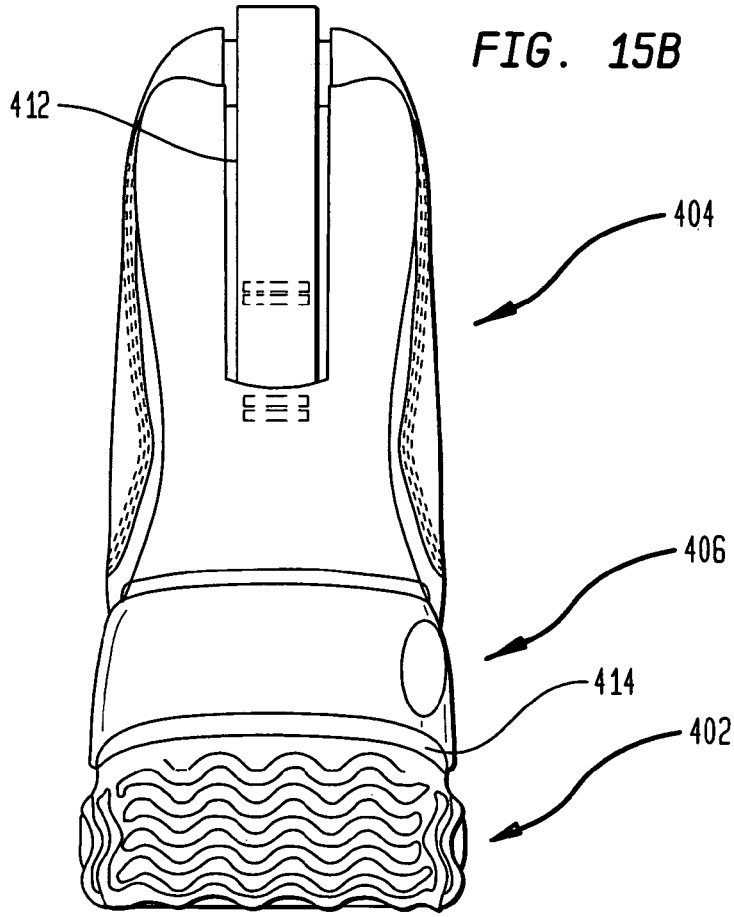
Figure 15C:
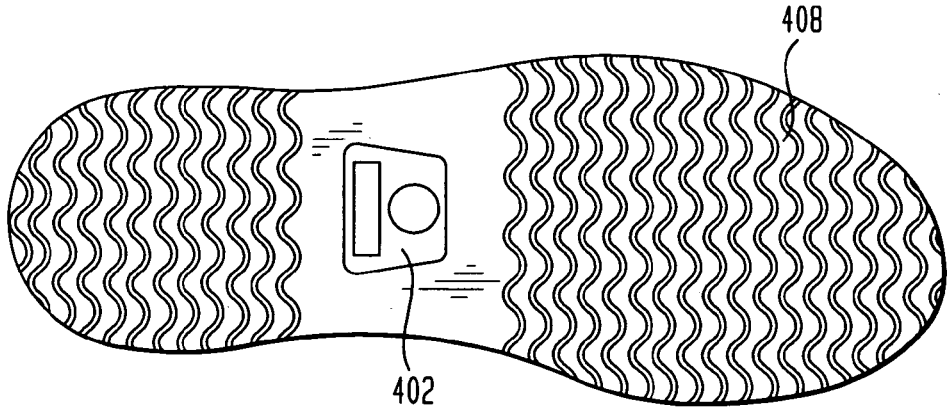
Figure 15D:
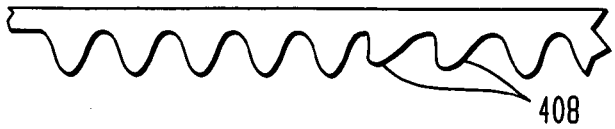

FIGS. 14(*a*) and 14(*b*) illustrate side and bottom views, respectively, of yet another version of the article of footwear 300, namely article of footwear $300_3$, in accordance with aspects of the present invention. The article of footwear $300_3$ is desirably formed as a "duty" type boot that is generally similar to the articles of footwear $300_1$ and $300_2$ described above, and includes many of the features thereof. However, as discussed above, the duty identifier is merely exemplary of types of activities that may be performed in exemplary situations or environments, and is not meant to limit how or where any particular footwear configuration such as the article of footwear $300_3$ is employed. The differences from the articles of footwear $300_1$ and $300_2$ will now be described.

The fitting and securing system of the article of footwear $300_3$ includes a lacing system $328_3$ without a zipper apparatus. The lacing system $328_3$ preferably comprises a single lace $328a_3$. Like the lace $328a_1$ of the lacing system 328, the lace $328a_3$ preferably crisscrosses or otherwise repeatedly extends transversely over the tongue 326 from the medial side to the lateral side of the upper $304_3$. The lace $328a_3$ may run through one or more receptacles $332_3$ such as eyelets or D-rings $332a_3$, and/or bungee-type connectors $332b_3$. The receptacles $332_3$ may be secured to upper $304_3$ using straps or webbing 333', which desirably is riveted or otherwise fastened to the upper $304_3$, midsole and/or rand $306_3$ using, for example, fasteners 335.

While one elasticized/bungee-type connector $332b_3$ may be used, preferably at least two elastomeric or bungee-type connectors $332b_3$ are employed. As shown in FIG. 14(*a*), a first bungee-type connector $332b_3$ is preferably positioned around the midfoot region of tongue $326_3$. This first connector $332b_3$ is used to tighten the article of footwear $300_3$ about the lower part of the foot and leg. A second bungee-type connector $332b_3$ is preferably positioned around the upper region of tongue or gusset $326_3$. This second connector $332b_3$ is used to tighten the article of footwear $300_3$ about the top thereof, for example at the middle or upper part wearer's shin. The first and second connectors $332b_3$ also help prevent loosening of the tension of the lace $328a_3$. Bands 337 may be used to secure the connectors $332b_3$ to the upper $304_3$.

As seen in FIG. 14(*a*) and the exploded view of FIG. 14(*c*), outsole $302_3$ is preferably cupped in the heel area. In addition, the outsole $302_3$ may also include one or more "wings" or side panels 303 which extend upward along the article of footwear $300_3$ over the midsole and/or the rand $306_3$. The side panels 303 may be used to provide increased stability and a more secure fit. While not shown, a protective plate may be inset into the outsole $302_3$ below the midsole and the rand $306_3$. The rand $306_3$ may be formed of one or more pieces of, for example, vulcanized rubber. As seen in FIG. 14(*c*), a footbed $352_3$ may be received within the upper $304_3$.

The article of footwear $300_3$ desirably also includes a collar $340_3$ positioned along the top of the upper $304_3$. The collar $340_3$ preferably includes one or more handle members $342_3$ positioned thereon, and may be the same as the collar 140 and handle members 142 described above. The handle members $342_3$ enable the firefighter or other first responder to easily grip the article of footwear $300_3$ so as to pull it onto his or her foot. A first handle member $342_3$ may be placed on the medial side of the collar $340_3$ and a second handle may be placed on the lateral side of the collar $340_3$. Handle members $342_3$ may also be otherwise configured as described herein.

As with the handle members 142, the handle members $342_3$ are most preferably integrally formed with the collar $340_3$ and have a gripping overhang or lip $344_3$ that is positioned below the top line or upper surface of the collar $340_3$. In addition, the gripping overhang $344_3$ need only be spaced on the order of 15 cm or less away from the side of the upper $304_3$. Preferably, the gripping overhang $344_3$ is less than about 4-6 cm, such as approximately 2-3 cm away from the side of the upper $304_3$. This slight, streamlined projection is sufficient to enable the firefighter to grab onto, while providing a low profile that substantially reduces the likelihood of accidentally catching or snagging onto debris, equipment or other material or structures. More desirably, the spacing of the gripping overhand $344_3$ may be on the order of 6 cm, more preferably about 2-3 cm or less. Each handle member $342_3$ may comprise a folded over portion of the top of the upper $304_3$, and may be affixed at one or more points by fasteners such as rivets $346_3$. In this case, the folded over portion of the upper $304_3$ may have a wicking lining to promote moisture evaporation.

FIGS. 15(*a*) and 15(*b*) illustrate side and rear views, respectively, of an article of footwear 400 in accordance with aspects of the present invention. The article of footwear 400 is desirably formed as a "station" type boot for use in everyday activities around the firehouse or elsewhere. For example, the station boot 400 may be used while cleaning and servicing a fire truck, ambulance, police car, garbage truck, etc. However, as discussed above, the station identifier is merely exemplary of types of activities that may be performed in exemplary situations or environments, and is not meant to limit how or where any particular footwear configuration such as the article of footwear 400 is employed. As with the articles of footwear described above, the article of footwear 400 comprises several components, namely an outsole 402, an upper 404, and a rand 406. The outsole 402 provides a ground contacting surface. The upper 404 provides a receptacle or enclosure for receiving a wearer's foot. The rand 406 provides extra protection to the article of footwear 400. The rand 406 may be fabricated and employed as a distinct component, or may be fabricated integrally or otherwise employed in conjunction with, for example, the outsole 402 and/or a midsole.

As best seen in FIGS. 15(*c*)-(*d*), the outsole 402 preferably includes a tread in the form of lugs 408. The lugs 408 may be formed in one or more rows extending, for example, from the medial to the lateral side of the outsole 402. The rows of lugs 408 desirably have a wavy pattern as seen in the bottom view of FIG. 15(*c*). The side view of the lugs 408 in FIG. 15(*d*) shows that the lugs 408 are preferably pliable. Pliability is desirable, for example, so that the lugs 408 may articulate during wear, which provides enhanced traction on wet surfaces. Most preferably, the lugs 408 are articulating lugs, as shown and described in U.S. Patent Publication No. 2005/0081405, entitled FOOTWEAR WITH ARTICULATING OUTSOLE LUGS, published Apr. 21, 2005, the entire disclosure of which is hereby expressly incorporated by reference herein. Of course, it should be understood that such articulating lugs may be employed in accordance with any of the outsole embodiments discussed herein.

Figure 19A:
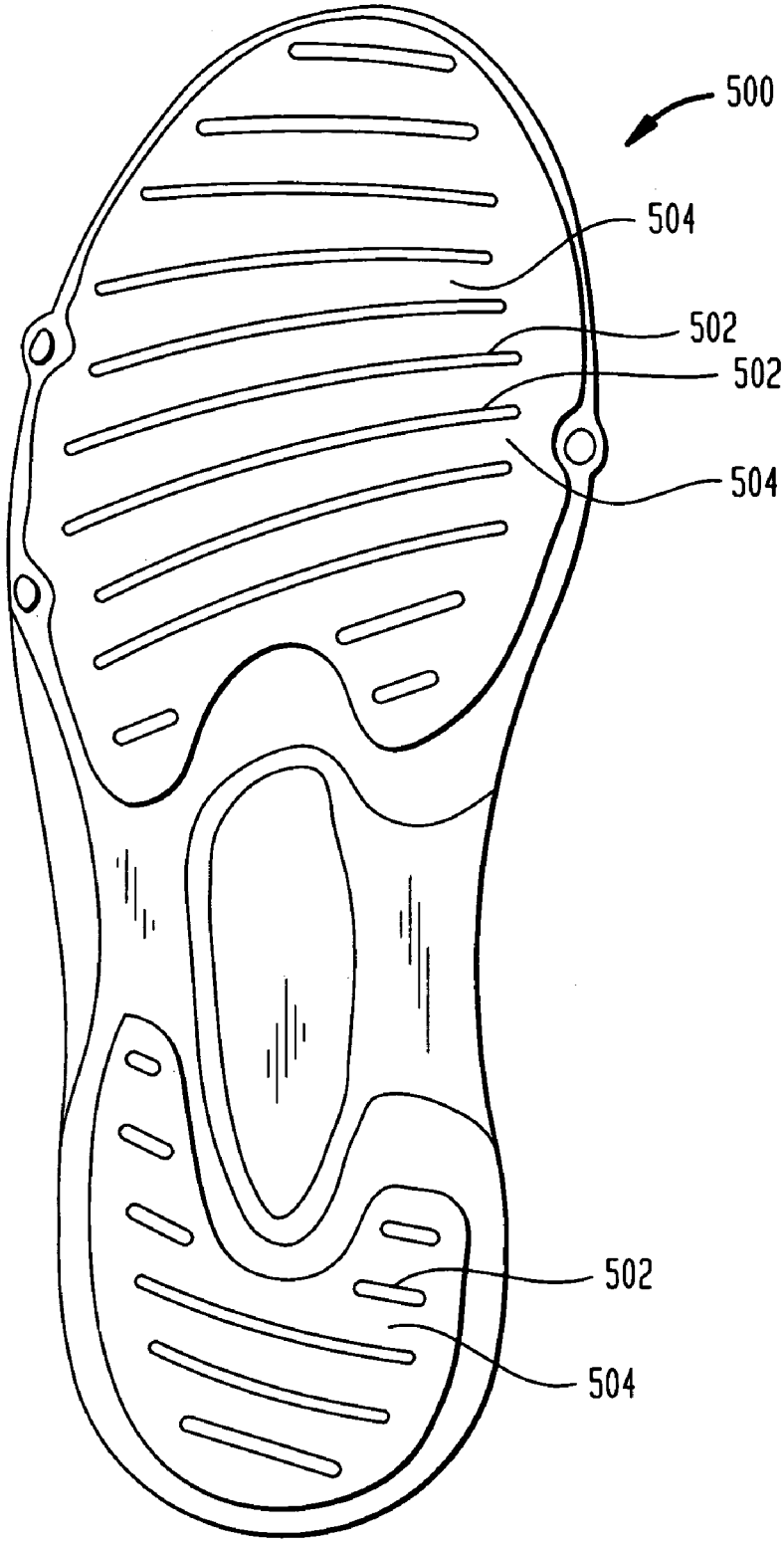
FIGS. 19(*a*)-(*c*) illustrate alternative outsole configurations in accordance with aspects of the present invention.
Figure 19C:
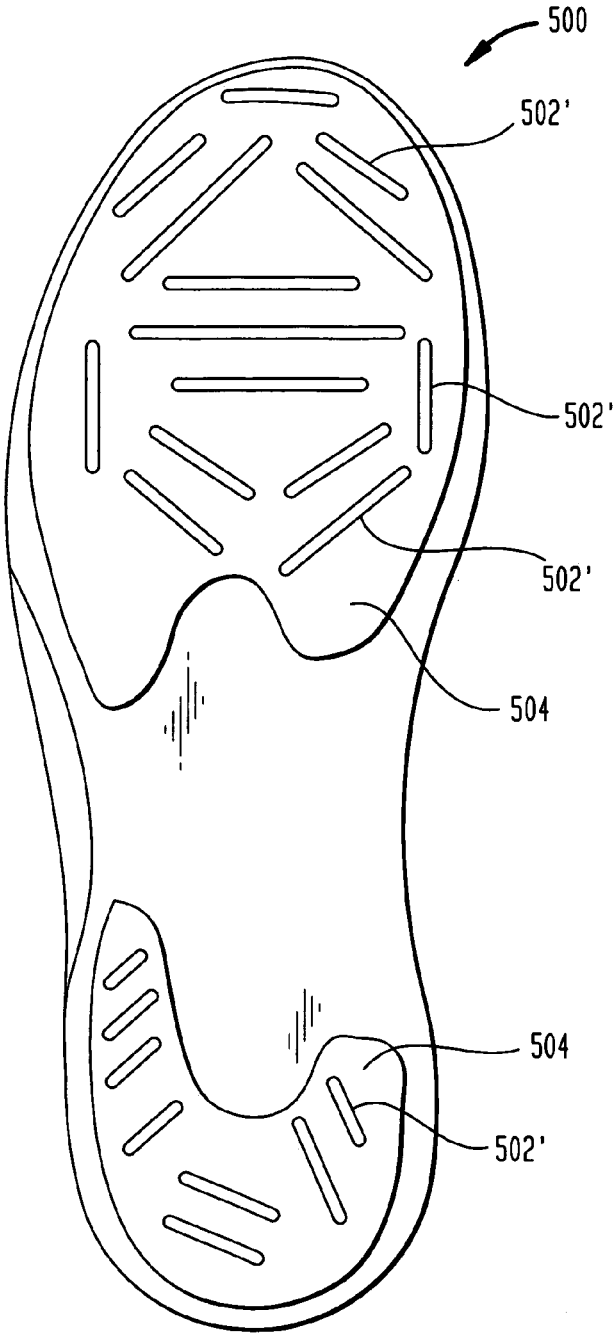
Figure 19B:
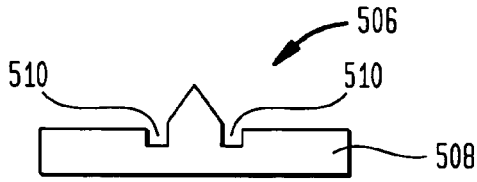

Other outsole configurations can also be used for enhanced wet surface traction. FIGS. 19(*a*)-(*c*) illustrate alternative outsole configurations in accordance with aspects of the present invention, which can be used with any of the articles of footwear described above, as well as with other types of footwear.

Referring now to FIG. 19(*a*), outsole 500 is illustrated having a set of blade-like traction elements. Specifically, positioned on the outsole 500 are a number of elongated, raised ridge members 502. The elongated raised ridge members 502 are designed to be beneficial by providing traction on wet surfaces and act like wiper blades or squeegee blades to remove water from the surface of the outsole 500. Preferably, the members 502 comprise PU, EVA and/or thermoplastic rubber ("TPR"), although other known outsole materials or combinations thereof can also be employed. The members 502 may be integrally formed as part of the outsole 500, or, alternatively, may be fabricated separately from the rest of the outsole 500 and then attached or otherwise securing during the manufacturing process. Optionally, the members 502 may be sold separately so that the wearer can attach members 502 at selected positions along the outsole 500 as he or she sees fit.

During a standard walking or running gait cycle, there is a small amount of translational movement between the shoe and the ground surface. This translational movement is evident during the "heel strike" and "toe off" phases of motion as the ground reaction forces are changed from no forces when the shoe is off the ground to braking forces when the shoe comes into contact with the ground to propulsion forces as the center of mass is moved forward towards the front of the shoe during the toe off phase. During these small translational movements, there is an opportunity to remove water from a surface by using these movements to squeegee the surface. As water is removed from the surface, outsole material 504 that is positioned adjacent to the members 502 can now come into contact with a dry surface thus greatly increasing traction. It is well known that the coefficient of friction on a dry surface is at least double and often more than double the coefficient of friction on a wet surface.

In more extreme movements where there is a great deal of translational movement, the effectiveness of the members 502 increases. For instance, in extreme movements where a person starts to slip, there is increased translational movement between the shoe and ground. In these situations, the members 502 are dragged across the ground surface and remove water from a larger area of the surface. This provides a larger dry surface that the adjacent outsole material 504 can grip in order to arrest the slipping. The outsole material 504 may be smooth or otherwise planar, or may include lugs such as the lugs 408, siping such as the siping 116, and/or spaces or regions devoid of traction elements. In order to promote water removal, the members 502 are preferably flexible and/or bendable in response to movement such as translational movement between the shoe and the ground.

The design of the leading edge geometry of the members 502 is critical in providing effective removal of the water from the surface. In order to effectively remove water from a surface, the geometry should come to a point or similar narrowed geometry forming an apex in areas where the member 902 comes into contact with the surface.

As seen in FIG. 19(*b*), the member 502 preferably includes a pointed tip 506 attached to a base section 508. Recesses, spacing or voids 510 may be positioned along either side of the tip 506. Given that the normal force remains constant and is equal to the force exerted by the person, the pointed tip 506 on the member 502 focuses and increases pressure between the article of footwear and the ground surface. This increased pressure between the two surfaces keeps fluids from seeping under the member 502. Other geometries (ones with increased surface area) will decrease the pressure between the two surfaces and increase the chance of fluids escape between the surfaces.

The members 502 may be positioned in any configuration and may be applied to any area of the outsole 500; however, the members 502 will be more effective in the heel and forefoot regions of the outsole 500. FIG. 19(*a*) shows the members 502 in a generally parallel arrangement running from the medial to the lateral side of the outsole 500. Alternatively, the members 502 can be oriented at different angles to account for the varied forces and movements that occur during a gait cycle. For instance, there are large anterior-posterior forces during heel strike and toe off. Medial-lateral forces are also present during a normal walking gait and these side to side forces increase during any turning motion by the person. Moreover, on uneven surfaces like the deck of a sail boat, the forces will be directed towards the low side of the boat as someone maneuvers over the deck. For all these, reasons, the members may be oriented at various angles. FIG. 19(*c*) illustrates an alternative in which members 502' are oriented at various positions along the outsole 500. Specifically, some of the members 502' may run generally transverse to the outsole 500, while others may run in a generally longitudinal direction. Still other ones of the members 502' may be positioned along paths that are neither transverse nor longitudinal.

Returning to FIG. 15(*a*), it can be seen that the upper 404 preferably comprises regions of different material. Specifically, the upper 404 desirably includes at least one first region 404*a* of a waterproof material, for example waterproof suede or leather. The upper 404 desirably also includes at least one second region 404*b* of a stretchable or elasticized material, such as a silicon or neoprene sheet. The second region 404*b* enables the wearer to pull or stretch the upper 404 when putting the article of footwear 400 on or taking it off, and also enables the article of footwear 400 to comfortably flex during wear. The second region 404*b* may include a reinforced backing material (not shown) facing the interior of the upper 404, and optionally an outer coating or layer of a glossy finish on the exterior. Both of the medial and lateral sides of the upper 404 may include one or more of the second regions 404*b*. As best seen in FIG. 15(*e*), the upper 404 may also include a section or region 410 on the front thereof. The section 410 may comprise the same or equivalent material as is used with the second region 404*b*, or may comprise a rigid or pliable material such a stretchable narrow fabric, rubber, leather, or synthetic. The upper 404 may also include a pull tab 412, which is preferably positioned along the upper heel portion of the upper 404 in close proximity to the collar.

Figure 16A:
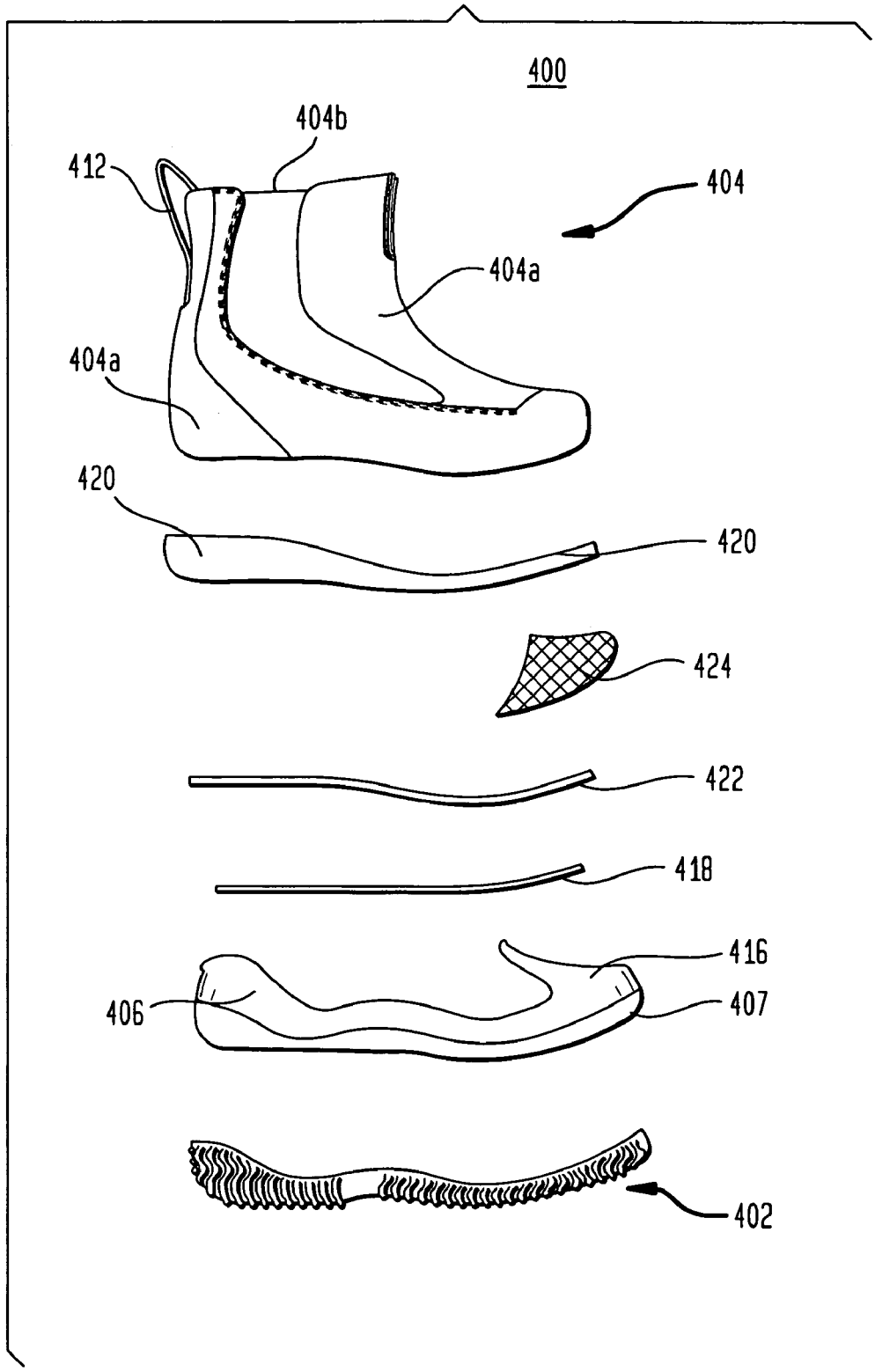
FIGS. 16(*a*)-(*c*) illustrate additional views of the article of footwear of FIGS. 15(*a*)-(*e*).
Figure 16B:
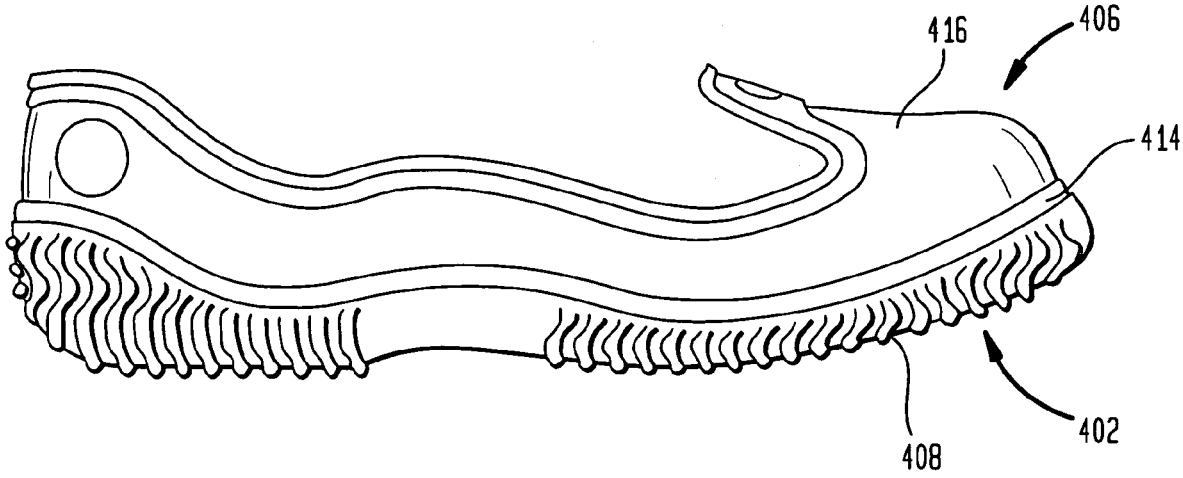
Figure 16C:
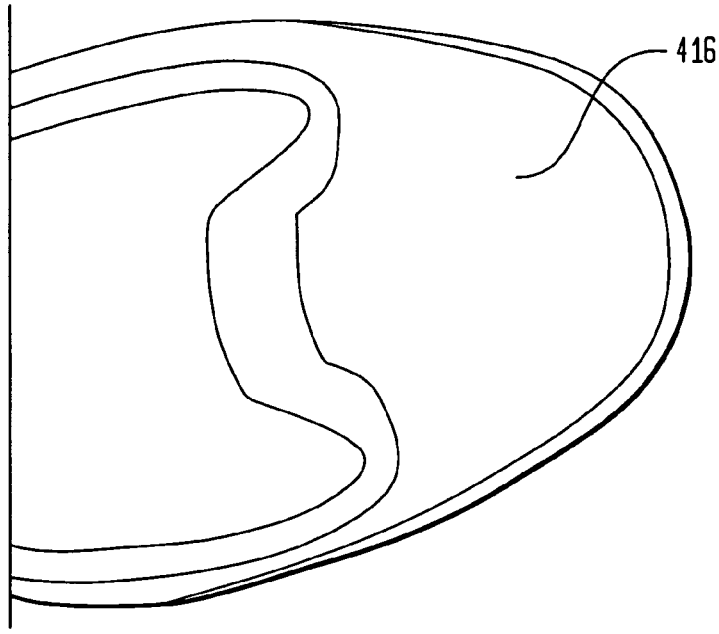

Midsole 407, as seen in FIG. 16(*a*), may be positioned above the outsole 402. A reflective indicator 414 may be positioned on, adjacent or above the outsole 402. The reflective indicator 414 desirably runs substantially or entirely around the article of footwear 400 at the top line of the outsole. In addition, the reflective indicator 414 may be configured as an inset groove positioned circumferentially, e.g. circumferentially along the top edge of the outsole.

In one alternative, the rand 406 preferably comprises a molded leather or rubber compound, which can be formed in several different ways as explained above with regard to the rands 106 or 206. In another example, the midsole 407 may comprise EVA, such as IMEVA, polyurethane PU, or combinations of these materials. However, other materials may be used alone or in combination to form the midsole 407 and/or the rand 406. Such materials include, but are not limited to, polyester and polyether based polyurethane, rubber, plastics, or any of the other materials discussed herein.

As shown in the exploded view of the article of footwear 400 in FIG. 16(*a*), the reflective indicator 414 may be applied substantially or entirely along the upper portion of the outsole. In addition, the rand 406 may include a protective toe guard 416, which is desirably integrally molded as part of the rand 406. Alternatively, the toe guard 416 may be attached to the upper 404, adjacent to the rand 406 during fabrication of the article of footwear 400. The rand 406 may also be integrally molded or otherwise formed with the outsole 402 and/or the midsole 407. A puncture resistant plate such as a steel plate 418, may be disposed above or below the midsole 407 for enhanced support or protection of the wearer's foot.

A footbed 420 may be permanently or removably positioned within the article of footwear 400. The footbed 420 is preferably positioned on or over the midsole 407, for instance on top of a lasting board 422 and the optional steel plate 418 between the footbed 420 and the midsole 407. The footbed 420 may be formed from resilient materials such as EVA or PU foams or other such materials commonly used in shoe midsoles, insoles or sockliners. Furthermore, the footbed may be an adjustable footbed as described herein.

As discussed above with regard to the footbed 152, the footbed 420 may be formed of one or more material layers, regions and/or segments, which may each have a different thickness and/or a different rigidity. For example, the footbed 420 may comprise multiple layers of different rigidity. Alternatively, the footbed 420 may have different levels of rigidity in the forefoot, instep and heel regions, respectively. The footbed 420 could also have a first segment about the first metatarsal on the medial side of the forefoot of a first rigidity and a second segment about the fifth metatarsal on the lateral side of the forefoot of a second rigidity. In a preferred example, a first layer or region of the footbed 420 comprises EVA foam such as CMEVA, and a second layer or region of the footbed 420 includes an antimicrobial component.

Lasting board 422 can also serve as an insulating member to provide enhanced thermal protection is desirably placed between the steel plate and the footbed. A toe protector 424 may be connected to or integrally formed with the upper 404 for added protection of the wearer's toes. The toe protector 424 may be, for example, steel, a composite plastic, a ceramic or other material or combinations of material. Furthermore, the toe protector 424 may be used with or without the toe guard/toe cap 416 (which is part of the rand 406) or as a separate protective layer of material for the toe cap 416. FIG. 16(*b*) is a side view illustrating the assembled outsole 402 and rand 406, and shows the reflective indicator 414. FIG. 16(*c*) is a top view of the forefoot region showing the toe cap 416 of the rand 406, which covers the toe area of the foot and extends upward with molded sections of the rand 406 denoted in the shaded area across the forefoot.

Figure 17A:
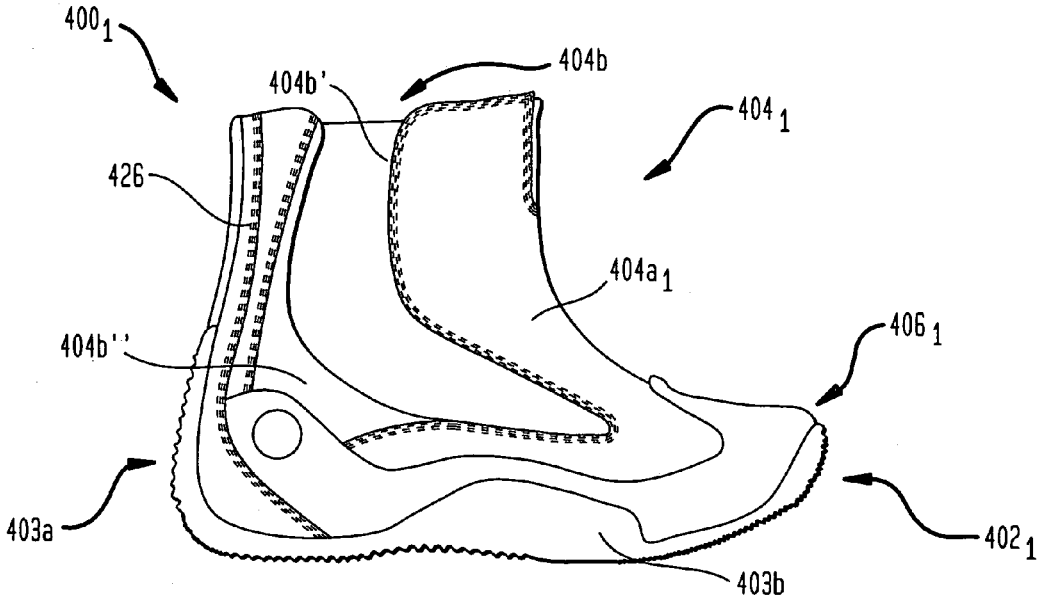
FIGS. 17(*a*)-(*b*) illustrate an alternative station-type boot configuration in accordance with aspects of the present invention.
Figure 17B:
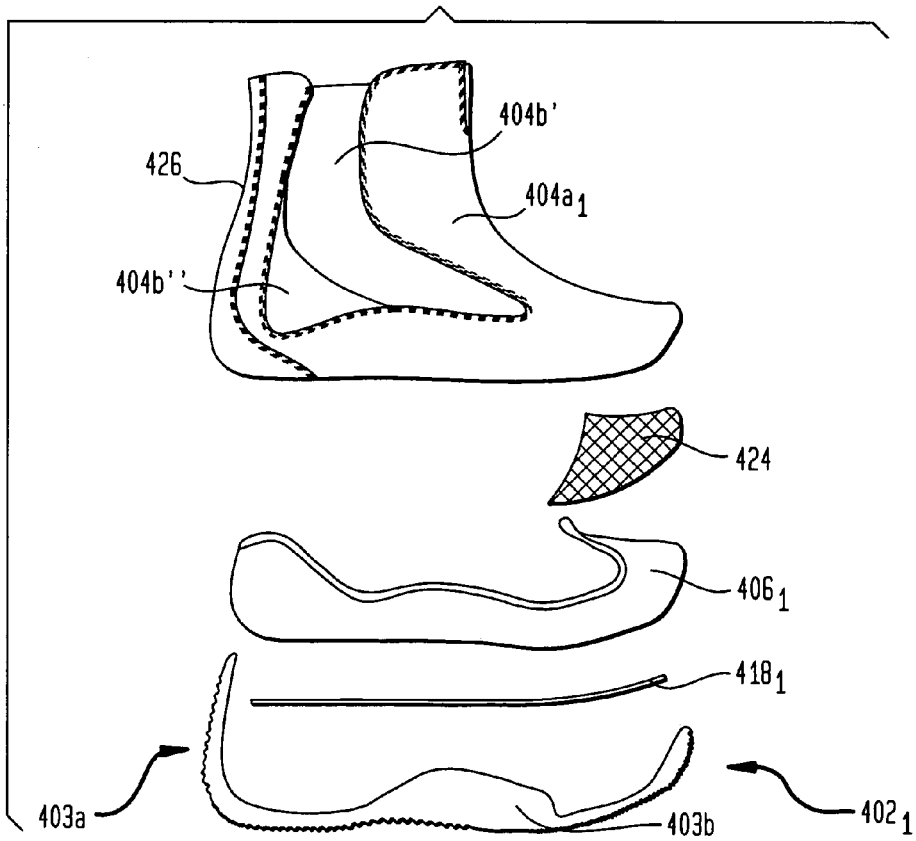

FIGS. 17(*a*) and 17(*b*) illustrate side and exploded views, respectively, of an alternative version of the article of footwear 400, namely article of footwear $\mathbf{400}_1$, in accordance with aspects of the present invention. The article of footwear $\mathbf{400}_1$ is desirably formed as a "station" type boot for use in everyday activities around the firehouse. However, as discussed above, the station identifier is merely exemplary of types of activities that may be performed in exemplary situations or environments, and is not meant to limit how or where any particular footwear configuration such as the article of footwear $\mathbf{400}_1$ is employed. As with the article of footwear 400, the article of footwear $\mathbf{400}_1$ comprises several components, namely an outsole $\mathbf{402}_1$, an upper $\mathbf{404}_1$, and a rand $\mathbf{406}_1$. The outsole $\mathbf{402}_1$ provides a ground contacting surface. The upper $\mathbf{404}_1$ provides a receptacle or enclosure for receiving a wearer's foot. The rand $\mathbf{406}_1$ connects the outsole $\mathbf{402}_1$ and the upper $\mathbf{404}_1$ together. While not shown, a midsole may also be employed. The differences from the article of footwear 400 will now be described.

The outsole $\mathbf{402}_1$ is preferably cupped in the heel area 403*a*, extending upward beyond the rand section of the article of footwear. In addition, the outsole $\mathbf{402}_1$ may also include one or more "wings" or side panels 403*b* which extend upward along the article of footwear $\mathbf{400}_1$ to the top of the rand $\mathbf{406}_1$ or over the rand topline. The side panels 403*b* may be used to provide increased stability, and a more secure fit. As seen in FIG. 17(*b*), protective plate $\mathbf{418}_1$ may be inset over or near the outsole $\mathbf{402}_1$ below the midsole (if any) and preferably below the rand $\mathbf{406}_1$ not shown. The rand $\mathbf{406}_1$ may be formed of one or more pieces of, for example, vulcanized rubber or molded TPU, leather or synthetic material.

The first region $\mathbf{404}a_1$ is preferably formed of a waterproof and durable material such as abrasion resistant, waterproof leather or synthetic leather. Second region 404*b* of the upper $\mathbf{404}_1$ may comprise a first section 404*b*' and a second section 404*b*'. The first section 404*b*' may be a stretchable material, such as a stretchable fabric, a rubber, leather, or synthetic material. The second section 404*b*' may be, for example, an abrasion resistant material such as a treated leather or synthetic as well as have protective qualities if backed by a softer material like foam or felt to add a protection element to the ankle region. A protective reinforcement 426 may be added to the heel section of the upper 404. While not shown, the protective reinforcement 426 may include a pull tab to promote donning or doffing the article of footwear 400.

Figure 18A:
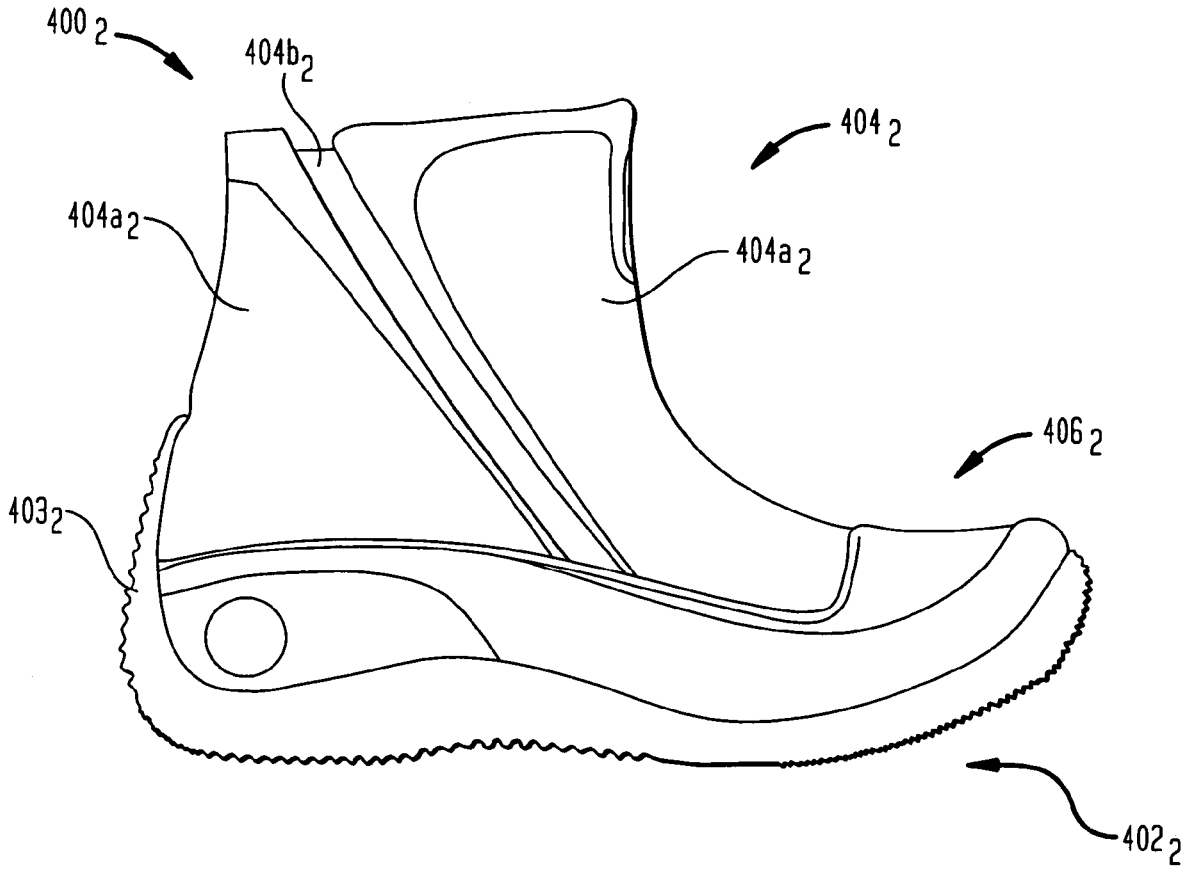
FIGS. 18(*a*)-(*b*) illustrate another station-type boot configuration in accordance with aspects of the present invention.
Figure 18B:
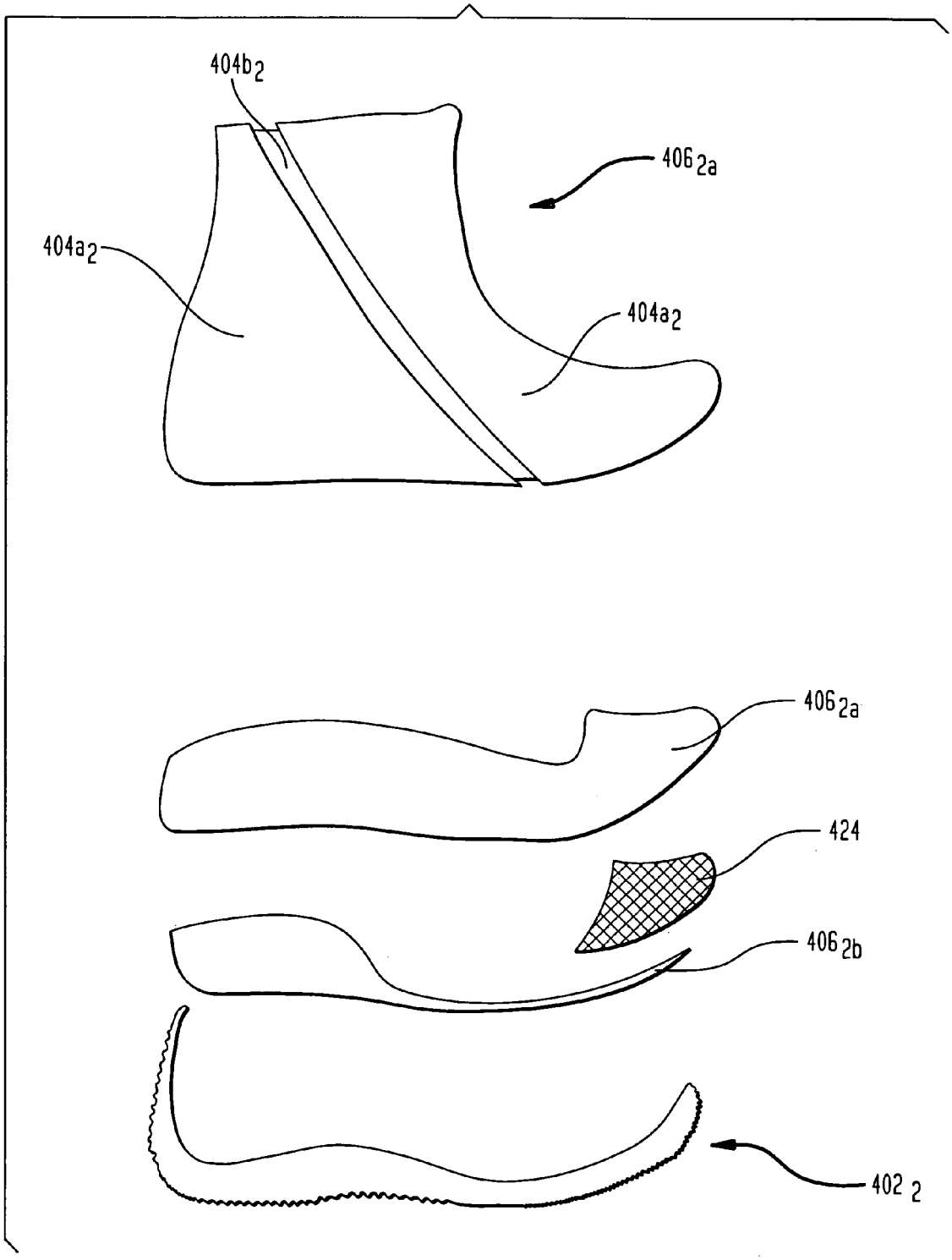

FIGS. 18(*a*) and 18(*b*) illustrate side and exploded views, respectively, of another version of the article of footwear 400, namely article of footwear $\mathbf{400}_2$, in accordance with aspects of the present invention. The article of footwear $\mathbf{400}_2$ is desirably formed as a "station" type boot for use in everyday activities around the firehouse. However, as discussed above, the station identifier is merely exemplary of types of activities that may be performed in exemplary situations or environments, and is not meant to limit how or where any particular footwear configuration such as the article of footwear $\mathbf{400}_2$ is employed. As with the articles of footwear 400 and $\mathbf{400}_1$, the article of footwear $\mathbf{400}_2$ comprises several components, namely an outsole $\mathbf{402}_2$, an upper $\mathbf{404}_2$, and a rand $\mathbf{406}_2$. The outsole $\mathbf{402}_2$ provides a ground contacting surface. The upper $\mathbf{404}_2$ provides a receptacle or enclosure for receiving a wearer's foot. The rand $\mathbf{406}_2$ is a protective layer for the lower part of the upper $\mathbf{404}_2$ to resist abrasion and or create a waterproof structure. The rand $\mathbf{406}_2$ may also, in some cases, provide a fireproof/heat resistant layer over the lower portion of the upper $\mathbf{404}_2$. The article of footwear $\mathbf{400}_2$ is generally similar to the article of footwear $\mathbf{400}_1$, and the differences between them will now be described.

As with the outsole $\mathbf{402}_1$, the outsole $\mathbf{402}_2$ is preferably cupped in the heel area $\mathbf{403}_2$. However, in this embodiment, the outsole $\mathbf{402}_2$ does not include "wings" or side panels.

As with the uppers 404 and $\mathbf{404}_1$, the upper $\mathbf{404}_2$ desirably includes at least one first region $\mathbf{404}a_2$ of a waterproof material, for example waterproof suede or leather, and at least one second region $\mathbf{404}b_2$ of a stretchable material, such as a stretchable fabric, a webbing, stretchable tape or neoprene. In this case, however, the first region $\mathbf{404}a_2$ desirably comprises a pair of regions separated by the second region $\mathbf{404}b_2$. The second region $\mathbf{404}b_2$ is preferably a narrow strip or band extending from the top of the upper $404_2$ to the base thereof. More preferably, the narrow strip or band is angled and is not merely a vertical strip.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

Different components and features may be utilized in any of the embodiments. By way of example only, the different outsole and collar configurations, including lugs and handles, may be used with any of the articles of footwear. The locking bands and tibia/shin protectors in the call boots may be used with duty and/or station boots. The various dual lacing and zipper systems in the duty boots can be used in any combination. The traction elements described in relation to FIGS. 19(*a*)-(*c*) can be used with any of the embodiments discussed herein. The dimensions or other configurations of any particular component in a given embodiments may be used in any other embodiment. Furthermore, the materials for the components described herein may be interchanged or used in any combination. Finally, while the call, duty and station identifiers have been used with regard to particular conditions and environments, the are merely exemplary and are not meant to limit how or where any particular footwear configuration in accordance with the present invention is employed.

The invention claimed is:

1. An article of footwear, comprising:

an outsole having a first surface for contacting the ground and a second surface remote from the first surface; and an upper attached to the second surface of the outsole, the upper having an interior surface defining a cavity for receiving a foot, an exterior surface, and a collar having a top line providing an opening to the cavity, the collar including an integral gripping member positioned below the top line of the collar adjacent the exterior surface of the upper, and the collar further including a carrying member disposed below and adjacent the top line and along a medial or lateral side of the interior surface of the upper.

2. The article of footwear of claim 1, wherein the gripping member is spaced less than about 4 cm away from the exterior surface of the upper.

3. The article of footwear of claim 1, wherein the gripping member comprises a folded-over section of the collar that is attached to the exterior surface of the upper with a fastener.

4. The article of footwear of claim 1, wherein the gripping member has an outer surface substantially aligned with the exterior surface of the upper.

5. The article of footwear of claim 1, further comprising a securing member disposed across the upper from a medial to a lateral side of the article of footwear for securing the foot within the cavity.

6. The article of footwear of claim 5, wherein the securing member comprises at least one locking strap having a first section that is fixedly secured to a first one of the medial side or the lateral side and a second section that is removably connected to a second one of the medial side or the lateral side, at least one of the first and second sections having an elastic portion to allow for stretching and adjustment of the at least one locking strap.

7. The article of footwear of claim 6, wherein the first section is disposed within a channel along an interior section of the upper between the interior surface and the exterior surface, and the second section fastens to the exterior surface of the upper with a fastening system.

8. The article of footwear of claim 1, further comprising a tibia guard positioned along an anterior portion of the upper.

9. The article of footwear of claim 8, wherein the tibia guard has a first surface in contact with an exterior surface of the anterior portion and a second surface remote from the first surface, the second surface including a plurality of ridges thereon, the ridges being operable to provide traction and protection to a wearer of the article of footwear.

10. The article of footwear of claim 1, further comprising a reflective indicator that runs substantially around an outer surface of the article of footwear, the reflective indicator being adjacent to at least one of the upper and the outsole.

11. The article of footwear of claim 10, wherein the outsole includes an inset groove positioned circumferentially along the article of footwear, at least a portion of the reflective indicator being disposed on the inset groove.

12. The article of footwear of claim 1, wherein the outsole includes lugs disposed along the first surface thereof, a first set of the lugs having a substantially triangular pattern and being arranged in at least one row from the medial to the lateral side of the article of footwear, at least some of the first set of lugs including siping along bottoms thereof, a second set of the lugs comprising ridges and being disposed at a toe region and at a heel region of the outsole.

13. The article of footwear of claim 1, further comprising an ankle protection pad disposed on the medial or the lateral side of the upper.

14. The article of footwear of claim 13, wherein the protection pad comprises a pair of ankle protection pads, a first one of the pair being disposed on the medial side of the upper and a second one of the pair being disposed on the lateral side of the upper, the pair of ankle protection pads each comprising a protective insert, an inner lining disposed along a first side of the protective insert, an outer lining disposed along a second side of the protective insert, and an outer cover disposed over the outer lining.

15. The article of footwear of claim 1, further comprising a heel guard disposed along a heel section of the exterior surface of the upper, the heel guard including an indicator having identification data disposed thereon.

16. An article of footwear, comprising:

an outsole having a first surface for contacting the ground and a second surface remote from the first surface;

an upper attached to the second surface of the outsole, the upper having an interior surface defining a cavity for receiving a foot, an exterior surface, and a collar having a top line providing an opening to the cavity, the collar including an integral gripping member positioned on a medial or lateral side of the exterior surface below the top line of the collar;

a carrying member disposed along a medial or lateral side of the interior surface of the upper below and adjacent to the top line the collar;

a pair of strap members disposed across the upper from a medial to a lateral side of the article of footwear for retaining the foot within the cavity, the strap members each comprising an elasticized locking strap having a first section that is fixedly secured to a first one of the medial side or the lateral side and a second section that is removably connected to a second one of the medial side or the lateral side;

a tibia protector disposed along an anterior section of the upper, the tibia protector including a series of outwardly extending transverse ridges thereon;

a pair of ankle protection pads disposed on the medial and lateral sides of the upper;

an indicator comprising a reflective inset member positioned circumferentially around the article of footwear adjacent to the outsole;

a removable footbed disposed within the cavity of the upper;

a reinforcing plate disposed between the removable footbed and the outsole; and an insulating member disposed between the removable footbed and the outsole.

* * * * *